US008152957B2

(12) United States Patent
Edwards et al.

(10) Patent No.: US 8,152,957 B2
(45) **Date of Patent: *Apr. 10, 2012**

(54) FABRIC CREPED ABSORBENT SHEET WITH VARIABLE LOCAL BASIS WEIGHT

(75) Inventors: Steven L. Edwards, Fremont, WI (US); Guy H. Super, Menasha, WI (US); Stephen J. McCullough, Mount Calvary, WI (US); Ronald R. Reeb, De Pere, WI (US); Hung Liang Chou, Neenah, WI (US); Kang Chang Yeh, Neenah, WI (US); John H. Dwiggins, Neenah, WI (US); Frank D. Harper, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/924,233

(22) Filed: Sep. 23, 2010

(65) Prior Publication Data

US 2011/0011545 A1 Jan. 20, 2011

Related U.S. Application Data

(60) Division of application No. 12/319,508, filed on Jan. 8, 2009, now Pat. No. 7,820,008, which is a division of application No. 11/804,246, filed on May 16, 2007, now Pat. No. 7,494,563, which is a continuation-in-part of application No. 10/679,862, (Continued)

(51) Int. Cl.
*B31F 1/07* (2006.01)
*B31F 1/12* (2006.01)

(52) U.S. Cl. ..... 162/109; 162/111; 162/117; 428/156

(58) Field of Classification Search ..... 162/109, 162/111–113, 115–117, 123–133, 135, 158, 162/172; 156/183; 428/156, 212, 172; 264/282–283

See application file for complete search history.

(56) References Cited

U.S. PATENT DOCUMENTS 2,926,116 A 2/1960 Keim (Continued)

FOREIGN PATENT DOCUMENTS

CA 2053505 4/1992

(Continued)

OTHER PUBLICATIONS

Herbert H. Espy, Chapter 2: Alkaline-Curing Polymeric Amine-Epichlorohydrin Resins, Wet Strength Resins and Their Application, 1994, pp. 13-44, L. Chan, Editor.

(Continued)

*Primary Examiner* — Jose A Fortuna

(74) *Attorney, Agent, or Firm* — Fitzpatrick, Cella, Harper & Scinto

(57) ABSTRACT

An absorbent cellulosic sheet having a variable local basis weight includes a papermaking-fiber reticulum provided with (a) a plurality of elongated densified regions of compressed papermaking fibers, the densified regions being oriented generally along the machine direction (MD) of the sheet and having a relatively low local basis weight, as well as leading and trailing edges at their longitudinal extremities, and (b) a plurality of fiber-enriched, pileated regions connected with the plurality of elongated densified regions, the pileated regions having (i) a relatively high local basis weight and (ii) a plurality of cross-machine direction (CD) extending crests having concamerated CD profiles such that the extending crests of the pileated regions are arcuate and extend around the leading and trailing edges of the plurality of elongated densified regions.

29 Claims, 32 Drawing Sheets
(11 of 32 Drawing Sheet(s) Filed in Color)

Related U.S. Application Data filed on Oct. 6, 2003, now Pat. No. 7,399,378, said application No. 11/804,246 is a continuation-in-part of application No. 11/108,375, filed on Apr. 18, 2005, now Pat. No. 7,789,995, which is a continuation-in-part of application No. 10/679,862, said application No. 11/804,246 is a continuation-in-part of application No. 11/108,458, filed on Apr. 18, 2005, now Pat. No. 7,442,278, said application No. 11/804,246 is a continuation-in-part of application No. 11/402,609, filed on Apr. 12, 2006, now Pat. No. 7,662,257, said application No. 11/804,246 is a continuation-in-part of application No. 11/104,014, filed on Apr. 12, 2005, now Pat. No. 7,588,660, said application No. 11/804,246 is a continuation-in-part of application No. 11/451,111, filed on Jun. 12, 2006, now Pat. No. 7,585,389.

(60) Provisional application No. 60/808,863, filed on May 26, 2006, provisional application No. 60/416,666, filed on Oct. 7, 2002, provisional application No. 60/563,519, filed on Apr. 19, 2004, provisional application No. 60/673,492, filed on Apr. 21, 2005, provisional application No. 60/562,025, filed on Apr. 14, 2004, provisional application No. 60/693,699, filed on Jun. 24, 2005.

(56) References Cited

U.S. PATENT DOCUMENTS 3,058,873 A 10/1962 Keim et al.
3,432,936 A 3/1969 Cole et al.
3,545,705 A 12/1970 Hodgson
3,549,742 A 12/1970 Benz
3,556,932 A 1/1971 Coscia et al.
3,556,933 A 1/1971 Williams et al.
3,700,623 A 10/1972 Keim
3,772,076 A 11/1973 Keim
3,858,623 A 1/1975 Lefkowitz
3,974,025 A 8/1976 Ayers
3,994,771 A 11/1976 Morgan, Jr. et al.
4,041,989 A 8/1977 Johansson et al.
4,071,050 A 1/1978 Codorniu
4,102,737 A 7/1978 Morton
4,112,982 A 9/1978 Bugge et al.
4,149,571 A 4/1979 Burroughs
4,157,276 A 6/1979 Wandel et al.
4,161,195 A 7/1979 Khan
4,182,381 A 1/1980 Gisbourne
4,184,519 A 1/1980 McDonald et al.
4,225,382 A 9/1980 Kearney et al.
4,239,065 A 12/1980 Trokhan
4,314,589 A 2/1982 Buchanan et al.
4,356,059 A 10/1982 Hostetler
4,359,069 A 11/1982 Hahn
4,376,455 A 3/1983 Hahn
4,379,735 A 4/1983 MacBean
4,420,372 A 12/1983 Hostetler
4,440,597 A 4/1984 Wells et al.
4,445,638 A 5/1984 Connell et al.
4,448,638 A 5/1984 Klowak
4,453,573 A 6/1984 Thompson
4,468,254 A 8/1984 Yokoyama et al.
4,482,429 A 11/1984 Klowak
4,490,925 A 1/1985 Smith
4,528,316 A 7/1985 Sorens
4,529,480 A 7/1985 Trokhan
4,533,437 A 8/1985 Curran et al.
4,543,156 A 9/1985 Cheshire et al.
4,546,052 A 10/1985 Nicoll
4,551,199 A * 11/1985 Weldon ..... 162/109
4,552,709 A 11/1985 Koger, II et al.
4,556,450 A 12/1985 Chuang et al.
4,564,052 A 1/1986 Borel
4,592,395 A 6/1986 Borel
4,603,176 A 7/1986 Bjorkquist et al.
4,605,585 A 8/1986 Johansson
4,605,702 A 8/1986 Guerro et al.
4,611,639 A 9/1986 Bugge
4,614,679 A 9/1986 Farrington, Jr. et al.
4,637,859 A 1/1987 Trokhan
4,640,741 A 2/1987 Tsuneo
4,675,394 A 6/1987 Solarek et al.
4,675,934 A 6/1987 Dal Palu
4,689,119 A 8/1987 Weldon
4,709,732 A 12/1987 Kinnunen
4,720,383 A 1/1988 Drach et al.
4,759,391 A 7/1988 Waldvogel et al.
4,759,976 A 7/1988 Dutt
4,795,530 A 1/1989 Soerens et al.
4,803,032 A 2/1989 Schulz
4,804,769 A 2/1989 Solarek et al.
4,834,838 A 5/1989 Klowak
4,849,054 A * 7/1989 Klowak ..... 162/109
4,866,151 A 9/1989 Tsai et al.
4,942,077 A 7/1990 Wendt et al.
4,967,085 A 10/1990 Bryan et al.
4,973,512 A 11/1990 Stanley et al.
4,981,557 A 1/1991 Bjorkquist
4,983,748 A 1/1991 Tsai et al.
4,998,568 A 3/1991 Vohringer
5,008,344 A 4/1991 Bjorkquist
5,016,678 A 5/1991 Borel et al.
5,023,132 A 6/1991 Stanley et al.
5,054,525 A 10/1991 Vohringer
5,066,532 A 11/1991 Gaisser
5,085,736 A 2/1992 Bjorkquist
5,087,324 A 2/1992 Awofeso et al.
5,098,519 A 3/1992 Ramasubramanian et al.
5,103,874 A 4/1992 Lee
5,114,777 A 5/1992 Gaisser
5,129,988 A 7/1992 Farrington, Jr. et al.
5,137,600 A 8/1992 Barnes et al.
5,138,002 A 8/1992 Bjorkquist
5,167,261 A 12/1992 Lee
5,182,164 A 1/1993 Eklund et al.
5,199,261 A 4/1993 Baker
5,199,467 A 4/1993 Lee
5,211,815 A 5/1993 Ramasubramanian et al.
5,215,617 A 6/1993 Grupe
5,217,576 A 6/1993 Van Phan
5,219,004 A 6/1993 Chiu
5,223,096 A 6/1993 Phan et al.
5,225,269 A 7/1993 Bohlin
5,240,562 A 8/1993 Phan et al.
5,245,025 A 9/1993 Trokhan et al.
5,262,007 A 11/1993 Phan et al.
5,264,082 A 11/1993 Phan et al.
5,277,761 A 1/1994 Van Phan et al.
5,312,522 A 5/1994 Van Phan et al.
5,314,584 A 5/1994 Grinnell et al.
5,328,565 A 7/1994 Rasch et al.
5,336,373 A 8/1994 Scattolino et al.
5,338,807 A 8/1994 Espy et al.
5,348,620 A 9/1994 Hermans et al.
5,366,785 A 11/1994 Sawdai
5,368,696 A 11/1994 Cunnane, III et al.
5,372,876 A 12/1994 Johnson et al.
5,379,808 A 1/1995 Chiu
5,411,636 A 5/1995 Hermans et al.
5,415,737 A 5/1995 Phan et al.
5,431,840 A 7/1995 Soldanski et al.
5,449,026 A 9/1995 Lee
5,451,353 A 9/1995 Rezai et al.
5,492,598 A 2/1996 Hermans et al.
5,494,554 A 2/1996 Edwards et al.
5,501,768 A 3/1996 Hermans et al.
5,503,715 A 4/1996 Trokhan et al.
5,505,818 A 4/1996 Hermans et al.
5,508,818 A 4/1996 Hamma
5,510,001 A 4/1996 Hermans et al.
5,510,002 A 4/1996 Hermans et al.

5,549,790 A 8/1996 Van Phan
5,556,509 A 9/1996 Trokhan et al.
5,593,545 A 1/1997 Rugowski et al.
5,601,871 A 2/1997 Krzysik et al.
5,607,551 A 3/1997 Farrington, Jr. et al.
5,609,725 A 3/1997 Van Phan
5,614,293 A 3/1997 Krzysik et al.
5,618,612 A 4/1997 Gstrein
H1672 H 8/1997 Hermans et al.
5,656,132 A 8/1997 Farrington, Jr. et al.
5,657,797 A 8/1997 Townley et al.
5,667,636 A 9/1997 Engel et al.
5,672,248 A 9/1997 Wendt et al.
5,674,590 A 10/1997 Anderson et al.
5,690,149 A 11/1997 Lee
5,695,607 A 12/1997 Oriaran et al.
5,725,734 A * 3/1998 Herman et al. ..... 162/111
5,746,887 A 5/1998 Wendt et al.
5,772,845 A 6/1998 Farrington, Jr. et al.
5,814,190 A 9/1998 Van Phan
5,830,321 A * 11/1998 Lindsay et al. ..... 162/204
5,840,403 A 11/1998 Trokhan et al.
5,851,353 A 12/1998 Fiscus et al.
5,888,347 A 3/1999 Engel et al.
5,932,068 A 8/1999 Farrington, Jr. et al.
5,935,381 A 8/1999 Trokhan et al.
5,961,782 A 10/1999 Luu et al.
6,017,417 A 1/2000 Wendt et al.
6,033,736 A 3/2000 Perlman et al.
6,080,279 A 6/2000 Hada et al.
6,083,346 A 7/2000 Hermans et al.
6,093,284 A 7/2000 Hada et al.
6,096,169 A 8/2000 Hermans et al.
6,117,525 A 9/2000 Trokhan et al.
6,133,405 A 10/2000 Allen
6,136,146 A 10/2000 Van Phan et al.
6,139,686 A 10/2000 Trokhan et al.
6,143,135 A 11/2000 Hada et al.
6,146,499 A * 11/2000 Lin et al. ..... 162/197
6,149,767 A 11/2000 Hermans et al.
6,149,769 A 11/2000 Mohammadi et al.
6,161,303 A 12/2000 Beck
6,162,327 A 12/2000 Batra et al.
6,171,442 B1 1/2001 Farrington, Jr. et al.
6,187,137 B1 2/2001 Druecke et al.
6,190,506 B1 2/2001 Beck
6,197,154 B1 3/2001 Chen et al.
6,207,011 B1 3/2001 Luu et al.
6,210,528 B1 4/2001 Wolkowicz
6,228,220 B1 5/2001 Hada et al.
6,248,203 B1 6/2001 Beck
6,261,679 B1 * 7/2001 Chen et al. ..... 428/317.9
6,274,042 B1 8/2001 Beck
6,280,573 B1 8/2001 Lindsay et al.
6,287,426 B1 9/2001 Edwards et al.
6,287,427 B1 9/2001 Beck
6,306,257 B1 10/2001 Hada et al.
6,306,258 B1 10/2001 Lange et al.
6,318,727 B1 11/2001 Hada
6,321,963 B1 11/2001 Gracyalny et al.
6,331,230 B1 12/2001 Hermans et al.
6,350,349 B1 2/2002 Hermans et al.
6,379,496 B2 4/2002 Edwards et al.
6,381,868 B1 5/2002 Grabscheid et al.
6,412,678 B2 7/2002 Gracyalny et al.
6,416,631 B1 7/2002 Beck
6,419,793 B1 7/2002 Beck
6,420,013 B1 7/2002 Vinson et al.
6,432,267 B1 8/2002 Watson
6,432,270 B1 * 8/2002 Liu et al. ..... 162/164.4
6,436,234 B1 8/2002 Chen et al.
6,447,640 B1 9/2002 Watson et al.
6,447,641 B1 9/2002 Wolkowicz et al.
6,454,904 B1 9/2002 Hermans et al.
6,461,474 B1 10/2002 Lindsay et al.
6,464,829 B1 10/2002 Chen et al.
6,478,927 B1 11/2002 Chen et al.
6,497,789 B1 12/2002 Hermans et al.
6,534,151 B2 3/2003 Merker
6,547,924 B2 4/2003 Klerelid et al.
6,551,461 B2 4/2003 Hermans et al.
6,562,198 B2 5/2003 Beck et al.
6,565,707 B2 5/2003 Behnke et al.
6,579,418 B2 6/2003 Lindsay et al.
6,585,855 B2 7/2003 Drew et al.
6,589,394 B2 7/2003 Beck
6,592,067 B2 7/2003 Denen et al.
6,607,638 B2 8/2003 Drew et al.
6,610,173 B1 8/2003 Lindsay et al.
6,616,812 B2 9/2003 Beck
6,645,420 B1 11/2003 Beck
6,698,681 B1 3/2004 Guy et al.
6,701,637 B2 * 3/2004 Lindsay et al. ..... 34/71
6,746,558 B2 6/2004 Hoeft et al.
6,749,723 B2 6/2004 Linden
6,752,907 B2 * 6/2004 Edwards et al. ..... 162/207
6,766,977 B2 7/2004 Denen et al.
6,793,170 B2 9/2004 Denen et al.
6,797,115 B2 * 9/2004 Klerelid et al. ..... 162/111
6,838,887 B2 1/2005 Denen et al.
6,871,815 B2 3/2005 Moody et al.
6,998,022 B2 2/2006 Hultcrantz
7,070,678 B2 7/2006 Allen et al.
7,070,679 B2 7/2006 Cason et al.
7,160,418 B2 1/2007 Edwards et al.
7,300,543 B2 11/2007 Mullally et al.
7,399,378 B2 7/2008 Edwards et al.
7,416,637 B2 8/2008 Murray et al.
7,442,278 B2 10/2008 Murray et al.
7,494,563 B2 2/2009 Edwards et al.
7,503,998 B2 3/2009 Murray et al.
7,563,344 B2 7/2009 Beuther et al.
7,585,388 B2 9/2009 Yeh et al.
7,585,389 B2 * 9/2009 Yeh et al. ..... 162/111
7,585,392 B2 9/2009 Kokko et al.
7,588,660 B2 * 9/2009 Edwards et al. ..... 162/109
7,588,661 B2 * 9/2009 Edwards et al. ..... 162/109
7,591,925 B2 9/2009 Scherb et al.
7,608,164 B2 10/2009 Chou et al.
7,651,589 B2 * 1/2010 Murray et al. ..... 162/111
7,662,255 B2 * 2/2010 Murray et al. ..... 162/111
7,662,257 B2 * 2/2010 Edwards et al. ..... 162/125
7,670,457 B2 * 3/2010 Murray et al. ..... 162/111
7,704,349 B2 * 4/2010 Edwards et al. ..... 162/111
7,726,349 B2 6/2010 Mullally et al.
7,789,995 B2 9/2010 Super et al.
7,820,008 B2 * 10/2010 Edwards et al. ..... 162/111
7,828,931 B2 * 11/2010 Edwards et al. ..... 162/111
7,850,823 B2 12/2010 Chou et al.
7,918,964 B2 4/2011 Edwards et al.
7,927,456 B2 4/2011 Murray et al.
7,935,220 B2 5/2011 Edwards et al.
7,951,266 B2 5/2011 Kokko et al.
7,959,761 B2 6/2011 Boettcher et al.
2001/0008180 A1 7/2001 Anderson et al.
2002/0062936 A1 5/2002 Klerelid et al.
2002/0088577 A1 7/2002 Watson et al.
2002/0134520 A1 9/2002 Behnke et al.
2002/0148584 A1 * 10/2002 Edwards et al. ..... 162/204
2002/0187307 A1 12/2002 Tanaka et al.
2003/0000664 A1 1/2003 Drew et al.
2003/0021952 A1 1/2003 Zink et al.
2003/0056919 A1 3/2003 Beck
2003/0056921 A1 3/2003 Beck et al.
2003/0056922 A1 3/2003 Beck
2003/0056923 A1 3/2003 Beck
2003/0056925 A1 3/2003 Beck
2003/0098134 A1 5/2003 Scherb et al.
2003/0102098 A1 6/2003 Allen et al.
2003/0111195 A1 6/2003 Hu
2003/0121626 A1 7/2003 Hultzcrantz
2003/0146581 A1 8/2003 Beck
2003/0153443 A1 8/2003 Beck
2004/0089168 A1 5/2004 Beck
2004/0226673 A1 11/2004 Edwards et al.
2004/0238135 A1 * 12/2004 Edwards et al. ..... 162/111
2005/0006040 A1 1/2005 Boettcher et al.
2005/0217814 A1 * 10/2005 Super et al. ..... 162/111

| | | | | |
|---|---|---|---|---|
| 2005/0236122 | A1 | 10/2005 | Mullally et al. | |
| 2005/0241786 | A1 * | 11/2005 | Edwards et al. | 162/109 |
| 2005/0241787 | A1 * | 11/2005 | Murray et al. | 162/113 |
| 2005/0279471 | A1 * | 12/2005 | Murray et al. | 162/111 |
| 2006/0000567 | A1 | 1/2006 | Murray et al. | |
| 2006/0237154 | A1 * | 10/2006 | Edwards et al. | 162/111 |
| 2006/0289133 | A1 | 12/2006 | Yeh et al. | |
| 2006/0289134 | A1 * | 12/2006 | Yeh et al. | 162/111 |
| 2007/0107863 | A1 * | 5/2007 | Edwards et al. | 162/111 |
| 2007/0137807 | A1 * | 6/2007 | Schulz et al. | 162/109 |
| 2007/0204966 | A1 | 9/2007 | Chou et al. | |
| 2008/0008860 | A1 * | 1/2008 | Murray et al. | 428/152 |
| 2008/0008865 | A1 | 1/2008 | Luu et al. | |
| 2008/0029235 | A1 * | 2/2008 | Edwards et al. | 162/111 |
| 2008/0035288 | A1 | 2/2008 | Mullally et al. | |
| 2008/0047675 | A1 * | 2/2008 | Murray et al. | 162/101 |
| 2008/0083519 | A1 | 4/2008 | Kokko et al. | |
| 2008/0099169 | A1 | 5/2008 | Beuther et al. | |
| 2008/0173419 | A1 | 7/2008 | Sumnicht | |
| 2008/0236772 | A1 | 10/2008 | Edwards et al. | |
| 2008/0245492 | A1 | 10/2008 | Edwards et al. | |
| 2008/0264589 | A1 | 10/2008 | Chou et al. | |
| 2009/0038768 | A1 | 2/2009 | Murray et al. | |
| 2009/0120598 | A1 | 5/2009 | Edwards et al. | |
| 2009/0159223 | A1 | 6/2009 | Edwards et al. | |
| 2009/0294079 | A1 | 12/2009 | Edwards et al. | |
| 2009/0301675 | A1 | 12/2009 | Edwards et al. | |
| 2010/0006249 | A1 | 1/2010 | Kokko et al. | |
| 2010/0126682 | A1 * | 5/2010 | Murray et al. | 162/111 |
| 2010/0170647 | A1 * | 7/2010 | Edwards et al. | 162/111 |
| 2010/0186913 | A1 * | 7/2010 | Super et al. | 162/111 |
| 2010/0224338 | A1 | 9/2010 | Harper et al. | |
| 2010/0282423 | A1 * | 11/2010 | Super et al. | 162/111 |
| 2011/0011545 | A1 * | 1/2011 | Edwards et al. | 162/111 |
| 2011/0155337 | A1 | 6/2011 | Murray et al. | |

FOREIGN PATENT DOCUMENTS

| | | | |
|---|---|---|---|
| EP | 0098683 | A2 | 1/1984 |
| EP | 1356923 | A1 * | 10/2003 |
| EP | 1398413 | A2 | 3/2004 |
| JP | 2002292835 | A | 10/2002 |
| RU | 2141546 | C1 | 11/1999 |
| RU | 2182198 | C2 | 5/2002 |
| SU | 1601274 | A1 | 10/1990 |
| SU | 1771983 | A1 | 10/1992 |
| WO | 97/36047 | | 10/1997 |
| WO | 97/39188 | | 10/1997 |
| WO | 97/43484 | | 11/1997 |
| WO | 00/14330 | | 3/2000 |
| WO | 00/40405 | A1 | 7/2000 |
| WO | 01/85109 | A1 | 11/2001 |
| WO | 2004033793 | A2 | 4/2004 |
| WO | 2005103375 | A1 | 11/2005 |
| WO | 2005106117 | A1 | 11/2005 |
| WO | 2006113025 | A2 | 10/2006 |
| WO | 2006115817 | A2 | 11/2006 |
| WO | 2007/001837 | A2 | 1/2007 |
| WO | WO 2007001837 | A2 * | 1/2007 |
| WO | WO 2007139726 | A1 * | 12/2007 |
| WO | WO 2008045770 | A2 * | 4/2008 |

OTHER PUBLICATIONS

Lars Westfelt, Chemistry of Paper Wet Strength I. A. Survey of Mechanisms of Wet-Strength Development, Cellulose Chemistry and Technology, 1979, pp. 813-825, vol. 13.

W. P. Evans, Cationic Fabric Softeners, Chemistry and Industry, Jul. 5, 1969, pp. 893-903.

R. R. Egan, Cationic Surface Active Agents as Fabric Softeners, J. Am. Oil Chemist's Soc., 1978, pp. 118-121, vol. 55.

B. C. Trivedi et al., Quaternization of Imidazoline: Unequivocal Structure Proof, J. Am. Oil Chemists' Soc., Jun. 1981, pp. 754-756.

David W. Anderson, Absorption of Ionizing Radiation, 1984, p. 69, University Park Press, Baltimore.

International Search Report dated Oct. 29, 2007, for PCT/US2007/011967.

* cited by examiner (75x)

1950 OFF (16x)

CD

MD

SUCTION OFF
109 CALIPER

10952- FABRIC SIDE

SUCTION OFF
109 CALIPER

10952- YANKEE SIDE

SUCTION ON
135 CALIPER

10951- FABRIC SIDE

SUCTION ON
135 CALIPER

10951- YANKEE SIDE

CROSS-SECTIONAL VIEW OF CMP BASESHEET

YANKEE SIDE

SINGLE LAYER (10x)

YANKEE SIDE

W013 (10x)

YANKEE SIDE

TAD (10x)

FABRIC SIDE

SINGLE LAYER (10x)

FABRIC SIDE

W013 (10x)

FABRIC SIDE

TAD (10x)

25/0(50x)

25/7(50x)

35/0(50x)

FABRIC CREPED ABSORBENT SHEET WITH VARIABLE LOCAL BASIS WEIGHT

CLAIM FOR PRIORITY AND CROSS-REFERENCE TO RELATED APPLICATIONS

This application is a divisional patent application of U.S. patent application Ser. No. 12/319,508, filed Jan. 8, 2009, now U.S. Pat. No. 7,820,008, which was a divisional patent application of U.S. patent application Ser. No. 11/804,246, filed May 16, 2007, now U.S. Pat. No. 7,494,563, which application claims the benefit of the filing date of U.S. Provisional Patent Application No. 60/808,863, filed May 26, 2006. The priorities of U.S. patent application Ser. No. 12/319,508 and No. 11/804,246 and that of U.S. Provisional Patent Application No. 60/808,863 are hereby claimed and the disclosures thereof are incorporated into this application by reference.

U.S. application Ser. No. 11/804,246 is also a continuation-in part of the following United States Patent Applications: U.S. patent application Ser. No. 10/679,862 (United States Patent Application Publication No. US 2004-0238135), entitled "Fabric Crepe Process for Making Absorbent Sheet", filed Oct. 6, 2003, now U.S. Pat. No. 7,399,378, which application was based upon U.S. Provisional Patent Application No. 60/416,666, filed Oct. 7, 2002; U.S. patent application Ser. No. 11/108,375 (United States Patent Application Publication No. US 2005-0217814), entitled "Fabric Crepe/Draw Process for Producing Absorbent Sheet", filed Apr. 18, 2005 now U.S. Pat. No. 7,789,995, which application is a continuation-in-part of U.S. patent application Ser. No. 10/679,862, filed Oct. 6, 2003 now U.S. Pat. No. 7,399,378; U.S. patent application Ser. No. 11/108,458 (United States Patent Application Publication No. US 2005-0241787), entitled "Fabric Crepe and In Fabric Drying Process for Producing Absorbent Sheet", filed Apr. 18, 2005, now U.S. Pat. No. 7,442,278, which application was based upon U.S. Provisional Patent Application No. 60/563,519, filed Apr. 19, 2004; U.S. patent application Ser. No. 11/402,609 (United States Patent Application Publication No. US 2006-0237154), entitled "Multi-Ply Paper Towel With Absorbent Core", filed Apr. 12, 2006 now U.S. Pat. No. 7,662,257, which application was based upon U.S. Provisional Patent Application No. 60/673,492, filed Apr. 21, 2005; U.S. patent application Ser. No. 11/104,014 (United States Patent Application Publication No. US 2005-0241786), entitled "Wet-Pressed Tissue and Towel Products With Elevated CD Stretch and Low Tensile Ratios Made With a High Solids Fabric Crepe Process", filed Apr. 12, 2005 now U.S. Pat. No. 7,588,660, which application was based upon U.S. Provisional Patent Application No. 60/562,025, filed Apr. 14, 2004; and U.S. patent application Ser. No. 11/451,111 (United States Patent Application Publication No. US 2006-0289134), entitled "Method of Making Fabric-Creped Sheet for Dispensers", filed Jun. 12, 2006 now U.S. Pat. No. 7,585,389, which application was based upon U.S. Provisional Patent Application No. 60/693,699, filed Jun. 24, 2005. The priorities of the foregoing applications are hereby claimed and their disclosures incorporated herein by reference.

TECHNICAL FIELD

This application relates generally to an absorbent sheet for paper towel and tissue. Typical products have a variable local basis weight with (i) elongated densified regions oriented along the machine direction of the product having a relatively low basis weight and (ii) fiber-enriched regions of a relatively high basis weight between the densified regions.

BACKGROUND

Methods of making paper tissue, towel, and the like, are well known, including various features such as Yankee drying, through-air drying (TAD), fabric creping, dry creping, wet creping, and so forth. Conventional wet pressing (CWP) processes have certain advantages over conventional through-air drying (TAD) processes including: (1) lower energy costs associated with the mechanical removal of water rather than transpiration drying with hot air; and (2) higher production speeds that are more readily achieved with processes that utilize wet pressing to form a web. On the other hand, through-air drying processes have become the method of choice for new capital investment, particularly for the production of soft, bulky, premium quality towel products.

Fabric creping has been employed in connection with papermaking processes which include mechanical or compactive dewatering of the paper web as a means to influence product properties. See U.S. Pat. Nos. 4,689,119 and 4,551,199 of Weldon; 4,849,054 of Klowak; and 6,287,426 of Edwards et al. Operation of fabric creping processes has been hampered by the difficulty of effectively transferring a web of high or intermediate consistency to a dryer. Further U.S. patents relating to fabric creping include the following: U.S. Pat. No. 4,834,838; U.S. Pat. No. 4,482,429 as well as U.S. Pat. No. 4,445,638. Note also, U.S. Pat. No. 6,350,349 to Hermans et al., which discloses wet transfer of a web from a rotating transfer surface to a fabric.

In connection with papermaking processes, fabric molding has also been employed as a means to provide texture and bulk. In this respect, there is seen in U.S. Pat. No. 6,610,173 to Lindsay et al. a method for imprinting a paper web during a wet pressing event which results in asymmetrical protrusions corresponding to the deflection conduits of a deflection member. The '173 patent reports that a differential velocity transfer during a pressing event serves to improve the molding and imprinting of a web with a deflection member. The tissue webs produced are reported as having particular sets of physical and geometrical properties, such as a pattern densified network and a repeating pattern of protrusions having asymmetrical structures. With respect to wet-molding of a web using textured fabrics, see also, the following U.S. Pat. No. 6,017,417 and No. 5,672,248 both to Wendt et al.; No. 5,505,818 to Hermans et al. and No. 4,637,859 to Trokhan. With respect to the use of fabrics used to impart texture to a mostly dry sheet, see U.S. Pat. No. 6,585,855 to Drew et al., as well as United States Publication No. US 2003/0000664.

U.S. Pat. No. 5,503,715 to Trokhan et al. discloses a cellulosic fibrous structure having multiple regions distinguished from one another by basis weight. The structure is reported as having an essentially continuous high basis weight network, and discrete regions of low basis weight which circumscribe discrete regions of intermediate basis weight. The cellulosic fibers forming the low basis weight regions may be radially oriented relative to the centers of the regions. The paper may be formed by using a forming belt having zones with different flow resistances. The basis weight of a region of the paper is generally inversely proportional to the flow resistance of the zone of the forming belt, upon which such a region was formed. The zones of different flow resistances provide for selectively draining a liquid carrier having suspended cellulosic fibers through the different zones of the forming belt. A similar structure is reported in U.S. Pat. No.

5,935,381, also to Trokhan et al., where the features are achieved by using different fiber types.

Through-air-dried (TAD), creped products are disclosed in the following patents: U.S. Pat. No. 3,994,771 to Morgan, Jr. et al.; U.S. Pat. No. 4,102,737 to Morton; and U.S. Pat. No. 4,529,480 to Trokhan. The processes described in these patents comprise, very generally, forming a web on a foraminous support, thermally pre-drying the web, applying the web to a Yankee dryer with a nip defined, in part, by an impression fabric, and creping the product from the Yankee dryer. A relatively uniformly permeable web is typically required, making it difficult to employ recycle furnish at levels that may be desired. Transfer to the Yankee typically takes place at web consistencies of from about 60% to about 70%.

As noted above, through-air-dried products tend to exhibit enhanced bulk and softness; however, thermal dewatering with hot air tends to be energy intensive and requires a relatively uniformly permeable substrate. Thus, wet-press operations wherein the webs are mechanically dewatered are preferable from an energy perspective and are more readily applied to furnishes containing recycle fiber, which tends to form webs with less uniform permeability than virgin fiber. A Yankee dryer can be more effectively employed because a web is transferred thereto at consistencies of 30% or so, which enables the web to be firmly adhered for drying.

Despite the many advances in the art, improvements in absorbent sheet qualities such as bulk, softness and tensile strength generally involve compromising one property in order to gain an advantage in another. Moreover, existing premium products generally use limited amounts of recycle fiber or none at all, despite the fact that use of recycle fiber is beneficial to the environment and is much less expensive as compared with virgin kraft fiber.

SUMMARY OF THE INVENTION

The present invention provides absorbent paper sheet products of variable local basis weight which may be made by compactively dewatering a furnish and wet-creping the resulting web into a fabric chosen such that the absorbent sheet is provided with a plurality of elongated, machine-direction oriented densified regions of a relatively low basis weight and a plurality of fiber-enriched regions of a relatively high local basis weight, which occupy most of the area of the sheet.

The products are produced in a variety of forms suitable for paper tissue or paper towel, and have remarkable absorbency over a wide range of basis weights exhibiting, for example, POROFIL® void volumes of over 7 g/g even at high basis weights. With respect to tissue products, the sheet of the invention has surprising softness at high tensile, offering a combination of properties particularly sought in the industry. With respect to towel products, the absorbent sheet of the invention makes it possible to employ large amounts of recycle fiber without abandoning softness or absorbency requirements. Again, this is a significant advance over existing art.

In another aspect of the invention, papermachine efficiency is enhanced by providing a sheet to the Yankee exhibiting greater Caliper Gain/Reel Crepe ratios, which make lesser demands on wet-end speed—a production bottleneck for many papermachines.

The invention is better understood by reference to FIGS. 1 and 2. FIG. 1 is a photomicrograph of an absorbent sheet 10 of the invention and FIG. 2 is a cross section showing the structure of the sheet along the machine direction. In FIGS. 1 and 2, it is seen in particular that inventive sheet 10 includes a plurality of cross machine direction (CD) extending, fiber-enriched pileated or crested regions 12 of a relatively high local basis weight interconnected by a plurality of elongated densified regions 14 having a relatively low local basis weight, which are generally oriented along the machine direction (MD) of the sheet. The elongated densified regions extend in the MD the length 18 and they extend in the CD by a length 20. The elongated densified regions are characterized by an MD/CD aspect ratio, i.e., distance 18 divided by distance 20 of at least 1.5. The profile of the density and basis weight variation is further appreciated by reference to FIG. 2, which is an enlarged photomicrograph of a section of the sheet taken along line X-S#1 of FIG. 1. In FIG. 2, it is also seen that the pileated regions 12 include a large concentration of fiber having a fiber orientation bias toward the cross-machine direction (CD), as evidenced by the cut fiber ends seen in the photograph. This fiber orientation bias is further seen in the high CD stretch and tensile strengths discussed hereafter. It is further seen in FIG. 2 that the elongated densified regions 14 include highly compressed fiber 16, which also has a fiber bias in the cross direction, as evidenced by cut fiber ends.

Fiber orientation bias is likewise illustrated in FIG. 1, wherein it is seen that the fiber-enriched, pileated regions 12 are bordered at lateral extremities by CD aligned elongated densified regions 14, and that regions 12 generally extend in the CD direction between aligned densified regions, being linked thereto by CD-extending fibers. See also, FIGS. 16-18.

Among the notable features of the invention is elevated absorbency, as evidenced by FIG. 3, for example, which shows that the inventive absorbent sheet exhibits very high void volumes even at high basis weights. In FIG. 3, it is seen that products having POROFIL® void volumes of 7 grams/gram and greater are readily produced in accordance with the invention at basis weights of 12 lbs/ream and at basis weights of 24 lbs/ream and more. This level of absorbency over a wide range is remarkable, especially for a compactively dewatered, wet-creped product (prior art wet-creped products typically have void volumes of less than 5 grams/gram).

Further details and attributes of the inventive products and process for making them are discussed below.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The invention is described in detail below with reference to the various Figures, wherein like numerals designate similar parts. In the Figures.

In connection with photomicrographs, magnifications reported herein are approximate, except when presented as part of a scanning electron micrograph where an absolute scale is shown.

DETAILED DESCRIPTION

The invention is described below with reference to numerous embodiments. Such a discussion is for purposes of illustration only. Modifications to particular examples within the spirit and scope of the present invention, set forth in the appended claims, will be readily apparent to one of skill in the art.

A first aspect of the invention provides an absorbent cellulosic sheet having a variable local basis weight comprising a papermaking-fiber reticulum provided with (i) a plurality of cross-machine direction (CD) extending, fiber-enriched pileated regions of a relatively high local basis weight interconnected by (ii) a plurality of elongated densified regions of compressed papermaking fibers, the elongated densified regions having a relatively low local basis weight and being generally oriented along the machine direction (MD) of the sheet. The elongated densified regions are further characterized by an MD/CD aspect ratio of at least 1.5. Typically, the MD/CD aspect ratios of the densified regions are greater than 2 or greater than 3, generally, between about 2 and 10. In most cases, the fiber-enriched, pileated regions have a fiber orientation bias toward the CD of the sheet, and the densified regions of a relatively low basis weight extend in the machine direction, and also have a fiber orientation bias along the CD of the sheet.

Figure 3:
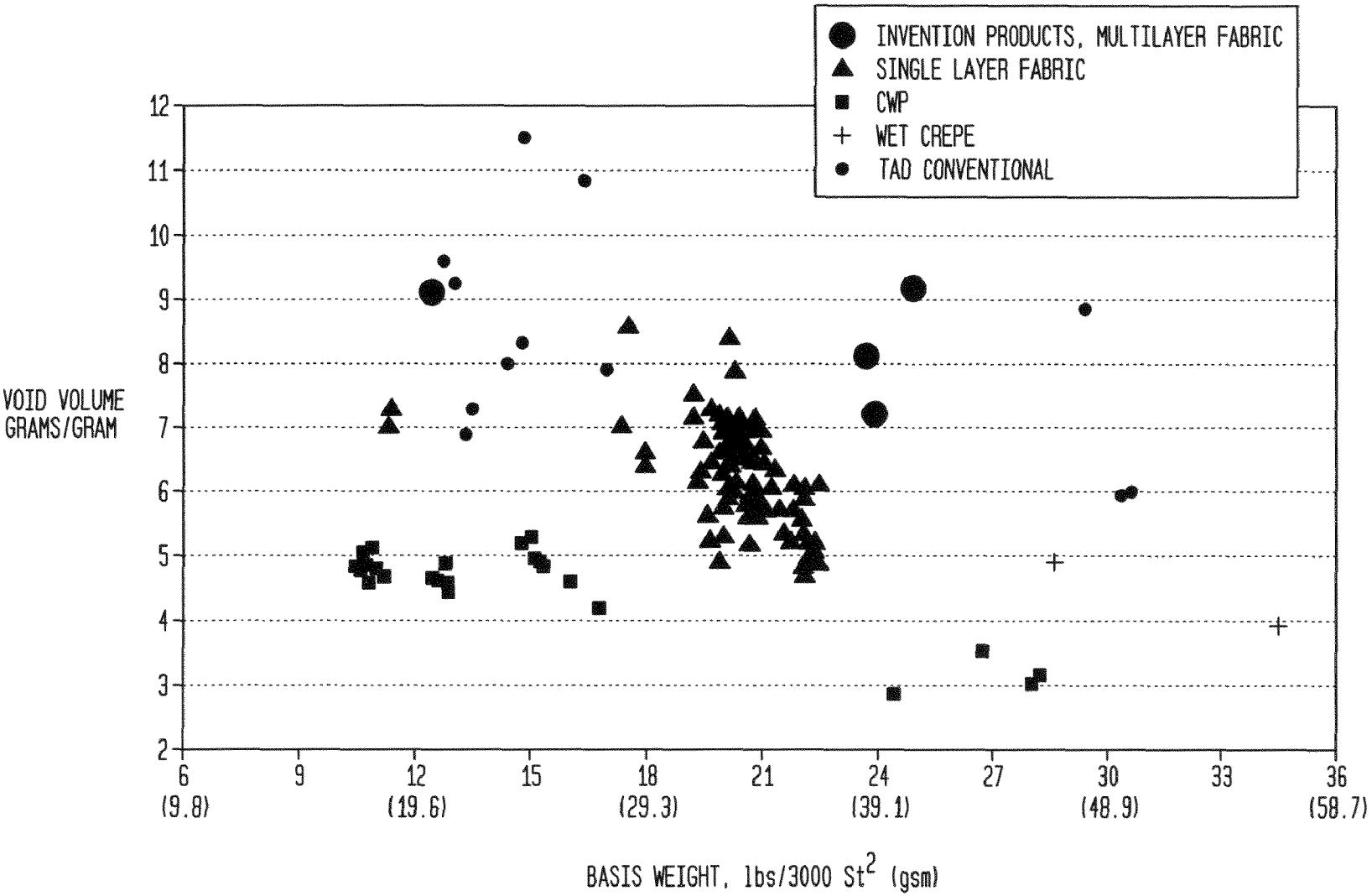
FIG. 3 is a plot showing POROFIL® void volume in grams/gm of various products, including those of the present invention.

In one preferred embodiment, the fiber-enriched pileated regions are bordered at lateral extremities by a laterally-spaced pair of CD-aligned densified regions, and the fiber-enriched regions are at least partially-bordered intermediate the lateral extremities thereof at longitudinal portions by a longitudinally-spaced, CD-staggered pair of densified regions. For many sheet products, the sheet has a basis weight of from 8 lbs per 3000 square-foot ream to 35 lbs per 3000 square-foot ream, and a void volume greater than 7 grams/gram. A sheet may have a void volume of equal to or greater than 7 grams/gram and perhaps up to 15 grams/gram. A suitable void volume of equal to or greater than 8 grams/gram and up to 12 grams/gram is seen in FIG. 3.

The present invention provides products of relatively high POROFIL® void volume, even at high basis weights. For example, in some cases, the sheet has a basis weight of from 20 lbs per 3000 square foot ream to 35 lbs per 3000 square-foot ream and a void volume greater than 7 grams/gram and perhaps up to 15 grams/gram. Suitably, the void volume is equal to or greater than 8 grams/gram and up to 12 grams/gram.

Salient features of the invention likewise include high CD stretch and the ability to employ a recycle furnish in premium products. A CD stretch of from 5% to 10% is typical. At least 5%, at least 7% or at least 8% is preferred in some cases. The papermaking fiber may be 50% by weight fiber of recycle fiber or more. At least 10%, 25%, 35% or 45% is used, depending upon availability and suitability for the product.

Another aspect of the invention is directed to a tissue base sheet exhibiting softness, elevated bulk and high strength. Thus, the inventive absorbent sheet may be in the form of a tissue base sheet wherein the fiber is predominantly hardwood fiber and the sheet has a bulk of at least 5 ((mils/8 plies)/(lb/ream)), or in the form of a tissue base sheet wherein the fiber is predominantly hardwood fiber, and the sheet has a bulk of at least 6 ((mils/8 plies)/(lb/ream)). Typically, the sheet has a bulk of equal to or greater than 5 and up to about 8 ((mils/8 plies)/(lb/ream)), and is incorporated into a two-ply tissue product. The invention sheet is likewise provided in the form of a tissue base sheet wherein the fiber is predominantly hardwood fiber and the sheet has a normalized Geometric Mean (GM) tensile strength of greater than 21 ((g/3")/(lbs/ream)) and a bulk of at least 5 ((mils/8 plies)/(lb/ream)) up to about 10 ((mils/8 plies)/(lb/ream)). Typically, the tissue sheet has a normalized GM tensile of greater than 21 ((g/3")/(lbs/ream)) and up to about 30 ((g/3")/(lbs/ream)).

The base sheet may have a normalized GM tensile of 25 ((g/3")/(lbs/ream)) or greater, and be incorporated into a two-ply tissue product.

Alternatively, the inventive products are produced in the form of a towel base sheet incorporating mechanical pulp and wherein at least 40% by weight of the papermaking fiber is softwood fiber or in the form of a towel base sheet wherein at least 40% by weight of the papermaking fiber is softwood fiber and at least 20% by weight of the papermaking fiber is recycle fiber. At least 30%, at least 40% or at least 50% of the papermaking fiber may be recycle fiber. As much as 75% or 100% of the fiber may be recycle fiber in some cases.

A typical towel base sheet for two-ply toweling has a basis weight in the range of from 12 to 22 lbs per 3000 square-foot ream and an 8-sheet caliper of greater than 90 mils, up to about 120 mils. Base sheet may be converted into a towel with a CD stretch of at least about 6%. Typically, a CD stretch in the range of from 6% to 10% is provided. Sometimes, a CD stretch of at least 7% is preferred.

The present invention is likewise suitable for manufacturing towel base sheet for use in automatic towel dispensers. Thus, the product is provided in the form of a towel base sheet wherein at least 40% by weight of the papermaking fiber is softwood fiber and at least 20% by weight of the papermaking fiber is recycle fiber, and wherein the MD bending length of the base sheet is from about 3.5 cm to about 5 cm. An MD bending length of the base sheet in the range of from about 3.75 cm to about 4.5 cm is typical.

Such sheets may include at least 30% recycle fiber, at least 40% recycle fiber. In some cases, at least 50% by weight of the fiber is recycle fiber. As much as 75% or 100% by weight recycle fiber may be employed. Typically, the base sheet has a bulk of greater than 2.5 ((mils/8 plies)/(lb/ream)), such as a bulk of greater than 2.5 mils/8 plies/lb/ream up to about 3 ((mils/8 plies)/(lb/ream)). In some cases, having a bulk of at least 2.75 ((mils/8 plies)/(lb/ream)) is desirable.

A further aspect of the invention is an absorbent cellulosic sheet having a variable local basis weight comprising a patterned papermaking-fiber reticulum provided with: (a) a plurality of generally machine direction (MD) oriented elongated densified regions of compressed papermaking fibers having a relatively low local basis weight, as well as leading and trailing edges, the densified regions being arranged in a repeating pattern of a plurality of generally parallel linear arrays, which are longitudinally staggered with respect to each other, such that a plurality of intervening linear arrays are disposed between a pair of CD-aligned densified regions; and (b) a plurality of fiber-enriched, pileated regions having a relatively high local basis weight interspersed between and connected with the densified regions, the pileated regions having crests extending generally in the cross-machine direction of the sheet, wherein the generally parallel, longitudinal arrays of densified regions are positioned and configured such that a fiber-enriched region between a pair of CD-aligned densified regions extends in the CD unobstructed by leading or trailing edges of densified regions of at least one intervening linear array. Typically, the generally parallel, longitudinal arrays of densified regions are positioned and configured such that a fiber-enriched region between a pair of CD-aligned densified regions extends in the CD unobstructed by leading or trailing edges of densified regions of at least two intervening linear arrays. So also, the generally parallel, longitudinal arrays of densified regions are positioned and configured such that a fiber-enriched region between a pair of CD-aligned densified regions is at least partially truncated in the MD and at least partially bordered in the MD by the leading or trailing edges of densified regions of at least one intervening linear array of the sheet at an MD position intermediate an MD position of the leading and trailing edges of the CD-aligned densified regions. More preferably, the generally parallel, longitudinal arrays of densified regions are positioned and configured such that a fiber-enriched region between a pair of CD-aligned densified regions is at least partially truncated in the MD and at least partially bordered in the MD by the leading or trailing edges of densified regions of at least two intervening linear arrays of the sheet at an MD position intermediate an MD position of the leading and trailing edges of the CD-aligned densified regions. It is seen from the various Figures that the leading and trailing MD edges of the fiber-enriched pileated regions are generally inwardly concave such that a central MD span of the fiber-enriched regions is less than an MD span at the lateral extremities of the fiber-enriched areas. Further, the elongated densified regions occupy from about 5% to about 30% of the area of the sheet; more typically, the elongated densified regions occupy from about 5% to about 25% of the area of the sheet or the elongated densified regions occupy from about 7.5% to about 20% of the area of the sheet. The fiber-enriched, pileated regions typically occupy from about 95% to about 50% of the area of the sheet, such as from about 90% to about 60% of the area of the sheet.

While any suitable repeating pattern may be employed, the linear arrays of densified regions have an MD repeat frequency of from about 50 meter−1 to about 200 meter-1, such as an MD repeat frequency of from about 75 meter−1 to about 175 meter−1 or an MD repeat frequency of from about 90 meter−1 to about 150 meter−1. The densified regions of the linear arrays of the sheet have a CD repeat frequency of from about 100 meter−1 to about 500 meter−1; typically, a CD repeat frequency of from about 150 meter−1 to about 300 meter-1; such as a CD repeat frequency of from about 175 meter−1 to about 250 meter−1.

In still another aspect of the invention, an absorbent cellulosic sheet having variable local basis weight comprises a papermaking fiber reticulum provided with: (a) a plurality of elongated densified regions of compressed papermaking fiber, the densified regions being oriented generally along the machine direction (MD) of the sheet and having a relatively low local basis weight, as well as leading and trailing edges at their longitudinal extremities; and (b) a plurality of fiber-enriched, pileated regions connected with the plurality of elongated densified regions, the pileated regions having (i) a relatively high local basis weight and (ii) a plurality of cross-machine direction (CD) extending crests having concamerated CD profiles with respect to the leading and trailing edges of the plurality of elongated densified regions.

Many embodiments of the invention include an absorbent cellulosic sheet having a variable local basis weight comprising a papermaking-fiber reticulum provided with (i) a plurality of cross-machine direction (CD) extending, fiber-enriched pileated regions of a relatively high local basis weight having a fiber bias along the CD of the sheet adjacent, (ii) a plurality of densified regions of compressed papermaking fibers, the densified regions having a relatively low local basis weight and being disposed between pileated regions.

In another aspect of the invention, an absorbent cellulosic sheet having variable local basis weight comprises (i) a plurality of cross-machine direction (CD) extending fiber-enriched regions of a relatively high local basis weight and (ii) a plurality of low basis weight regions interspersed with the high basis weight regions, wherein representative areas within the relatively high basis weight regions exhibit a characteristic local basis weight at least 25% higher than a characteristic local basis weight of representative areas within the low basis weight regions. In other cases, the characteristic local basis weight of representative areas within the relatively high basis weight regions is at least 35% higher than the characteristic local basis weight of representative areas within the low basis weight regions; while in still others, the characteristic local basis weight of representative areas within the relatively high basis weight regions is at least 50% higher than the characteristic local basis weight of representative areas within the low basis weight regions. In some embodiments, the characteristic local basis weight of representative areas within the relatively high basis weight regions is at least 75% higher than the characteristic low basis weight of representative areas within the local basis weight regions or at least 100% higher than the characteristic local basis weight of the low basis weight regions. The characteristic local basis weight of representative areas within the relatively high basis weight regions may be at least 150% higher than the characteristic local basis weight of representative areas within the low basis weight regions; generally, the characteristic local basis weight of representative areas within the relatively high basis weight regions is from 25% to 200% higher than the characteristic local basis weight of representative areas within the low basis weight regions.

Figure 19:
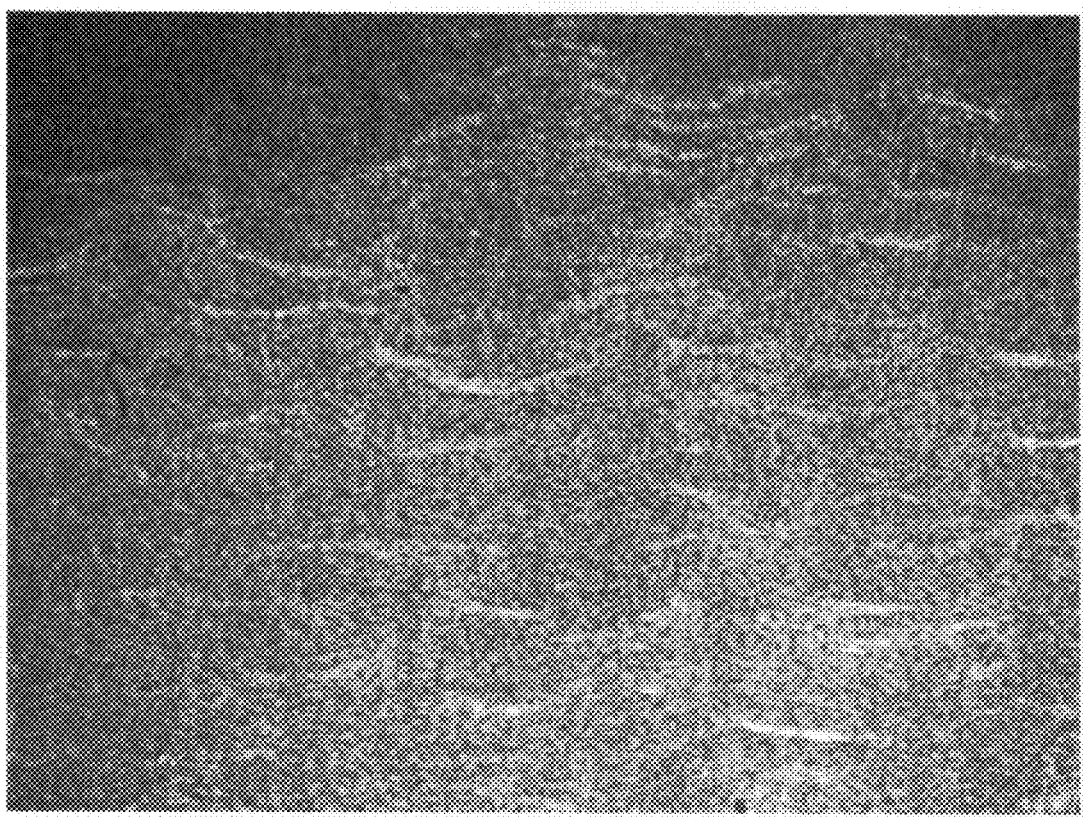
FIG. 19 is an X-ray negative through a sheet of the invention at prolonged exposure, 6 kV.
Figure 20:
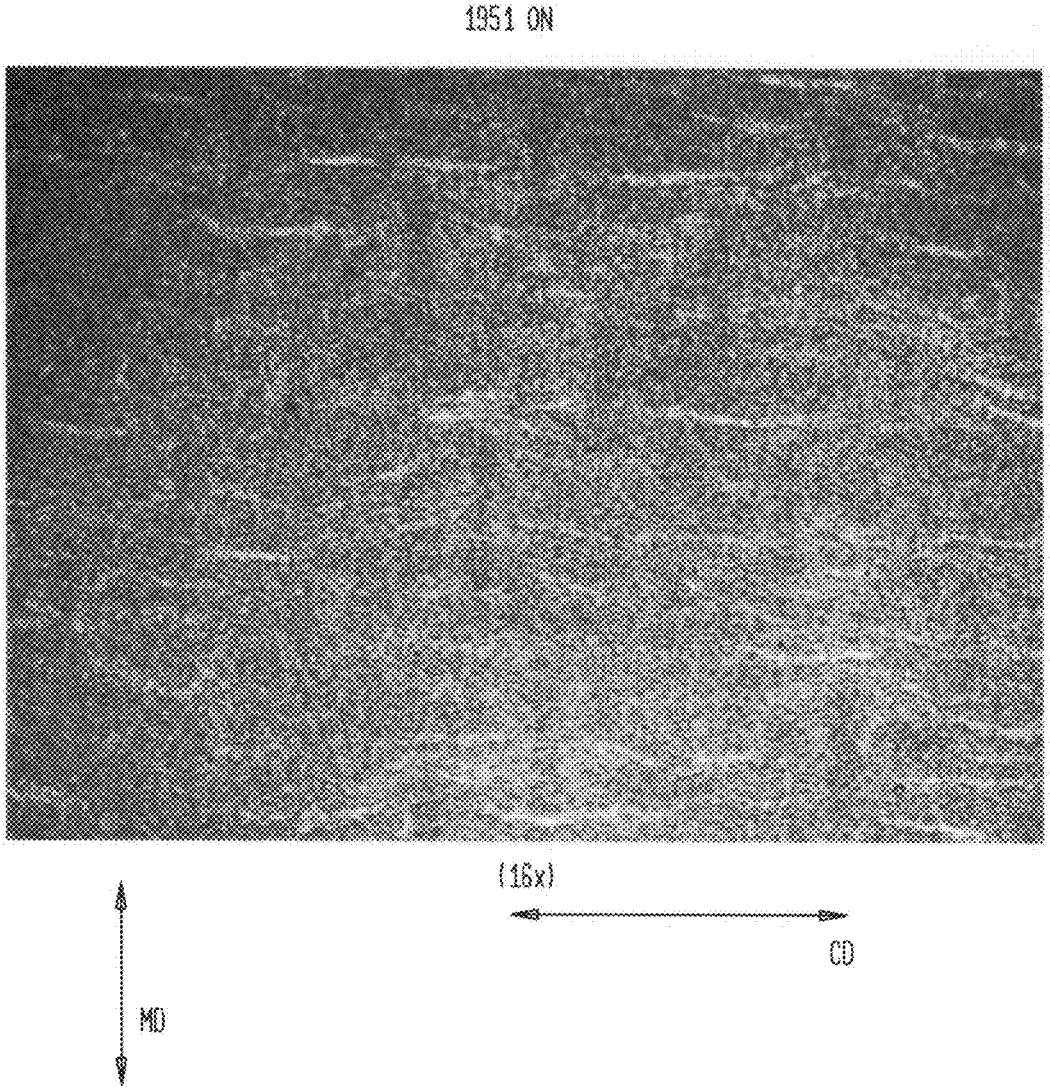
FIG. 20 is another X-ray negative through a sheet of the invention at prolonged exposure, 6 kV.

In another embodiment, an absorbent cellulosic sheet having a variable local basis weight comprises (i) a plurality of cross-machine direction (CD) extending fiber-enriched regions of a relatively high local basis weight and (ii) a plurality of elongated low basis weight regions generally oriented in the machine direction (MD), wherein the regions of relatively high local basis weight extend in the CD generally a distance of from about 0.25 to about 3 times a distance that the elongated relatively low basis weight regions extend in the MD. This feature is seen in FIGS. 19 and 20. Typically, the fiber-enriched regions are pileated regions having a plurality of macrofolds. So also, the elongated low basis weight regions have an MD/CD aspect ratio of greater than 2 or 3, usually, between about 2 and 10 such as between 2 and 6.

The present invention also includes methods of producing an absorbent sheet.

Still other aspects of the invention include a method of making a belt-creped absorbent cellulosic sheet comprising: (a) compactively dewatering a papermaking furnish to form a nascent web having an apparently random distribution of papermaking fiber orientation, (b) applying the dewatered web having the apparently random distribution of fiber orientation to a translating transfer surface moving at a first speed, (c) belt-creping the web from the transfer surface at a consistency of from about 30% to about 60% utilizing a patterned creping belt, the creping step occurring under pressure in a belt creping nip defined between the transfer surface and the creping belt wherein the belt is traveling at a second speed slower than the speed of the transfer surface. The belt pattern, nip parameters, velocity delta and web consistency are selected such that the web is creped from the transfer surface and redistributed on the creping belt to form a web with a reticulum having a plurality of interconnected regions of different local basis weights including at least (i) a plurality of fiber-enriched pileated regions of high local basis weight, interconnected by way of (ii) a plurality of elongated densified regions of compressed papermaking fiber. The elongated densified regions have a relatively low local basis weight and are generally oriented along the machine direction (MD) of the sheet. The elongated densified regions are further characterized by an MD/CD aspect ratio of at least 1.5; and the process further includes (d) drying the web. Preferably, the creping belt is a fabric. The process may yet further include applying suction to the creped web while it is disposed in the creping fabric. Most preferably, the creping belt is a woven creping fabric with prominent MD warp knuckles which project into the creping nip to a greater extent than weft knuckles of the fabric and the creping fabric is a multilayer fabric. The pileated regions include drawable macrofolds which may be expanded by drawing the web along the MD of the sheet. In some embodiments, the pileated regions include drawable macrofolds and nested therein drawable microfolds, and the process further includes the step of drawing the microfolds of the pileated regions by application of suction. In a typical process, the pileated regions include a plurality of overlapping crests inclined with respect to the MD of the sheet.

An additional aspect of the invention is a method of making a fabric-creped absorbent cellulosic sheet with improved dispensing characteristics comprising: (a) compactively dewatering a papermaking furnish to form a nascent web, (b) applying the dewatered web to a translating transfer surface moving at a first speed, (c) fabric-creping the web from the transfer surface at a consistency of from about 30% to about 60% utilizing a patterned creping fabric, the creping step occurring under pressure in a fabric creping nip defined between the transfer surface and the creping fabric wherein the fabric is traveling at a second speed slower than the speed of the transfer surface. The fabric pattern, nip parameters, velocity delta and web consistency are selected such that the web is creped from the transfer surface and transferred to the creping fabric. The process also includes (d) adhering the web to a drying cylinder with a resinous adhesive coating composition, (e) drying the web on the drying cylinder, and (f) peeling the web from the drying cylinder; wherein the furnish, creping fabric and creping adhesive are selected and the velocity delta, nip parameters and web consistency, caliper and basis weight are controlled such that the MD bending length of the dried web is at least about 3.5 cm, and the web has a papermaking-fiber reticulum provided with (i) a plurality of cross-machine direction (CD) extending, fiber-enriched pileated regions of a relatively high local basis weight interconnected by (ii) a plurality of elongated densified regions of compressed papermaking fibers. The elongated densified regions have a relatively low local basis weight and are generally oriented along the machine direction (MD) of the sheet, the elongated densified regions are further characterized by an MD/CD aspect ratio of at least 1.5. The MD bending length of the dried web is from about 3.5 cm to about 5 cm, in many cases, such as from about 3.75 cm to about 4.5 cm. The process may be operated at a fabric crepe of from about 2% to about 20% and is operated at a fabric crepe of from about 3% to about 10% in a typical embodiment.

A still further aspect of the invention is a method of making fabric-creped absorbent cellulosic sheet comprising (a) compactively dewatering a papermaking furnish to form a nascent web having an apparently random distribution of papermaking fiber orientation, (b) applying the dewatered web having the apparently random distribution of fiber orientation to a translating transfer surface moving at a first speed, (c) fabric-creping the web from the transfer surface at a consistency of from about 30% to about 60%, the creping step occurring under pressure in a fabric creping nip defined between the transfer surface and the creping fabric, wherein the fabric is traveling at a second speed slower than the speed of the transfer surface. The fabric pattern, nip parameters, velocity delta and web consistency are selected such that the web is creped from the transfer surface and redistributed on the creping fabric to form a web with a drawable reticulum having a plurality of interconnected regions of different local basis weights, including at least (i) a plurality of fiber-enriched regions of a high local basis weight, interconnected by way of (ii) a plurality of elongated densified regions of compressed papermaking fibers, the elongated densified regions having a relatively low local basis weight and being generally oriented along the machine direction (MD) of the sheet. The elongated densified regions are further characterized by an MD/CD aspect ratio of at least 1.5. The process further includes (d) drying the web, and thereafter, (e) drawing the web along its MD, wherein the drawable reticulum of the web is characterized in that it comprises a cohesive fiber matrix which exhibits elevated void volume upon drawing. Suitably, the at least partially dried web is drawn along its MD at least about 10% after fabric-creping or the web is drawn in the machine direction at least about 15% after fabric-creping. The web may be drawn in its MD at least about 30% after fabric-creping, at least about 45% after fabric-creping, and the web may be drawn in its MD up to about 75% or more after fabric-creping, provided that a sufficient amount of fabric crepe has been applied.

Another method of making a fabric-creped absorbent cellulosic sheet of the invention includes (a) compactively dewatering a papermaking furnish to form a nascent web having an apparently random distribution of papermaking fiber orientation, (b) applying the dewatered web having the apparently random distribution of fiber orientation to a translating transfer surface moving at a first speed, (c) fabric-creping the web from the transfer surface at a consistency of from about 30% to about 60%, the creping step occurring under pressure in a fabric creping nip defined between the transfer surface and the creping fabric, wherein the fabric is traveling at a second speed slower than the speed of said transfer surface, (d) applying the web to a Yankee dryer, (e) creping the web from the Yankee dryer, and (f) winding the web on a reel; the fabric pattern, nip parameters, velocity delta and web consistency and composition being selected such that (i) the web is creped from the transfer surface and redistributed on the creping fabric to form a web with a local basis weight variation including at least (A) a plurality of fiber-enriched regions of a relatively high local basis weight, (B) a plurality of elongated regions having a relatively low local basis weight and being generally oriented along the machine direction (MD) of the sheet, and (ii) the process exhibits a Caliper Gain/% Reel Crepe ratio of at least 1.5. Typically, the process exhibits a Caliper Gain/% Reel Crepe ratio of at least 2, such as a Caliper Gain/% Reel Crepe ratio of at least 2.5 or 3. Usually, the process exhibits a Caliper Gain/% Reel Crepe ratio of from about 1.5 to about 5 and is operated at a Fabric Crepe/Reel Crepe ratio of from about 1 to about 20. The process may be operated at a Fabric Crepe/Reel Crepe ratio of from about 2 to about 10, such as at a Fabric Crepe/Reel Crepe ratio of from about 2.5 to about 5.

The foregoing and further features of the invention are further illustrated in the discussion which follows.

Terminology used herein is given its ordinary meaning consistent with the exemplary definitions set forth immediately below: mg refers to milligrams and $m^2$ refers to square meters, and so forth.

The creping adhesive "add-on" rate is calculated by dividing the rate of application of adhesive (mg/min) by surface area of the drying cylinder passing under a spray applicator boom ($m^2$/min). The resinous adhesive composition most preferably consists essentially of a polyvinyl alcohol resin and a polyamide-epichlorohydrin resin wherein the weight ratio of polyvinyl alcohol resin to polyamide-epichlorohydrin resin is from about 2 to about 4. The creping adhesive may also include a modifier sufficient to maintain good transfer between the creping fabric and the Yankee cylinder, generally, less than 5% by weight modifier and, more preferably, less than about 2% by weight modifier, for peeled products. For blade creped products, 15%-25% modifier or more may be used.

Throughout this specification and claims, when we refer to a nascent web having an apparently random distribution of fiber orientation (or use like terminology), we are referring to the distribution of fiber orientation that results when known forming techniques are used for depositing a furnish on the forming fabric. When examined microscopically, the fibers give the appearance of being randomly oriented even though, depending on the jet to wire speed, there may be a significant bias toward machine direction orientation making the machine direction tensile strength of the web exceed the cross-direction tensile strength.

Unless otherwise specified, "basis weight", BWT, bwt, and so forth, refers to the weight of a 3000 square-foot ream of product. Likewise, "ream" means a 3000 square-foot ream unless otherwise specified. Consistency refers to % solids of a nascent web, for example, calculated on a bone dry basis. "Air dry" means including residual moisture, by convention up to about 10% moisture for pulp and up to about 6% for paper. A nascent web having 50% water and 50% bone dry pulp has a consistency of 50%.

The term "cellulosic", "cellulosic sheet", and the like, is meant to include any product incorporating papermaking fiber having cellulose as a major constituent. "Papermaking fibers" include virgin pulps or recycle (secondary) cellulosic fibers or fiber mixes comprising cellulosic fibers. Fibers suitable for making the webs of this invention include: nonwood fibers, such as cotton fibers or cotton derivatives, abaca, kenaf, sabai grass, flax, esparto grass, straw, jute hemp, bagasse, milkweed floss fibers, and pineapple leaf fibers, and wood fibers such as those obtained from deciduous and coniferous trees, including softwood fibers, such as northern and southern softwood kraft fibers, hardwood fibers, such as eucalyptus, maple, birch, aspen, or the like. Papermaking fibers can be liberated from their source material by any one of a number of chemical pulping processes familiar to one experienced in the art including sulfate, sulfite, polysulfide, soda pulping, etc. The pulp can be bleached if desired by chemical means including the use of chlorine, chlorine dioxide, oxygen, alkaline peroxide, and so forth. The products of the present invention may comprise a blend of conventional fibers (whether derived from virgin pulp or recycle sources) and high coarseness lignin-rich tubular fibers, mechanical pulps such as bleached chemical thermomechanical pulp (BCTMP). "Furnishes" and like terminology refers to aqueous compositions including papermaking fibers, optionally, wet strength resins, debonders, and the like, for making paper products. Recycle fiber is typically more than 50% by weight hardwood fiber and may be 75%-80% or more hardwood fiber.

As used herein, the term "compactively dewatering the web or furnish" refers to mechanical dewatering by wet pressing on a dewatering felt, for example, in some embodiments, by use of mechanical pressure applied continuously over the web surface as in a nip between a press roll and a press shoe, wherein the web is in contact with a papermaking felt. The terminology "compactively dewatering" is used to distinguish from processes wherein the initial dewatering of the web is carried out largely by thermal means as is the case, for example, in U.S. Pat. No. 4,529,480 to Trokhan and U.S. Pat. No. 5,607,551 to Farrington et al. Compactively dewatering a web thus refers, for example, to removing water from a nascent web having a consistency of less than 30% or so by application of pressure thereto and/or increasing the consistency of the web by about 15% or more by application of pressure thereto, that is, increasing the consistency, for example, from 30% to 45%.

Creping fabric and like terminology refers to a fabric or belt which bears a pattern suitable for practicing the process of the present invention, and preferably is permeable enough such that the web may be dried while it is held in the creping fabric. In cases where the web is transferred to another fabric or surface (other than the creping fabric) for drying, the creping fabric may have a lower permeability.

"Fabric side" and like terminology refers to the side of the web which is in contact with the creping fabric. "Dryer side" or "Yankee side" is the side of the web in contact with the drying cylinder, typically, opposite to the fabric side of the web.

Fpm refers to feet per minute; while fps refers to feet per second.

MD means machine direction and CD means cross-machine direction.

Nip parameters include, without limitation, nip pressure, nip width, backing roll hardness, creping roll hardness, fabric approach angle, fabric takeaway angle, uniformity, nip penetration and velocity delta between surfaces of the nip.

Nip width means the MD length over which the nip surfaces are in contact.

"Predominantly" means more than 50% of the specified component, by weight, unless otherwise indicated.

A translating transfer surface refers to the surface from which the web is creped into the creping fabric. The translating transfer surface may be the surface of a rotating drum as described hereafter, or may be the surface of a continuous smooth moving belt, or another moving fabric which may have surface texture, and so forth. The translating transfer surface needs to support the web and facilitate the high solids creping as will be appreciated from the discussion that follows.

Calipers and or bulk reported herein may be measured at 8 or 16 sheet calipers as specified. The sheets are stacked and the caliper measurement taken about the central portion of the stack. Preferably, the test samples are conditioned in an atmosphere of 23°±1.0° C. (73.4°±1.8° F.) at 50% relative humidity for at least about 2 hours and then measured with a Thwing-Albert Model 89-II-JR or Progage Electronic Thickness Tester with 2-in (50.8-mm) diameter anvils, 539±10 grams dead weight load, and 0.231 in./sec descent rate. For finished product testing, each sheet of product to be tested must have the same number of plies as the product is sold. For testing in general, eight sheets are selected and stacked together. For napkin testing, napkins are unfolded prior to stacking. For base sheet testing off of winders, each sheet to be tested must have the same number of plies as produced off the winder. For base sheet testing off of the papermachine reel, single plies must be used. Sheets are stacked together aligned in the MD. On custom embossed or printed product, try to avoid taking measurements in these areas if at all possible. Bulk may also be expressed in units of volume/weight by dividing caliper by basis weight.

Characteristic local basis weights and differences therebetween are calculated by measuring the local basis weight at two or more representative low basis weight areas within the low basis weight regions and comparing the average basis weight to the average basis weight at two or more representative areas within the relatively high local basis weight regions. For example, if the representative areas within the low basis weight regions have an average basis weight of 15 lbs/3000 ft ream and the average measured local basis weight for the representative areas within the relatively high local basis regions is 20 lbs/3000 $ft^2$ ream, the representative areas within high local basis weight regions have a characteristic basis weight of ((20−15)/15)×100% or 33% higher than the representative areas within the low basis weight regions. Preferably, the local basis weight is measured using a beta particle attenuation technique as described herein.

MD bending length (cm) is determined in accordance with ASTM test method D 1388-96, cantilever option. Reported bending lengths refer to MD bending lengths unless a CD bending length is expressly specified. The MD bending length test was performed with a Cantilever Bending Tester available from Research Dimensions, 1720 Oakridge Road, Neenah, Wis., 54956, which is substantially the apparatus shown in the ASTM test method, item 6. The instrument is placed on a level stable surface, horizontal position being confirmed by a built in leveling bubble. The bend angle indicator is set at 41.5° below the level of the sample table. This is accomplished by setting the knife edge appropriately. The sample is cut with a one inch JD strip cutter available from Thwing-Albert Instrument Company, 14 Collins Avenue, W. Berlin, N.J. 08091. Six (6) samples are cut as 1 inch×8 inch machine direction specimens. Samples are conditioned at 23° C.±1° C. (73.4° F.±1.8° F.) at 50% relative humidity for at least two hours. For machine direction specimens, the longer dimension is parallel to the machine direction. The specimens should be flat, free of wrinkles, bends or tears. The Yankee side of the specimens is also labeled. The specimen is placed on the horizontal platform of the tester aligning the edge of the specimen with the right hand edge. The movable slide is placed on the specimen, being careful not to change its initial position. The right edge of the sample and the movable slide should be set at the right edge of the horizontal platform. The movable slide is displaced to the right in a smooth, slow manner at approximately 5 inches/minute until the specimen touches the knife edge. The overhang length is recorded to the nearest 0.1 cm. This is done by reading the left edge of the movable slide. Three specimens are preferably run with the Yankee side up and three specimens are preferably run with the Yankee side down on the horizontal platform. The MD bending length is reported as the average overhang length in centimeters divided by two to account for bending axis location.

Water absorbency rate or WAR, is measured in seconds and is the time it takes for a sample to absorb a 0.1 gram droplet of water disposed on its surface by way of an automated syringe. The test specimens are preferably conditioned at 23° C.±1° C. (73.4±1.8° F.) at 50% relative humidity for 2 hours. For each sample, four 3×3 inch test specimens are prepared. Each specimen is placed in a sample holder such that a high intensity lamp is directed toward the specimen. 0.1 ml of water is deposited on the specimen surface and a stop watch is started. When the water is absorbed, as indicated by lack of further reflection of light from the drop, the stopwatch is stopped and the time recorded to the nearest 0.1 seconds. The procedure is repeated for each specimen and the results averaged for the sample. WAR is measured in accordance with TAPPI method T-432 cm–99.

Dry tensile strengths (MD and CD), stretch, ratios thereof, modulus, break modulus, stress and strain are measured with a standard INSTRON® test device or other suitable elongation tensile tester, which may be configured in various ways, typically, using three or one inch wide strips of tissue or towel, conditioned in an atmosphere of 23°±1° C. (73.4°±1° F.) at 50% relative humidity for 2 hours. The tensile test is run at a crosshead speed of 2 in/min. Break modulus is expressed in grams/3 inches/% strain. % strain is dimensionless and need not be specified. Unless otherwise indicated, values are break values. GM refers to the square root of the product of the MD and CD values for a particular product.

Tensile ratios are simply ratios of the values determined by way of the foregoing methods. Unless otherwise specified, a tensile property is a dry sheet property.

The wet tensile of the tissue of the present invention is measured using a three-inch wide strip of tissue that is folded into a loop, clamped in a special fixture termed a Finch Cup, then immersed in a water. The Finch Cup, which is available from the Thwing-Albert Instrument Company of Philadelphia, Pa., is mounted onto a tensile tester equipped with a 2.0 pound load cell with the flange of the Finch Cup clamped by the tester's lower jaw and the ends of tissue loop clamped into the upper jaw of the tensile tester. The sample is immersed in water that has been adjusted to a pH of 7.0+–0.1 and the tensile is tested after a 5 second immersion time. The results are expressed in g/3", dividing by two to account for the loop as appropriate.

"Fabric crepe ratio" is an expression of the speed differential between the creping fabric and the forming wire and typically calculated as the ratio of the web speed immediately before fabric creping and the web speed immediately following fabric creping, the forming wire and transfer surface being typically, but not necessarily, operated at the same speed:

Fabric crepe ratio=transfer cylinder speed÷creping fabric speed.

Fabric crepe can also be expressed as a percentage calculated as:

Fabric crepe=[Fabric crepe ratio−1]×100.

A web creped from a transfer cylinder with a surface speed of 750 fpm to a fabric with a velocity of 500 fpm has a fabric crepe ratio of 1.5 and a fabric crepe of 50%.

For reel crepe, the reel crepe ratio is typically calculated as the Yankee speed divided by reel speed. To express reel crepe as a percentage, 1 is subtracted from the reel crepe ratio and the result multiplied by 100%.

The fabric crepe/reel crepe ratio is calculated by dividing the fabric crepe by the reel crepe.

The Caliper Gain/% Reel Crepe ratio is calculated by dividing the observed caliper gain in mils/8 sheets by the % reel crepe. To this end, the gain in caliper is determined by comparison with like operating conditions with no reel crepe. See Table 13, below.

The line or overall crepe ratio is calculated as the ratio of the forming wire speed to the reel speed and a % total crepe is:

Line Crepe=[Line Crepe Ratio−1]×100.

A process with a forming wire speed of 2000 fpm and a reel speed of 1000 fpm has a line or total crepe ratio of 2 and a total crepe of 100%.

PLI or pli means pounds force per linear inch. The process employed is distinguished from other processes, in part, because fabric creping is carried out under pressure in a creping nip. Typically, rush transfers are carried out using suction to assist in detaching the web from the donor fabric and thereafter attaching it to the receiving or receptor fabric. In contrast, suction is not required in a fabric creping step, so, accordingly, when we refer to fabric creping as being "under pressure" we are referring to loading of the receptor fabric against the transfer surface, although suction assist can be employed at the expense of further complication of the system so long as the amount of suction is not sufficient to undesirably interfere with rearrangement or redistribution of the fiber.

Pusey and Jones (P&J) hardness (indentation) is measured in accordance with ASTM D 531, and refers to the indentation number (standard specimen and conditions).

Velocity delta means a difference in linear speed.

The void volume and/or void volume ratio as referred to hereafter, are determined by saturating a sheet with a nonpolar POROFIL® liquid and measuring the amount of liquid absorbed. The volume of liquid absorbed is equivalent to the void volume within the sheet structure. The % weight increase (PWI) is expressed as grams of liquid absorbed per gram of fiber in the sheet structure times 100, as noted hereinafter. More specifically, for each single-ply sheet sample to be tested, select eight sheets and cut out a 1 inch by 1 inch square (1 inch in the machine direction and 1 inch in the cross-machine direction). For multi-ply product samples, each ply is measured as a separate entity. Multiple samples should be separated into individual single plies and 8 sheets from each ply position used for testing. Weigh and record the dry weight of each test specimen to the nearest 0.0001 gram. Place the specimen in a dish containing POROFIL® liquid having a specific gravity of about 1.93 grams per cubic centimeter, available from Coulter Electronics Ltd., Northwell Drive, Luton, Beds, England; Part No. 9902458.) After 10 seconds, grasp the specimen at the very edge (1-2 Millimeters in) of one corner with tweezers and remove from the liquid. Hold the specimen with that corner uppermost and allow excess liquid to drip for 30 seconds. Lightly dab (less than ½ second contact) the lower corner of the specimen on #4 filter paper (Whatman Lt., Maidstone, England) in order to remove any excess of the last partial drop. Immediately weigh the specimen, within 10 seconds, recording the weight to the nearest 0.0001 gram. The PWI for each specimen, expressed as grams of POROFIL®liquid per gram of fiber, is calculated as follows:

$$PWI=[(W2-W1)/W1]\times 100$$

wherein

"W1" is the dry weight of the specimen, in grams; and

"W2" is the wet weight of the specimen, in grams.

The PWI for all eight individual specimens is determined as described above and the average of the eight specimens is the PWI for the sample.

The void volume ratio is calculated by dividing the PWI by 1.9 (density of fluid) to express the ratio as a percentage, whereas the void volume (gms/gm) is simply the weight increase ratio; that is, PWI divided by 100.

The creping adhesive used to secure the web to the Yankee drying cylinder is preferably a hygroscopic, re-wettable, substantially non-crosslinking adhesive. Examples of preferred adhesives are those which include poly(vinyl alcohol) of the general class described in U.S. Pat. No. 4,528,316 to Soerens et al. Other suitable adhesives are disclosed in co-pending U.S. Provisional Patent Application No. 60/372,255, filed Apr. 12, 2002, entitled "Improved Creping Adhesive Modifier and Process for Producing Paper Products". The disclosures of the '316 patent and the '255 application are incorporated herein by reference. Suitable adhesives are optionally provided with modifiers, and so forth. It is preferred to use crosslinker and/or modifier sparingly or not at all in the adhesive.

Creping adhesives may comprise a thermosetting or non-thermosetting resin, a film-forming semi-crystalline polymer and optionally an inorganic cross-linking agent as well as modifiers. Optionally, the creping adhesive of the present invention may also include other components, including, but not limited to, hydrocarbons oils, surfactants, or plasticizers. Further details as to creping adhesives useful in connection with the present invention are found in copending Provisional Application No. 60/779,614, filed Mar. 6, 2006, the disclosure of which is incorporated herein by reference.

The creping adhesive may be applied as a single composition or may be applied in its component parts. More particularly, the polyamide resin may be applied separately from the polyvinyl alcohol (PVOH) and the modifier.

When using a creping blade, a normal coating package is suitably applied at a total coating rate (add-on as calculated above) of 54 mg/m2 with 32 mg/m2 of PVOH (Celvol 523)/11.3 mg/m2 of PAE (Hercules 1145) and 10.5 mg/m2 of modifier (Hercules 4609VF). A preferred coating for a peeling process may be applied at a rate of 20 mg/m2 with 14.52 mg/m2 of PVOH (Celvol 523)/5.10 mg/m2 of PAE (Hercules 1145) and 0.38 mg/m2 of modifier (Hercules 4609VF).

In connection with the present invention, an absorbent paper web is made by dispersing papermaking fibers into aqueous furnish (slurry) and depositing the aqueous furnish onto the forming wire of a papermaking machine. Any suitable forming scheme might be used. For example, an extensive but non-exhaustive list in addition to Fourdrinier formers includes a crescent former, a C-wrap twin wire former, an S-wrap twin wire former, or a suction breast roll former. The forming fabric can be any suitable foraminous member including single layer fabrics, double layer fabrics, triple layer fabrics, photopolymer fabrics, and the like. Non-exhaustive background art in the forming fabric area includes U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,261; 5,199,467; 5,211,815; 5,219,004; 5,245,025; 5,277,761; 5,328,565; and 5,379,808 all of which are incorporated herein by reference in their entirety. One forming fabric particularly useful with the present invention is Voith Fabrics Forming Fabric 2164 made by Voith Fabrics Corporation, Shreveport, La.

Foam-forming of the aqueous furnish on a forming wire or fabric may be employed as a means for controlling the permeability or void volume of the sheet upon fabric-creping. Foam-forming techniques are disclosed in U.S. Pat. No. 4,543,156 and Canadian Patent No. 2,053,505, the disclosures of which are incorporated herein by reference. The foamed fiber furnish is made up from an aqueous slurry of fibers mixed with a foamed liquid carrier just prior to its introduction to the headbox. The pulp slurry supplied to the system has a consistency in the range of from about 0.5 to about 7 weight % fibers, preferably, in the range of from about 2.5 to about 4.5 weight %. The pulp slurry is added to a foamed liquid comprising water, air and surfactant containing 50 to 80% air by volume, forming a foamed fiber furnish having a consistency in the range of from about 0.1 to about 3 weight % fiber by simple mixing from natural turbulence and mixing inherent in the process elements. The addition of the pulp as a low consistency slurry results in excess foamed liquid recovered from the forming wires. The excess foamed liquid is discharged from the system and may be used elsewhere or treated for recovery of surfactant therefrom.

The furnish may contain chemical additives to alter the physical properties of the paper produced. These chemistries are well understood by the skilled artisan and may be used in any known combination. Such additives may be surface modifiers, softeners, debonders, strength aids, latexes, opacifiers, optical brighteners, dyes, pigments, sizing agents, barrier chemicals, retention aids, insolubilizers, organic or inorganic crosslinkers, or combinations thereof; said chemicals optionally comprising polyols, starches, PPG esters, PEG esters, phospholipids, surfactants, polyamines, HMCP (Hydrophobically Modified Cationic Polymers), HMAP (Hydrophobically Modified Anionic Polymers), or the like.

The pulp can be mixed with strength adjusting agents such as wet strength agents, dry strength agents and debonders/softeners and so forth. Suitable wet strength agents are known to the skilled artisan. A comprehensive, but non-exhaustive, list of useful strength aids include urea-formaldehyde resins, melamine formaldehyde resins, glyoxylated polyacrylamide resins, polyamide-epichlorohydrin resins, and the like. Thermosetting polyacrylamides are produced by reacting acrylamide with diallyl dimethyl ammonium chloride (DADMAC) to produce a cationic polyacrylamide copolymer, which is ultimately reacted with glyoxal to produce a cationic cross-linking wet strength resin, glyoxylated polyacrylamide. These materials are generally described in U.S. Pat. No. 3,556,932 to Coscia et al. and No. 3,556,933 to Williams et al., both of which are incorporated herein by reference in their entirety. Resins of this type are commercially available under the trade name of PAREZ 631NC by Bayer Corporation. Different mole ratios of acrylamide/-DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorohydrin wet strength resins, an example of which is sold under the trade names Kymene 557LX and Kymene 557H by Hercules Incorporated of Wilmington, Del. and AMRES® from Georgia-Pacific Resins, Inc. These resins and the process for making the resins are described in U.S. Pat. No. 3,700,623 and U.S. Pat. No. 3,772,076, each of which is incorporated herein by reference in its entirety. An extensive description of polymeric-epihalohydrin resins is given in Chapter 2: Alkaline-Curing Polymeric Amine-Epichlorohydrin by Espy in *Wet Strength Resins and Their Application* (L. Chan, Editor, 1994), herein incorporated by reference in its entirety. A reasonably comprehensive list of wet strength resins is described by Westfelt in *Cellulose Chemistry and Technology* Volume 13, p. 813, 1979, which is also incorporated herein by reference.

Suitable temporary wet strength agents may likewise be included, particularly in applications where disposable towel, or more typically, tissue with permanent wet strength resin is to be avoided. A comprehensive but non-exhaustive list of useful temporary wet strength agents includes aliphatic and aromatic aldehydes including glyoxal, malonic dialdehyde, succinic dialdehyde, glutaraldehyde and dialdehyde starches, as well as substituted or reacted starches, disaccharides, polysaccharides, chitosan, or other reacted polymeric reaction products of monomers or polymers having aldehyde groups, and optionally, nitrogen groups. Representative nitrogen containing polymers, which can suitably be reacted with the aldehyde containing monomers or polymers, includes vinyl-amides, acrylamides and related nitrogen containing polymers. These polymers impart a positive charge to the aldehyde containing reaction product. In addition, other commercially available temporary wet strength agents, such as, PAREZ 745, manufactured by Bayer can be used, along with those disclosed, for example in U.S. Pat. No. 4,605,702.

The temporary wet strength resin may be any one of a variety of water-soluble organic polymers comprising aldehydic units and cationic units used to increase dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769 and 5,217,576. Modified starches sold under the trademarks CO-BOND® 1000 and CO-BOND® 1000 Plus, by National Starch and Chemical Company of Bridgewater, N.J. may be used. Prior to use, the cationic aldehydic water soluble polymer can be prepared by preheating an aqueous slurry of approximately 5% solids maintained at a temperature of approximately 240 degrees Fahrenheit and a pH of about 2.7 for approximately 3.5 minutes. Finally, the slurry can be quenched and diluted by adding water to produce a mixture of approximately 1.0% solids at less than about 130 degrees Fahrenheit.

Other temporary wet strength agents, also available from National Starch and Chemical Company are sold under the trademarks CO-BOND® 1600 and CO-BOND® 2300. These starches are supplied as aqueous colloidal dispersions and do not require preheating prior to use.

Suitable dry strength agents include starch, guar gum, polyacrylamides, carboxymethyl cellulose and the like. Of particular utility is carboxymethyl cellulose, an example of which is sold under the trade name Hercules CMC, by Hercules Incorporated of Wilmington, Del. According to one embodiment, the pulp may contain from about 0 to about 15 lb/ton of dry strength agent. According to another embodiment, the pulp may contain from about 1 to about 5 lbs/ton of dry strength agent.

Suitable debonders are likewise known to the skilled artisan. Debonders or softeners may also be incorporated into the pulp or sprayed upon the web after its formation. The present invention may also be used with softener materials including but not limited to the class of amido amine salts derived from partially acid neutralized amines. Such materials are disclosed in U.S. Pat. No. 4,720,383. Evans, *Chemistry and Industry,* 5 Jul. 1969, pp. 893-903; Egan, *J. Am. Oil Chemist's Soc.*, Vol. 55 (1978), pp. 118-121; and Trivedi et al., *J. Am. Oil Chemist's Soc.*, June 1981, pp. 754-756, incorporated by reference in their entirety, indicate that softeners are often available commercially only as complex mixtures rather than as single compounds. While the following discussion will focus on the predominant species, it should be understood that commercially available mixtures would generally be used in practice.

Quasoft 202-JR is a suitable softener material, which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably 6 to 7 and most preferably 6.5 to 7.

Quaternary ammonium compounds, such as dialkyl dimethyl quaternary ammonium salts are also suitable particularly when the alkyl groups contain from about 10 to 24 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

In some embodiments, a particularly preferred debonder composition includes a quaternary amine component as well as a nonionic surfactant.

The nascent web may be compactively dewatered on a papermaking felt. Any suitable felt may be used. For example, felts can have double-layer base weaves, triple-layer base weaves, or laminated base weaves. Preferred felts are those having the laminated base weave design. A wet-press-felt which may be particularly useful with the present invention is Vector 3 made by Voith Fabric. Background art in the press felt area includes U.S. Pat. Nos. 5,657,797; 5,368,696; 4,973,512; 5,023,132; 5,225,269; 5,182,164; 5,372,876; and 5,618,612. A differential pressing felt as is disclosed in U.S. Pat. No. 4,533,437 to Curran et al. may likewise be utilized.

Figure 7:
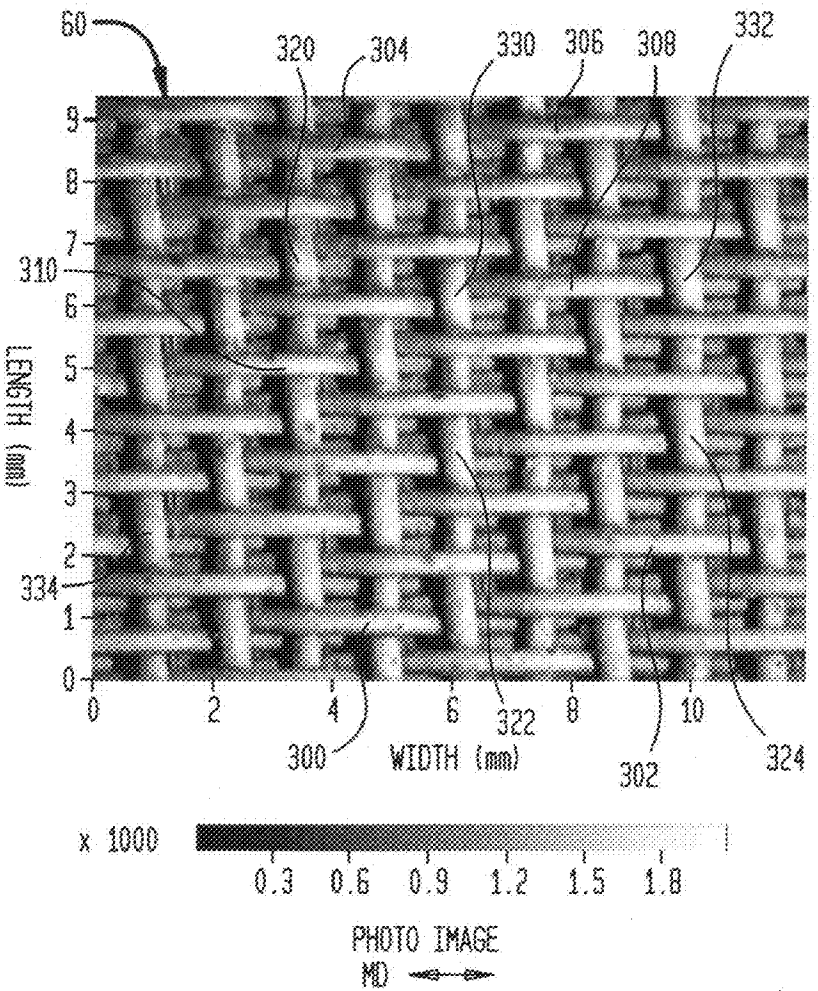
FIG. 7 is a gray scale topographical photomicrograph of a multi-layer fabric which is used as a creping fabric to make the products of the present invention.

Suitable creping or textured fabrics include single layer or multi-layer, or composite preferably open meshed structures. Fabric construction per se is of less importance than the topography of the creping surface in the creping nip as discussed in more detail below. Long MD knuckles with slightly lowered CD knuckles are greatly preferred for many products. Fabrics may have at least one of the following characteristics: (1) on the side of the creping fabric that is in contact with the wet web (the "top" side), the number of machine direction (MD) strands per inch (mesh) is from 10 to 200 and the number of cross-direction (CD) strands per inch (count) is also from 10 to 200, (2) the strand diameter is typically smaller than 0.050 inch, (3) on the top side, the distance between the highest point of the MD knuckles and the highest point on the CD knuckles is from about 0.001 to about 0.02 or 0.03 inch, (4) in between these two levels there can be knuckles formed either by MD or CD strands that give the topography a three dimensional hill/valley appearance which is imparted to the sheet, (5) the fabric may be oriented in any suitable way so as to achieve the desired effect on processing and on properties in the product; the long warp knuckles may be on the top side to increase MD ridges in the product, or the long shute knuckles may be on the top side if more CD ridges are desired to influence creping characteristics as the web is transferred from the transfer cylinder to the creping fabric, and (6) the fabric may be made to show certain geometric patterns that are pleasing to the eye, which is typically repeated between every two to 50 warp yarns. An especially preferred fabric is a W013 Albany International multilayer fabric. Such fabrics are formed from monofilament polymeric fibers having diameters typically ranging from about 0.25 mm to about 1 mm. A particularly preferred fabric is shown in FIG. 7 and the following.

In order to provide additional bulk, a wet web is creped into a textured fabric and expanded within the textured fabric by suction, for example.

If a Fourdrinier former or other gap former is used, the nascent web may be conditioned with suction boxes and a steam shroud until it reaches a solids content suitable for transferring to a dewatering felt. The nascent web may be transferred with suction assistance to the felt. In a crescent former, use of suction assist is unnecessary as the nascent web is formed between the forming fabric and the felt.

Figure 4:
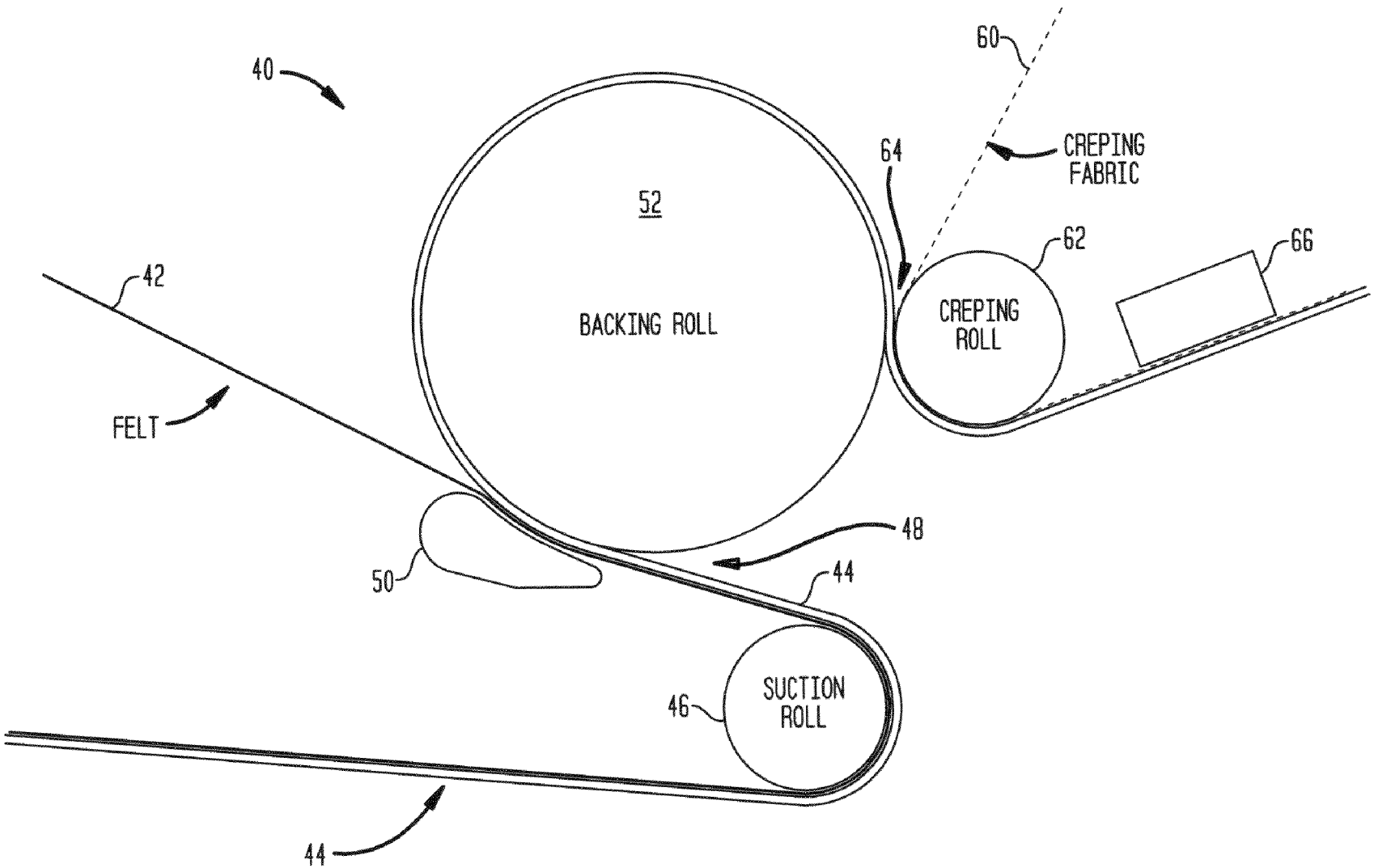
FIG. 4 is a schematic view illustrating fabric creping as practiced in connection with the present invention.

A preferred mode of making the inventive products involves compactively dewatering a papermaking furnish having an apparently random distribution of fiber orientation and fabric creping the web so as to redistribute the furnish in order to achieve the desired properties. Salient features of a typical apparatus 40 for producing the inventive products are shown in FIG. 4. Apparatus 40 includes a papermaking felt 42, a suction roll 46, a press shoe 50, and a backing roll 52. There is further provided a creping roll 62, a creping fabric 60, as well as an optional suction box 66.

In operation, felt 42 conveys a nascent web 44 around a suction roll 46 into a press nip 48. In press nip 48, the web is compactively dewatered and transferred to a backing roll 52 (sometimes referred to as a transfer roll hereinafter) where the web is conveyed to the creping fabric. In a creping nip 64, web 44 is transferred into fabric 60, as discussed in more detail hereafter. The creping nip is defined between backing roll 52 and creping fabric 60, which is pressed against roll 52 by creping roll 62, which may be a soft covered roll, as is also discussed hereafter. After the web is transferred into fabric 60, a suction box 66 may be used to apply suction to the sheet in order to draw out microfolds if so desired.

Figure 5:
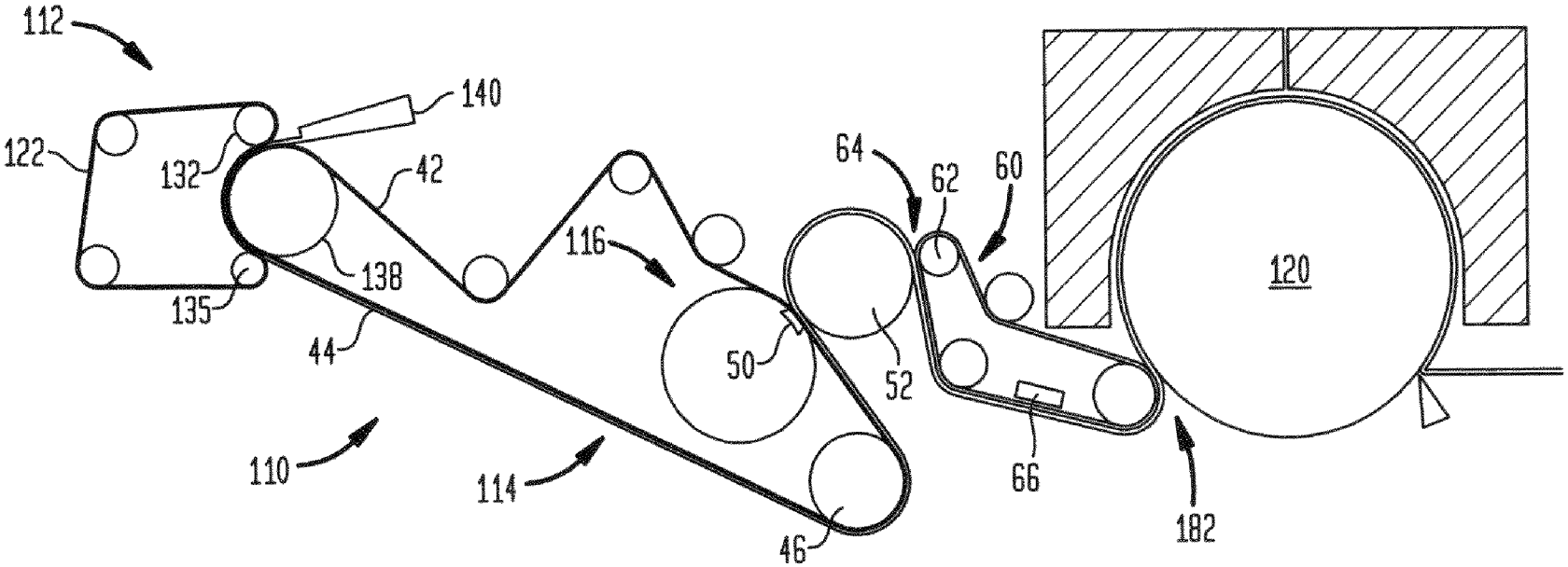
FIG. 5 is a schematic diagram of a paper machine which may be used to manufacture products of the present invention.
Figure 6:
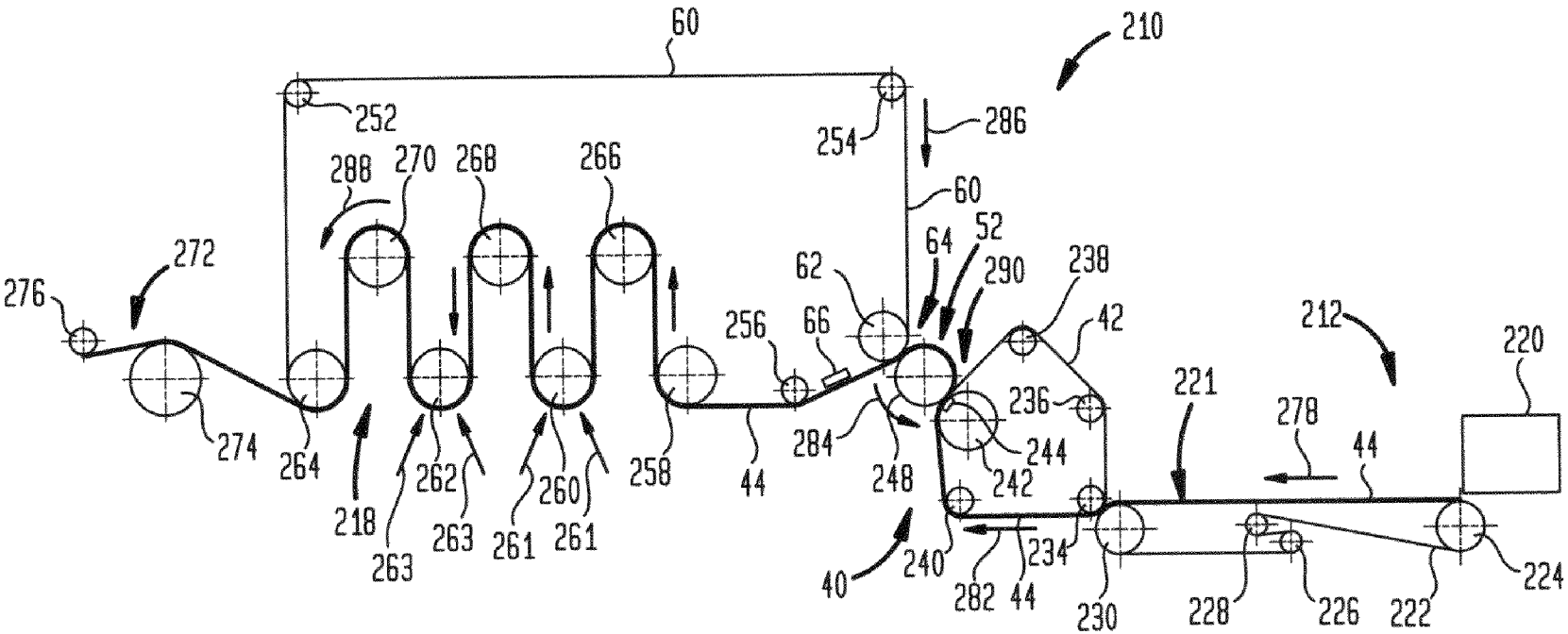
FIG. 6 is a schematic view of another paper machine which may be used to manufacture products of the present invention.

A papermachine suitable for making the product of the invention may have various configurations as is seen in FIGS. 5 and 6 discussed below.

FIG. 5 shows a papermachine 110 for use in connection with the present invention. Papermachine 110 is a three fabric loop machine having a forming section 112 generally referred to in the art as a crescent former. Forming section 112 includes a forming wire 122 supported by a plurality of rolls such as rolls 132, 135. The forming section also includes a forming roll 138 which supports papermaking felt 42 such that web 44 is formed directly on felt 42. Felt run 114 extends to a shoe press section 116 wherein the moist web is deposited on a backing roll 52 and wet-pressed concurrently with the transfer. Thereafter, web 44 is creped onto fabric 60 in fabric crepe nip 64 before being deposited on Yankee dryer 120 in another press nip 182 using a creping adhesive as noted above. The system includes a suction turning roll 46, in some embodiments; however, the three loop system may be configured in a variety of ways wherein a turning roll is not necessary. This feature is particularly important in connection with the rebuild of a papermachine, inasmuch as the expense of relocating associated equipment, i.e., pulping or fiber processing equipment and/or the large and expensive drying equipment, such as the Yankee dryer or plurality of can dryers would make a rebuild prohibitively expensive, unless the improvements could be configured to be compatible with the existing facility.

Referring to FIG. 6, a paper machine 210 is schematically shown, which may be used to practice the present invention. Paper machine 210 includes a forming section 212, a press section 40, a crepe roll 62, as well as a can dryer section 218. Forming section 212 includes: a head box 220, a forming fabric or wire 222, which is supported on a plurality of rolls to provide a forming table 221. There is thus provided forming roll 224, support rolls 226, 228 as well as a transfer roll 230.

Press section 40 includes a papermaking felt 42 supported on rollers 234, 236, 238, 240 and shoe press roll 242. Shoe press roll 242 includes a shoe 244 for pressing the web against transfer drum or roll 52. Transfer roll or drum 52 may be heated if so desired. In one preferred embodiment, the temperature is controlled so as to maintain a moisture profile in the web so a sided sheet is prepared, having a local variation in basis weight which does not extend to the surface of the web in contact with cylinder 52. Typically, steam is used to heat cylinder 52, as is noted in U.S. Pat. No. 6,379,496 of Edwards et al. Roll 52 includes a transfer surface 248, upon which the web is deposited during manufacture. Crepe roll 62 supports, in part, a creping fabric 60, which is also supported on a plurality of rolls 252, 254 and 256.

Dryer section 218 also includes a plurality of can dryers 258, 260, 262, 264, 266, 268, and 270 as shown in the diagram, wherein cans 266, 268 and 270 are in a first tier and cans 258, 260, 262 and 264 are in a second tier. Cans 266, 268 and 270 directly contact the web, whereas cans in the other tier contact the fabric. In this two tier arrangement where the web is separated from cans 260 and 262 by the fabric, it is sometimes advantageous to provide impingement air dryers at 260 and 262, which may be drilled cans, such that air flow is indicated schematically at 261 and 263.

There is further provided a reel section 272 which includes a guide roll 274 and a take up reel 276 shown schematically in the diagram.

Paper machine 210 is operated such that the web travels in the machine direction indicated by arrows 278, 282, 284, 286 and 288 as is seen in FIG. 6. A papermaking furnish at low consistency, less than 5%, is deposited on fabric or wire 222 to form a web 44 on table 221 as is shown in the diagram. Web 44 is conveyed in the machine direction to press section 40 and transferred onto a press felt 42. In this connection, the web is typically dewatered to a consistency of between about 10 and 15% on wire 222 before being transferred to the felt. So also, roll 234 may be a suction roll to assist in transfer to the felt 42. On felt 42, web 44 is dewatered to a consistency typically of from about 20 to about 25% prior to entering a press nip indicated at 290. At nip 290, the web is pressed onto cylinder 52 by way of shoe press roll 242. In this connection, the shoe 244 exerts pressure where upon the web is transferred to surface 248 of roll 52 at a consistency of from about 40 to 50% on the transfer roll. Transfer roll 52 translates in the machine direction indicated by 284 at a first speed.

Fabric 60 travels in the direction indicated by arrow 286 and picks up web 44 in the creping nip indicated at 64. Fabric 60 is traveling at second speed slower than the first speed of the transfer surface 248 of roll 52. Thus, the web is provided with a Fabric Crepe typically in an amount of from about 10 to about 100% in the machine direction.

The creping fabric defines a creping nip over the distance in which creping fabric 60 is adapted to contact surface 248 of roll 52; that is, applies significant pressure to the web against the transfer cylinder. To this end, creping roll 62 may be provided with a soft deformable surface which will increase the width of the creping nip and increase the fabric creping angle between the fabric and the sheet at the point of contact or a shoe press roll or similar device could be used as roll 52 or 62 to increase effective contact with the web in high impact fabric creping nip 64, where web 44 is transferred to fabric 60 and advanced in the machine-direction. By using different equipment at the creping nip, it is possible to adjust the fabric creping angle or the takeaway angle from the creping nip. A cover on roll 62 having a Pusey and Jones hardness of from about 25 to about 90 may be used. Thus, it is possible to influence the nature and amount of redistribution of fiber, delamination/debonding which may occur at fabric creping nip 64 by adjusting these nip parameters. In some embodiments, it may by desirable to restructure the z-direction inter-fiber characteristics while in other cases it may be desired to influence properties only in the plane of the web. The creping nip parameters can influence the distribution of fiber in the web in a variety of directions, including inducing changes in the z-direction, as well as in the MD and CD. In any case, the transfer from the transfer cylinder to the creping fabric is high impact in that the fabric is traveling slower than the web, and a significant velocity change occurs. Typically, the web is creped anywhere from 5-60% and even higher during transfer from the transfer cylinder to the fabric.

Creping nip 64 generally extends over a fabric creping nip distance or width of anywhere from about ⅛" to about 2", typically ½" to 2". For a creping fabric with 32 CD strands per inch, web 44 thus will encounter anywhere from about 4 to 64 weft filaments in the nip.

The nip pressure in nip 64, that is, the loading between creping roll 62 and transfer roll 52 is suitably 20-100, preferably 40-70 pounds per linear inch (PLI).

Following the Fabric Crepe, web 44 is retained in fabric 60 and fed to dryer section 218. In dryer section 218, the web is dried to a consistency of from about 92 to 98% before being wound up on reel 276. Note that there is provided in the drying section a plurality of heated drying rolls 266, 268 and 270, which are in direct contact with the web on fabric 60. The drying cans or rolls 266, 268, and 270 are steam heated to an elevated temperature operative to dry the web. Rolls 258, 260, 262 and 264 are likewise heated, although these rolls contact the fabric directly and not the web directly. Optionally provided is a suction box 66 which can be used to expand the web within the fabric to increase caliper as noted above.

In some embodiments of the invention, it is desirable to eliminate open draws in the process, such as the open draw between the creping and drying fabric and reel 276. This is readily accomplished by extending the creping fabric to the reel drum and transferring the web directly from the fabric to the reel, as is disclosed generally in U.S. Pat. No. 5,593,545 to Rugowski et al.

Figure 8:
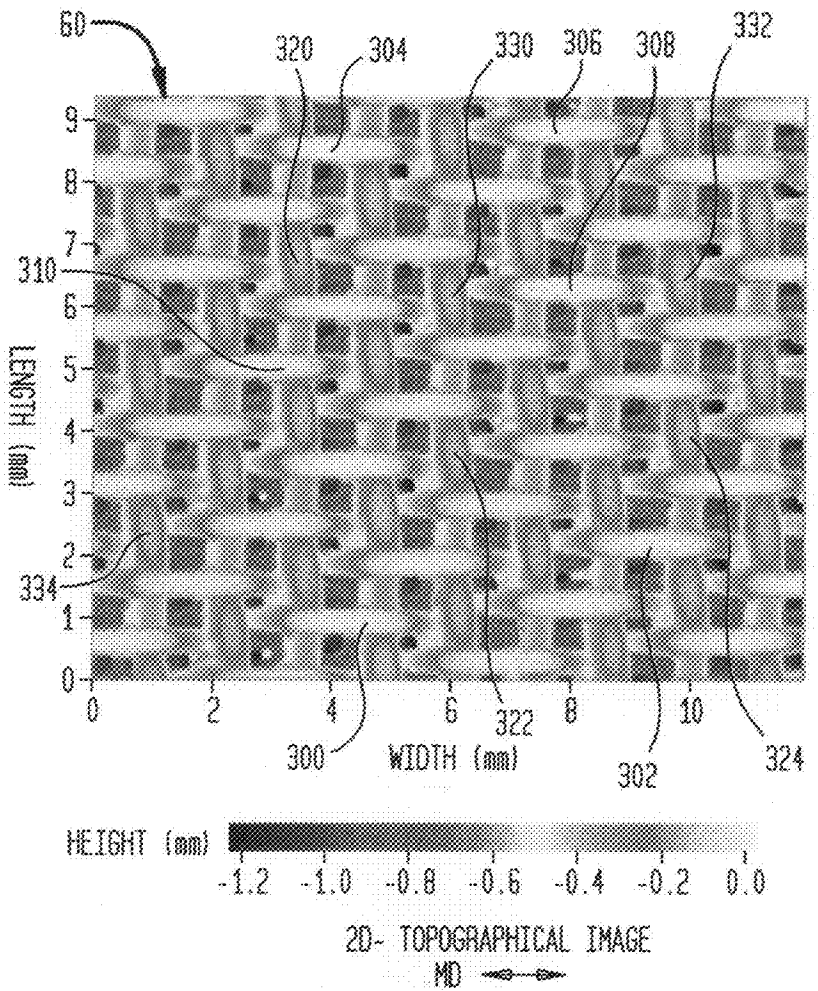
FIG. 8 is a color topographical representation of the creping fabric shown in FIG. 7.
Figure 9:
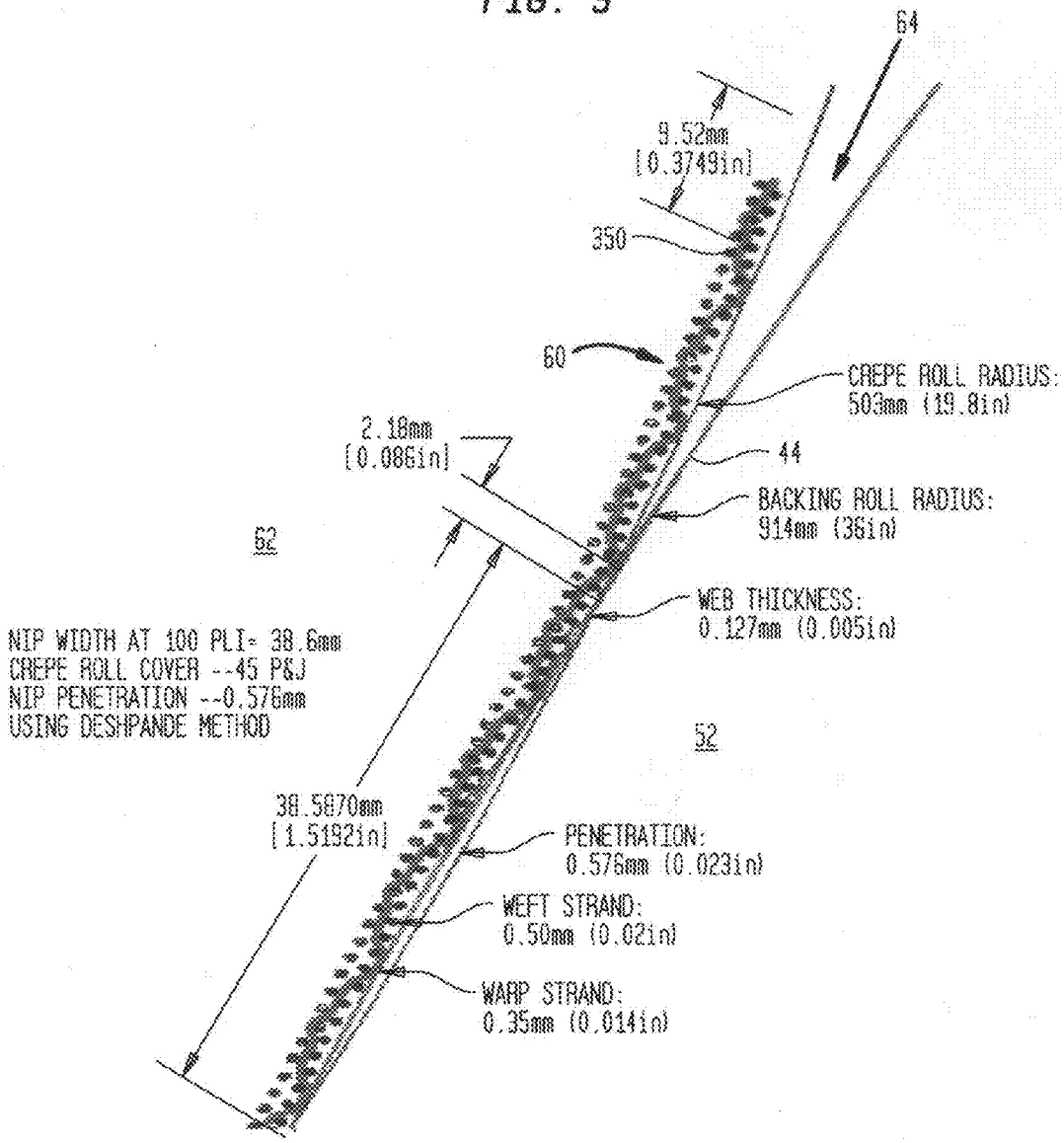
FIG. 9 is a schematic view illustrating a fabric creping nip utilizing the fabric of FIGS. 7 and 8.
Figure 10:
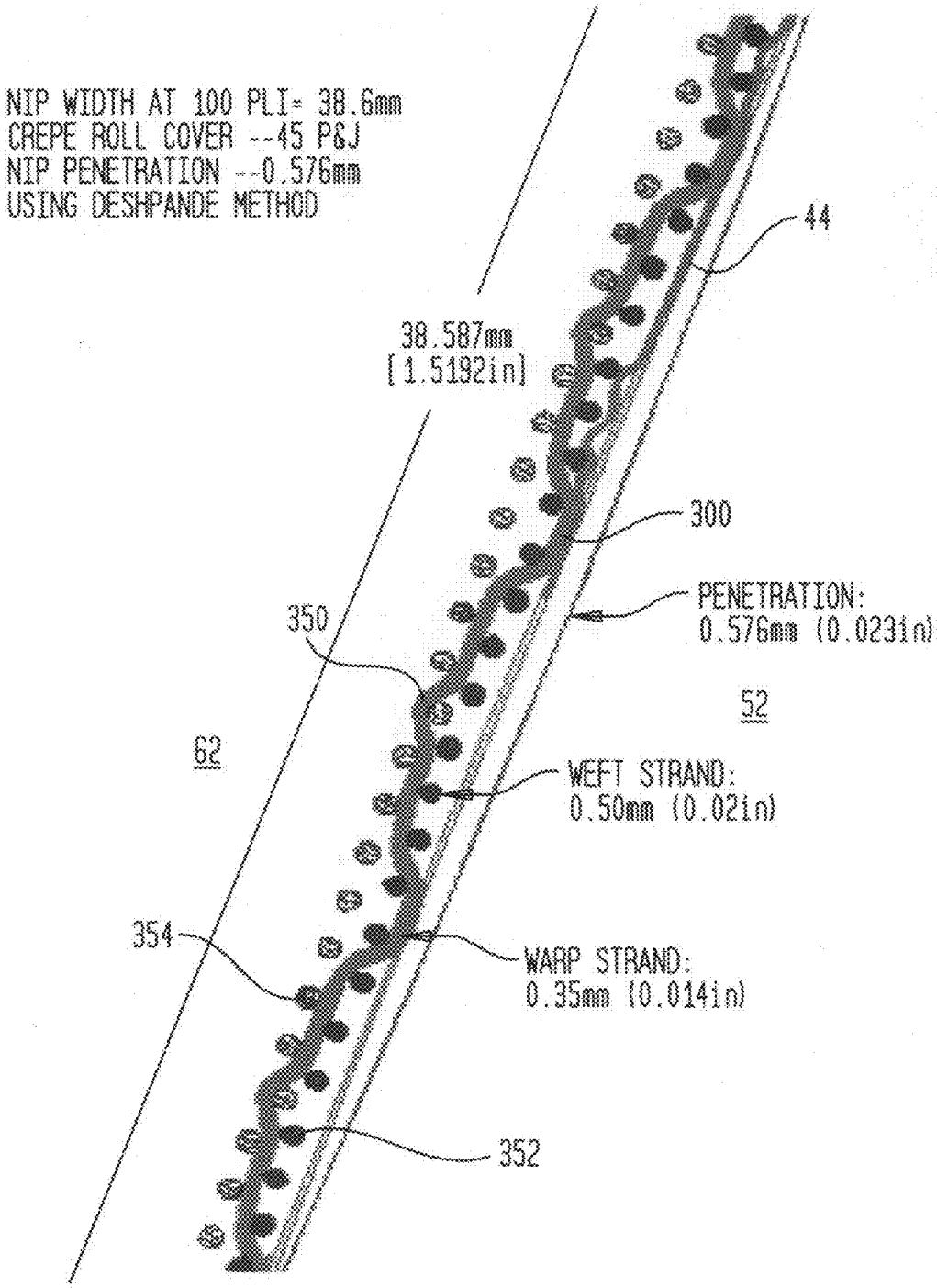
FIG. 10 is an enlarged schematic view of a portion of the creping nip illustrated in FIG. 9.

A preferred creping fabric 60 is shown in FIGS. 7 and 8. FIG. 7 is a gray scale topographical photo image of creping fabric 60, while FIG. 8 is an enhanced two-dimensional topographical color image of the creping fabric shown in FIG. 7. Fabric 60 is mounted in the apparatus of FIG. 4, 5, or 6 such that its MD knuckles 300, 302, 304, 306, 308, 310, and so forth, extend along the machine direction of the paper machine. It will be appreciated from FIGS. 7 and 8 that fabric 60 is a multi-layer fabric having creping pockets 320, 322, 324, and so forth, between the MD knuckles of the fabric. There is also provided a plurality of CD knuckles 330, 332, 334, and so forth, which may be preferably recessed slightly with respect to the MD knuckles of the creping fabric. The CD knuckles may be recessed with respect to the MD knuckles a distance of from about 0.1 mm to about 0.3 mm. This geometry creates a unique distribution of fiber when the web is wet creped from a transfer roll, as will be appreciated from FIG. 9 and following. Without intending to be bound by theory, it is believed that the structure illustrated, with relatively large recessed "pockets" and limited knuckle length and height in the CD, redistributes the fiber upon high impact creping to produce a sheet, which is especially suitable for recycle furnish and provides surprising caliper.

FIGS. 9 through 12 schematically show a creping nip 64, wherein a web 44 is transferred from a transfer or backing roll 52 into creping fabric 60. Fabric 60 has a plurality of warp filaments, such as filaments 350, as well as a plurality of weft filaments, as will be appreciated from the Figures discussed above. The weft filaments are arranged in a first level 352, as well as a second level 354 as shown in the diagrams. The various filaments or strands may be of any suitable dimensions, typically, a weft strand would have a diameter of 0.50 mm, while a warp strand would be somewhat smaller, perhaps 0.35 mm. The warp filaments extend around both levels of weft filaments, such that the elongated knuckles, such as knuckle 300, contacts the web as it is disposed on transfer roll 52, as shown in the various diagrams. The warp strands also may have smaller knuckles distal to the creping surface if so desired.

In a particularly preferred embodiment, the nip width at 100 pli is approximately 34.8 mm when used in connection with the crepe roll cover having a 45 P&J hardness. The nip penetration is calculated as 0.49 mm using the Deshpande method, assuming a 1" thick sleeve. A 2" thick sleeve is likewise suitable.

Figure 11:
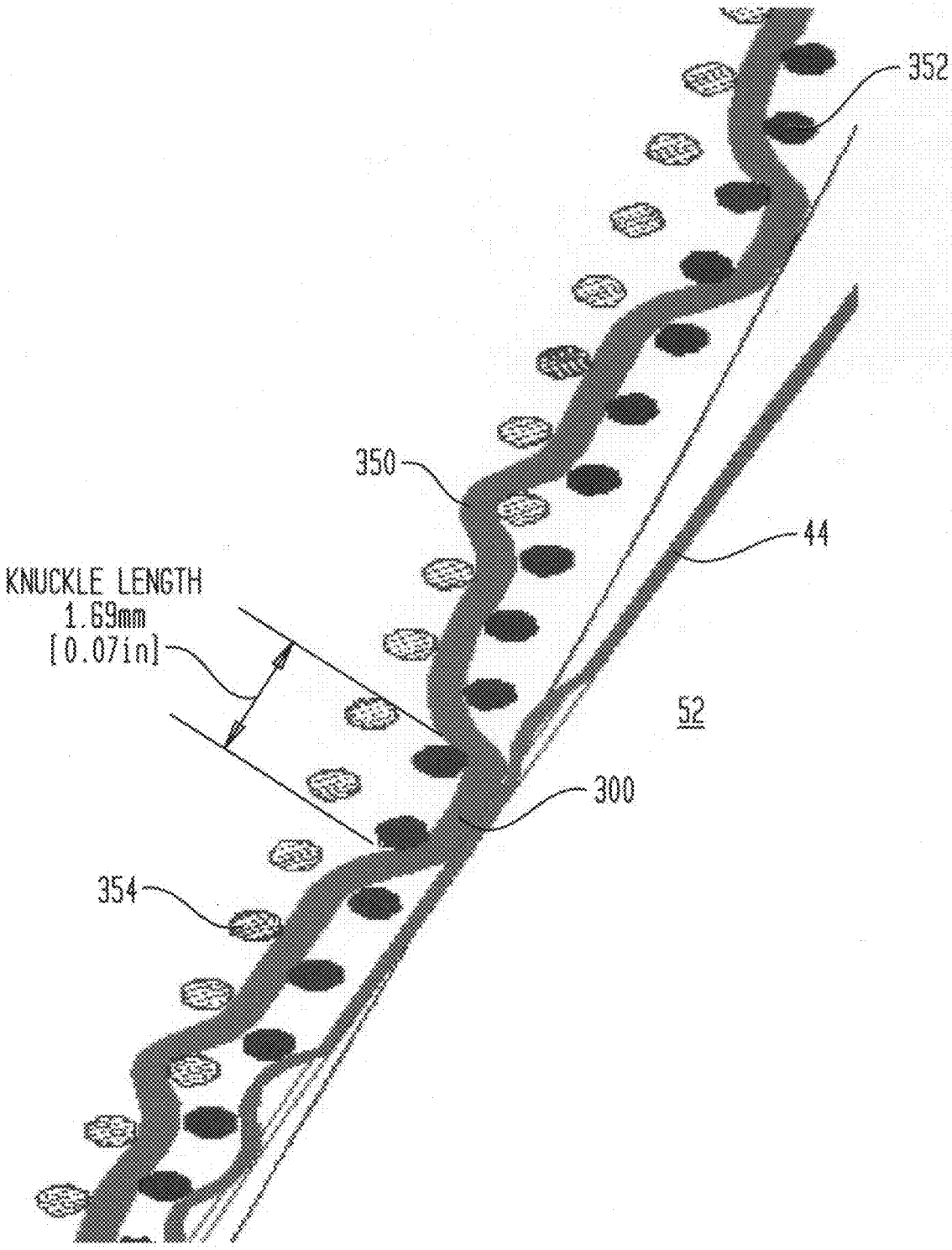
FIG. 11 is yet another enlarged schematic view of the creping nip of FIGS. 9 and 10.
Figure 12:
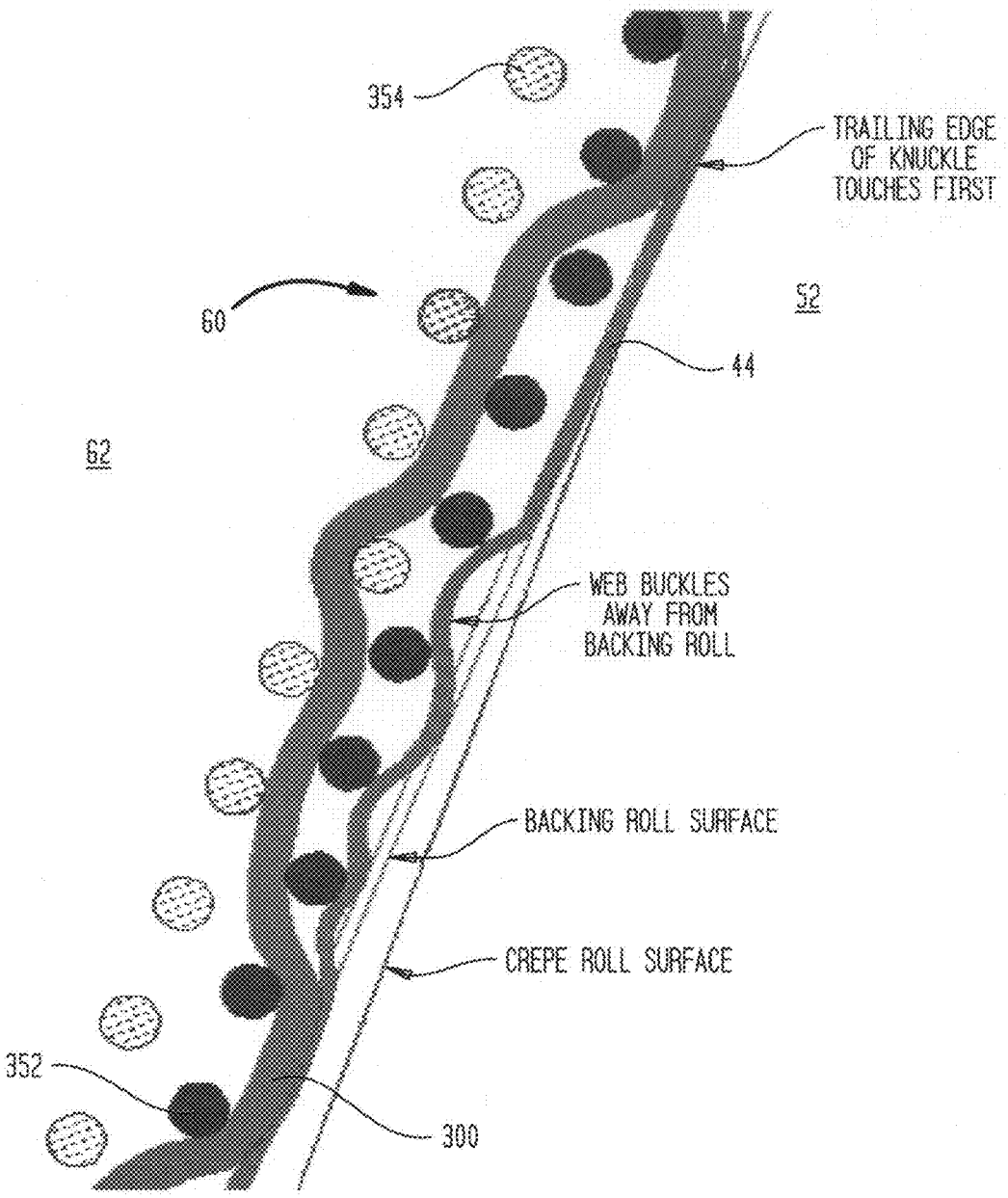
FIG. 12 is still yet another enlarged schematic view of the creping nip of FIGS. 9, 10 and 11.

A suitable fabric for use in connection with the present invention is a WO-13 fabric available from Albany International. This fabric provides MD knuckles having a MD length of about 1.7 mm as shown in FIG. 11.

Without intending to be bound by any theory, it is believed that creping from transfer roll 52 and redistribution of the papermaking fiber into the pockets of the creping fabric occurs as shown in FIGS. 9 through 12. That is to say, the trailing edge of the knuckles contacts the web first where upon the web buckles from the backing roll into the relatively deep creping pockets of the fabric away from the backing roll. Note particularly FIG. 12. The creping process with this fabric produces a unique product of the invention, which is described in connection with FIGS. 13 and 14.

Figure 13:
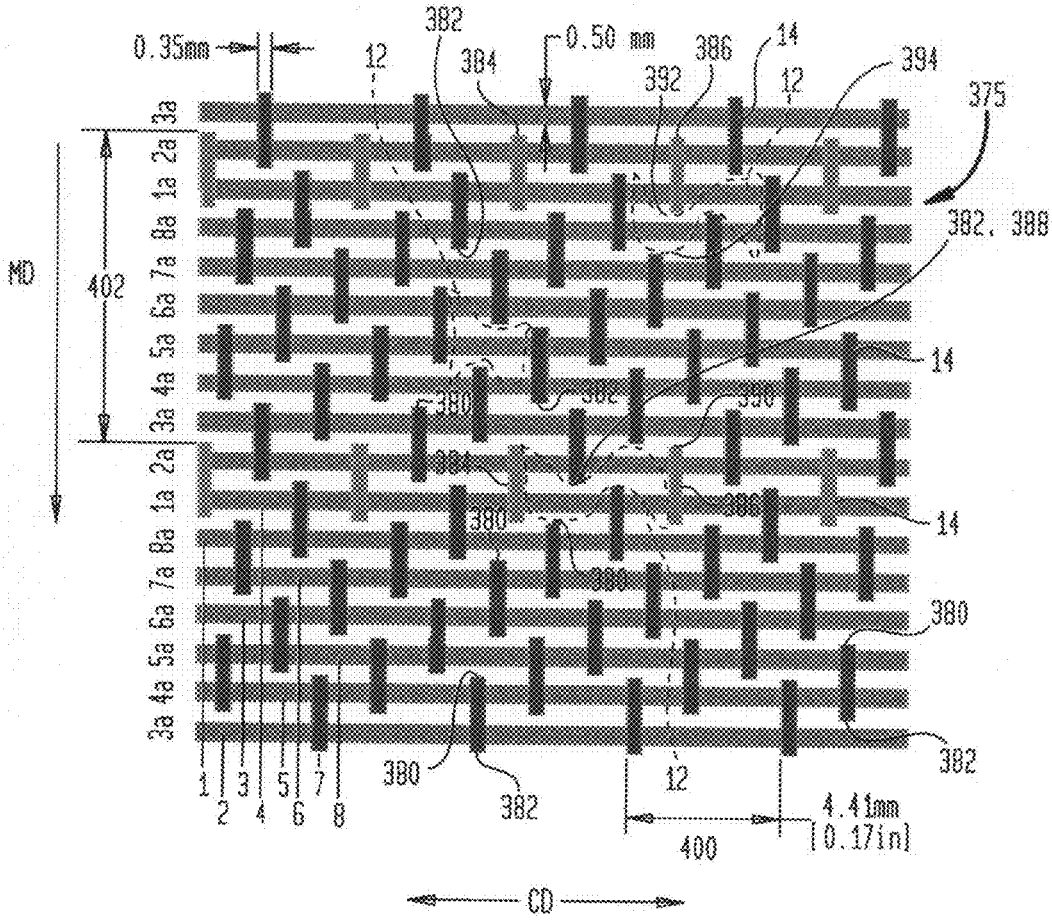
FIG. 13 is a schematic representation of the creping fabric pattern of FIGS. 7 and 8, as well as being a schematic representation of the patterned product made using that fabric.
Figure 14:
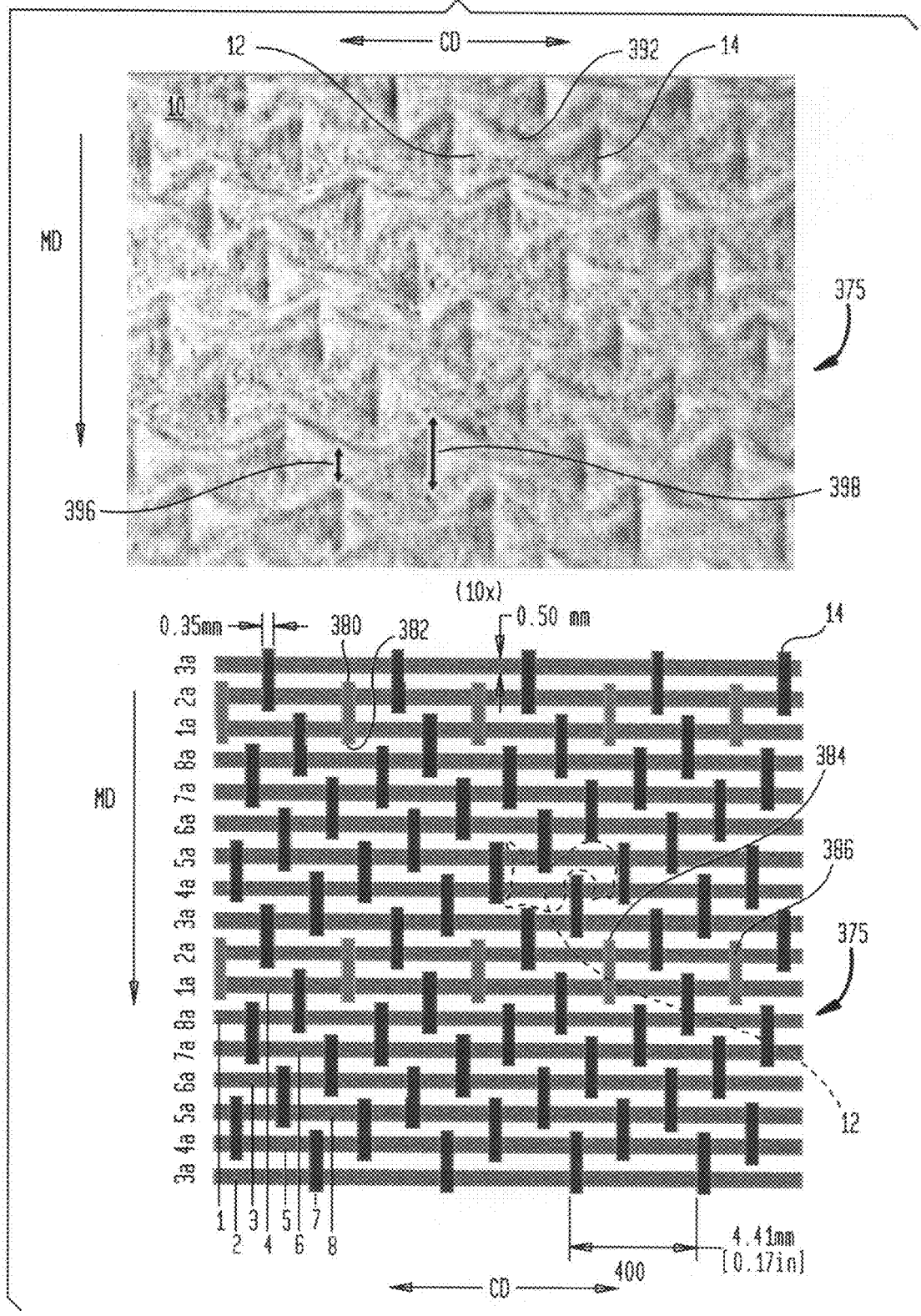
FIG. 14 is a schematic representation of the creping fabric pattern of FIGS. 7 and 8 aligned with a sheet produced utilizing that fabric, wherein it is seen that the MD knuckles correspond to the densified regions in the fabric.

There is illustrated schematically (and photographically) in FIGS. 13 and 14 a pattern with a plurality of repeating linear arrays 1, 2, 3, 4, 5, 6, 7, 8 of compressed densified regions 14, which are oriented in the machine direction. These regions form a repeating pattern 375 corresponding to the MD knuckles of fabric 60. For purposes of convenience, pattern 375 is presented schematically in FIG. 13 and the lower part of FIG. 14 as warp arrays 1-8 and weft bars 1*a*-8*a*; the top of FIG. 14 is a photomicrograph of a sheet produced with this pattern. Pattern 375 thus includes a plurality of generally machine direction (MD) oriented elongated densified regions 14 of compressed papermaking fibers having a relatively low local basis weight as well as leading and trailing edges 380, 382, the densified regions being arranged in a repeating pattern of a plurality of generally parallel linear arrays 1-8, which are longitudinally staggered with respect to each other such that a plurality of intervening linear arrays are disposed between a pair of CD-aligned densified regions 384, 386. There is a plurality of fiber-enriched, pileated regions 12 having a relatively high local basis weight interspersed between and connected with the densified regions, the pileated regions having crests extending laterally in the CD. The generally parallel, longitudinal arrays of densified regions 14 are positioned and configured such that a fiber-enriched region 12 between a pair of CD-aligned densified regions extends in the CD unobstructed by leading or trailing edges 380, 382 of densified regions of at least one intervening linear array thereof. As shown, the generally parallel, longitudinal arrays of densified regions are positioned and configured such that a fiber-enriched region 12 between a pair of CD-aligned densified regions 14 extends in the CD unobstructed by leading or trailing edges of densified regions of at least two intervening linear arrays. So also, a fiber-enriched region 12 between a pair of CD-aligned densified regions 384, 386 is at least partially truncated and at least partially bordered in the MD by the leading or trailing edges of densified regions of at least one or two intervening linear arrays of the sheet at MD position 388 intermediate MD positions 380, 390 of the leading and trailing edges of the CD-aligned densified regions. The leading and trailing MD edges 392, 394 of the fiber-enriched pileated regions are generally inwardly concave such that a central MD span 396 of the fiber-enriched regions is less than an MD span 398 at the lateral extremities of the fiber-enriched areas. The elongated densified regions occupy from about 5% to about 30% of the area of the sheet and are estimated as corresponding to the MD knuckle area of the fabric employed. The pileated regions occupy from about 95% to about 50% of the area of the sheet and are estimated by the recessed areas of the fabric. In the embodiment shown in FIGS. 13 and 14, the distance 400 between CD-aligned densified regions is 4.41 mm, such that the linear arrays of densified regions have an MD repeat frequency of about 225 meter−1. The densified elements of the arrays are spaced a distance 402 of about 8.8 mm, thus having an MD repeat frequency of about 110 meter−1.

The fiber-enriched regions have a concamerated structure, wherein the crests of the pileated regions are arched around the leading and trailing edges of the densified regions, as is seen particularly at the top of FIG. 14.

The product thus has the attributes shown and described above in connection with FIGS. 1 and 2.

Figure 15:
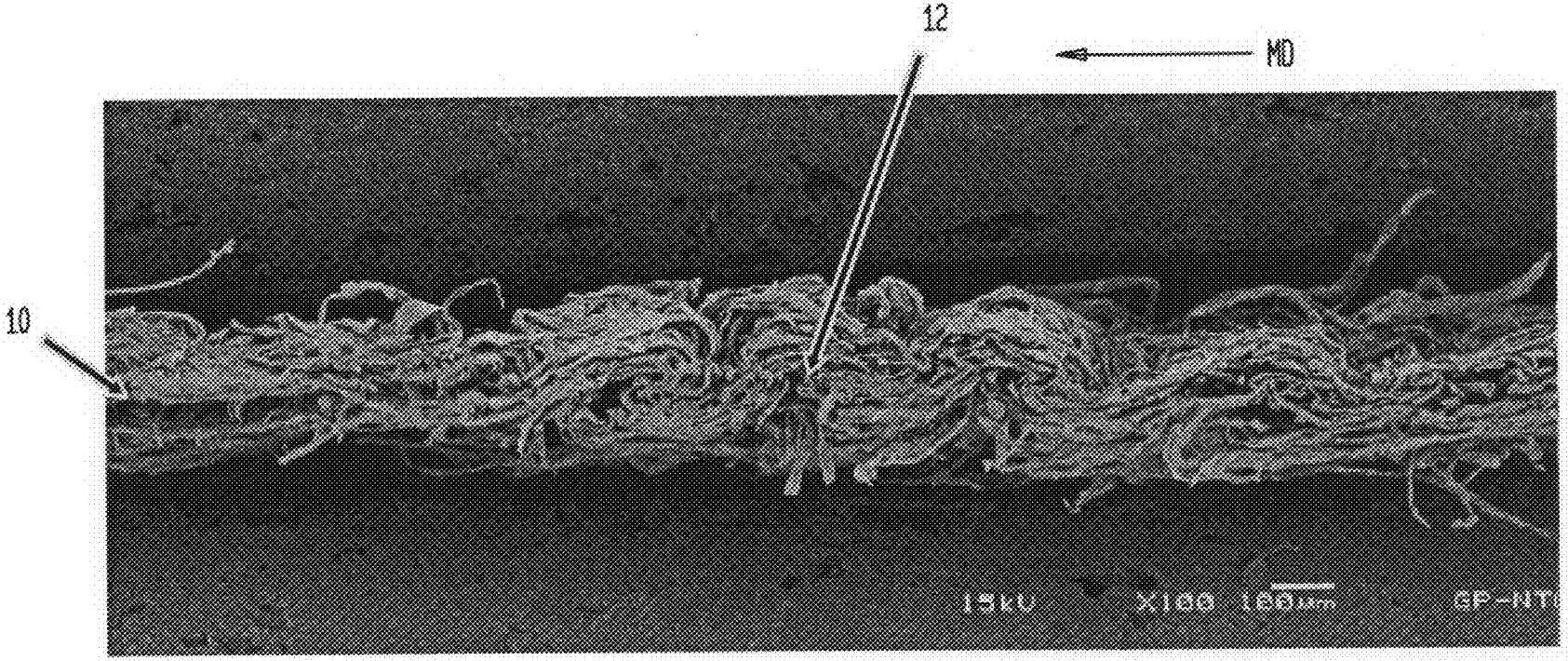
FIG. 15 is a photomicrograph, similar to FIG. 2, showing the structure of the pileated regions of the sheet after the sheet has been drawn in the machine direction.

Further aspects of the invention are appreciated by reference to FIGS. 15 through 30. FIG. 15 is a photomicrograph of a web similar to that shown in FIG. 2 wherein the web has been pulled in the machine direction. Here it is seen that the pileated region 12 has been expanded to a much greater degree of void volume, enhancing the absorbency of the sheet.

Figure 1:
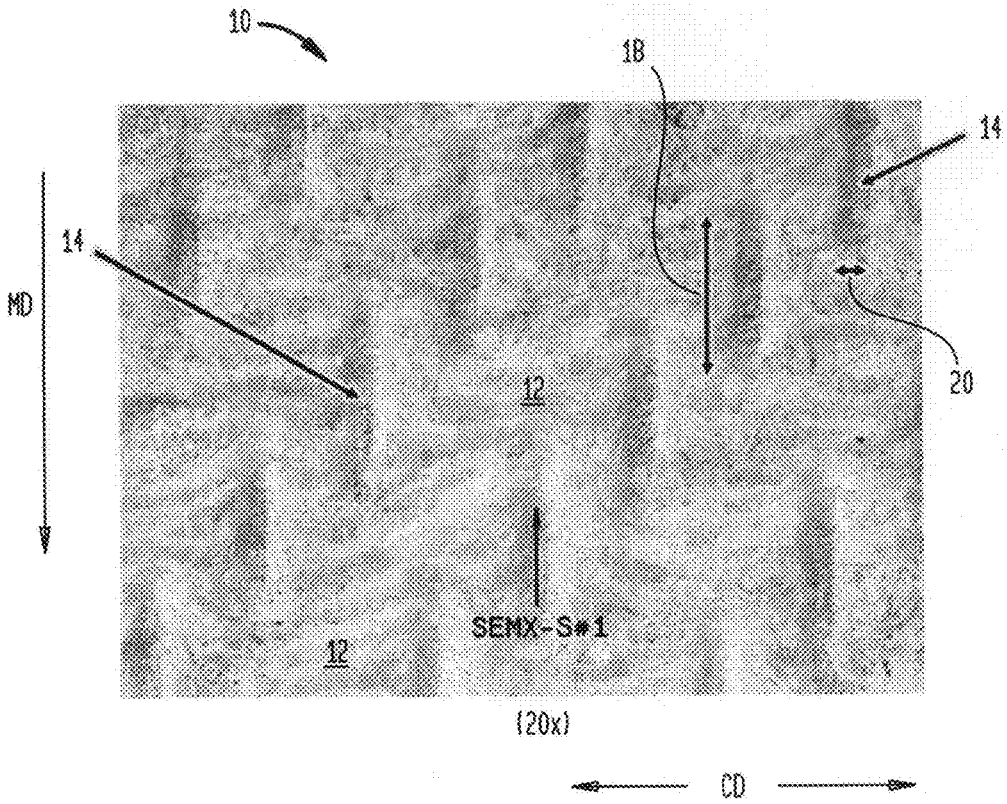
FIG. 1 is a plan view of an absorbent cellulosic sheet of the invention.
Figure 2:
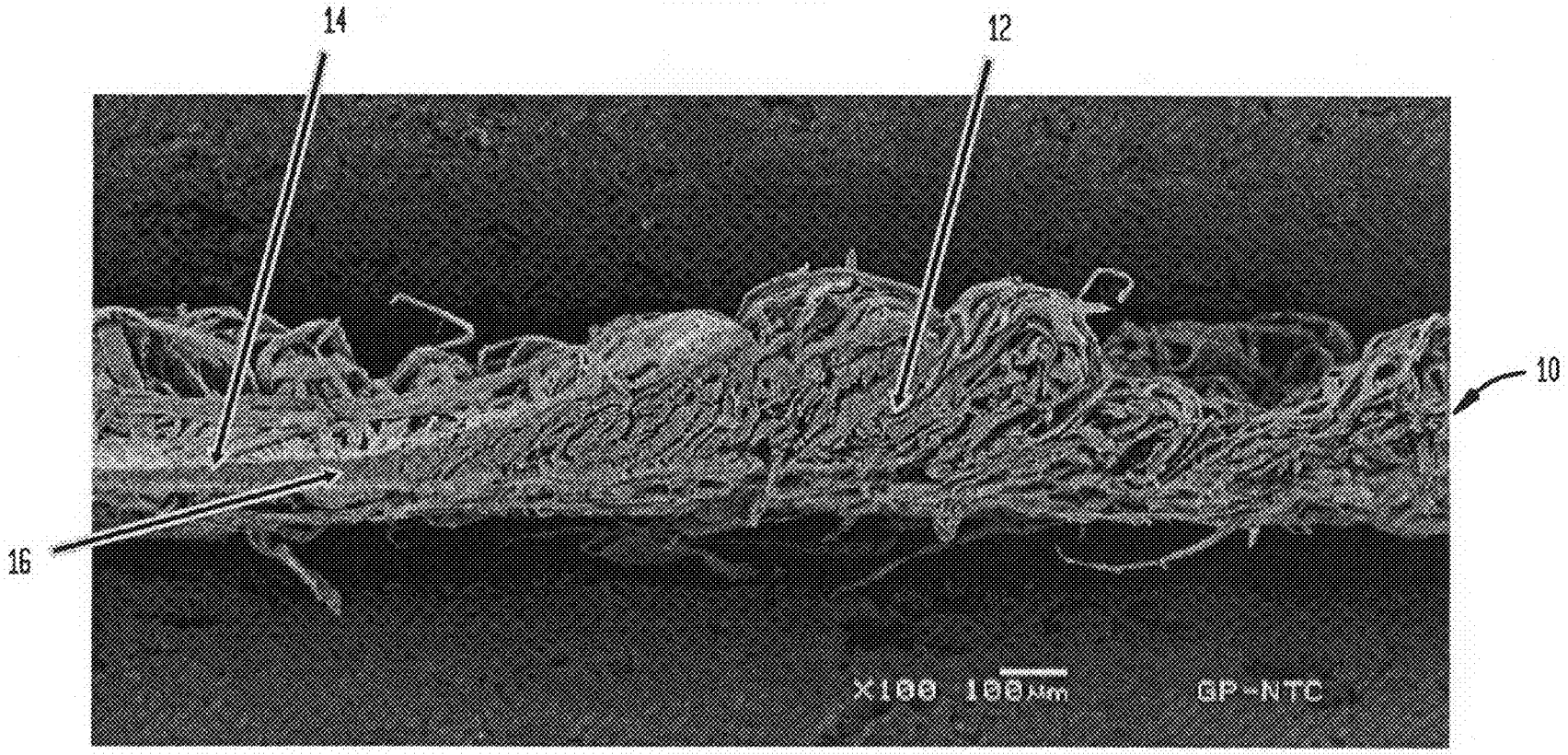
FIG. 2 is an enlarged photomicrograph along line X-S#1 of FIG. 1 showing the microstructure of the inventive sheet.
Figure 16:
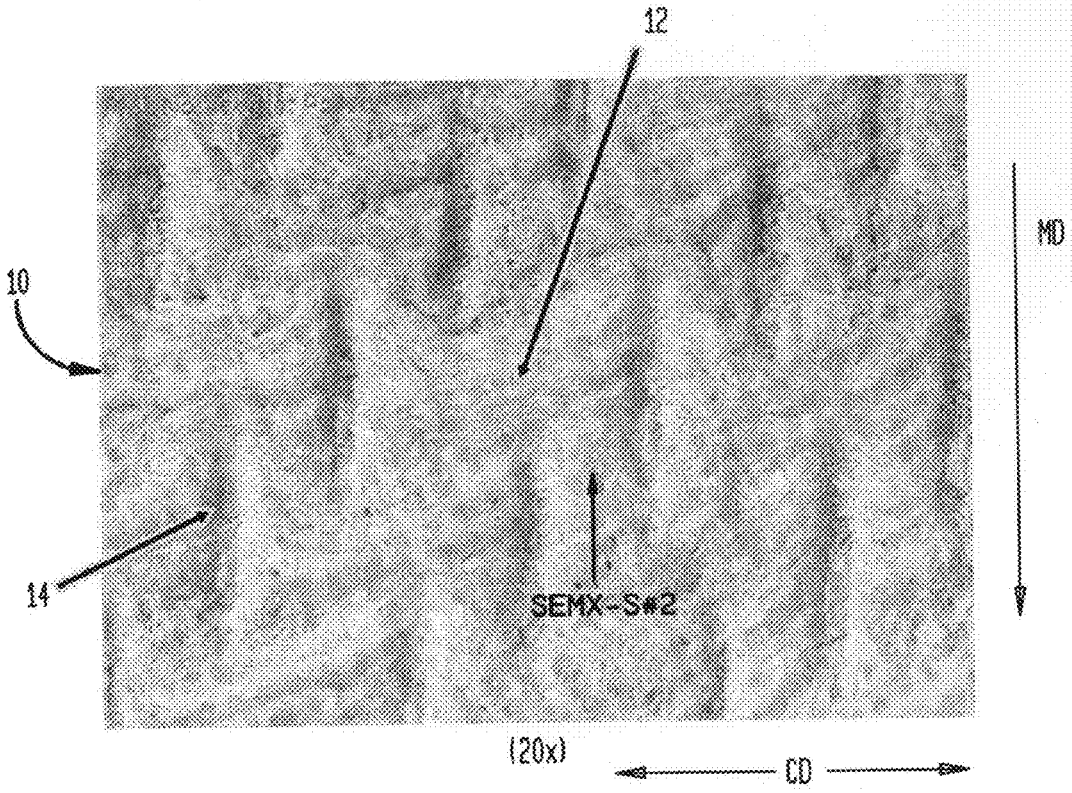
FIG. 16 is a photograph of absorbent cellulosic sheet of the invention, similar to FIG. 1.
Figure 17:
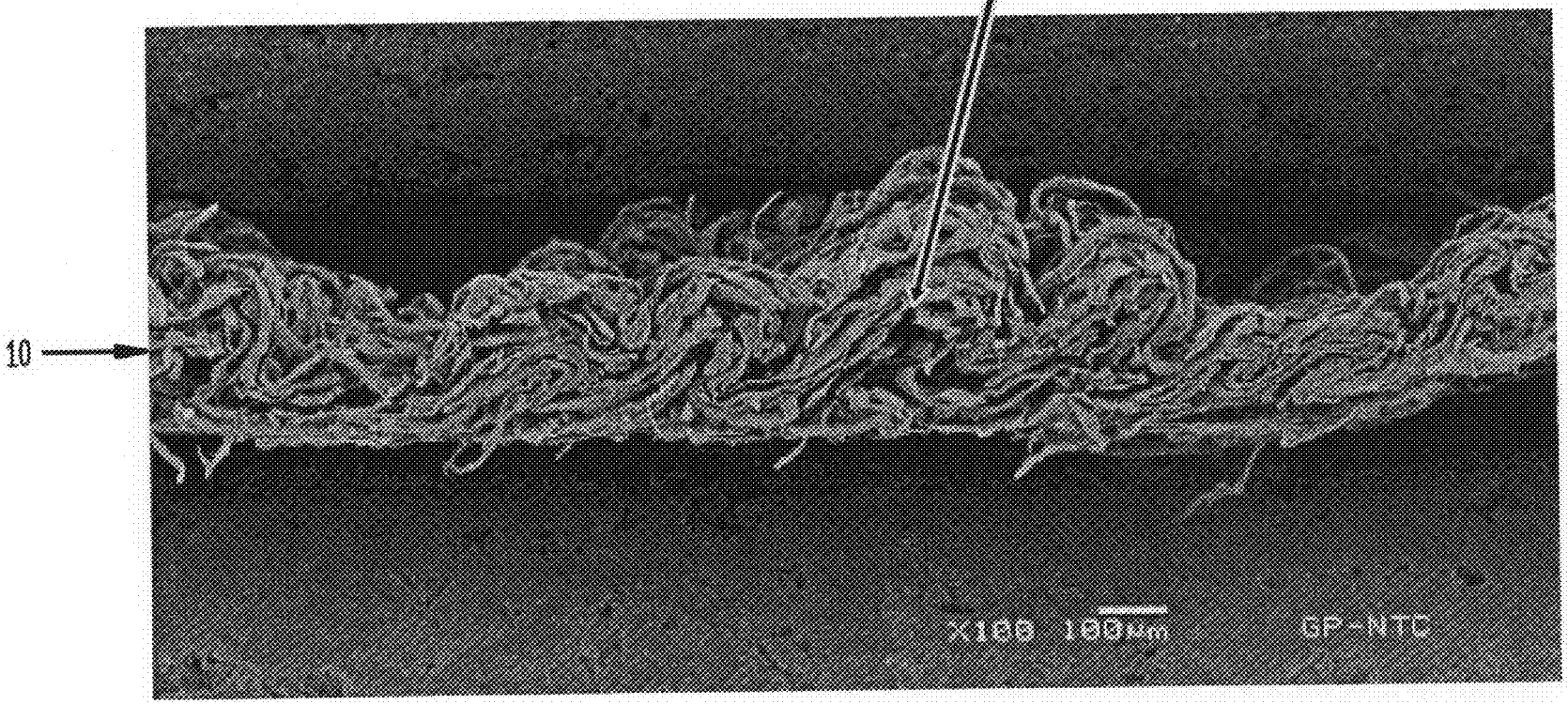
FIG. 17 is a photomicrograph taken along line X-S#2 shown in FIG. 16, wherein it is seen that the fiber-enriched, pileated regions of the sheet have not been densified by the knuckle.

FIG. 16 is a photomicrograph of a base sheet similar to that shown in FIG. 1, indicating the cross section shown in FIG. 17. FIG. 17 is a cross section of a pileated, fiber-enriched region where it is seen that the macrofolds have not been densified by the knuckle. In FIG. 17, it is seen that the sheet is extremely "sided". If it is desired to reduce this sidedness, the web can be transferred to another surface during drying, so that the fabric side of the web (prior to transfer) contacts drying cans thereafter.

Figure 18:
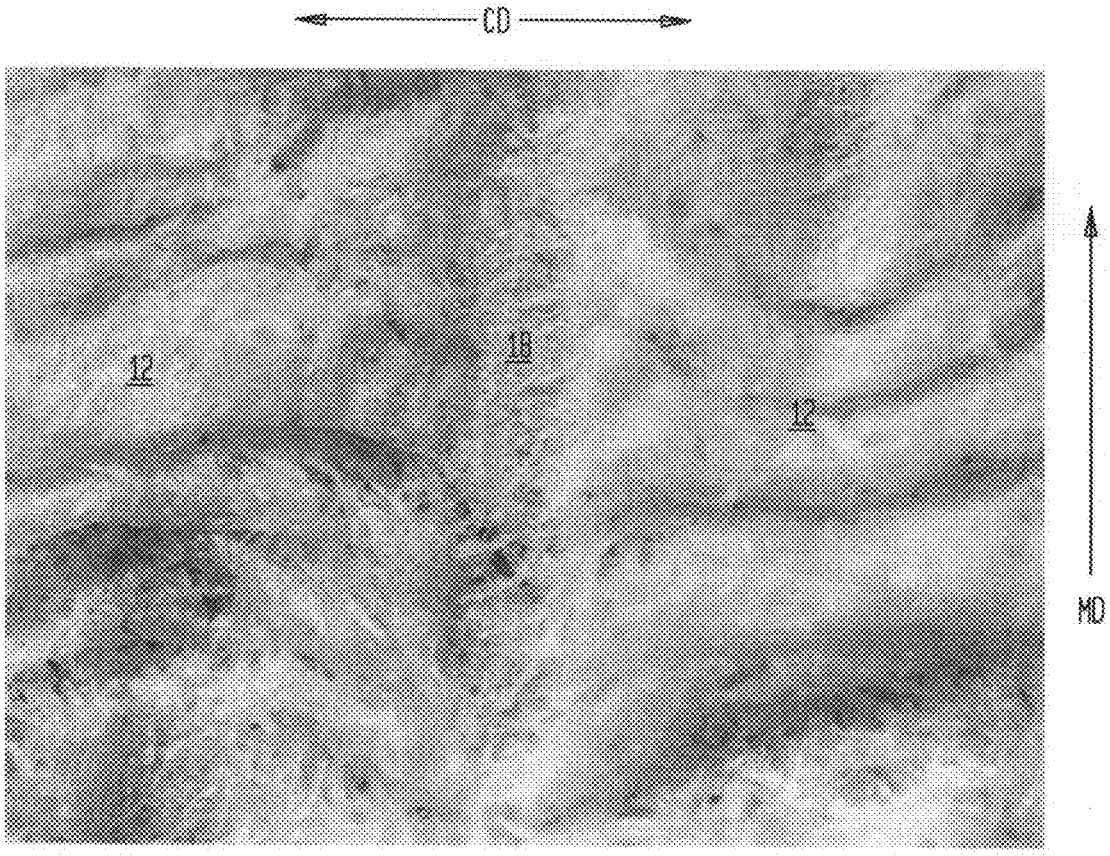
FIG. 18 is an enlarged view showing an MD knuckle impression on a sheet of the present invention.

FIG. 18 is a magnified photomicrograph showing a knuckle impression of an MD knuckle of the creping fabric, wherein it is seen that the fiber of the compressed, MD region, has a CD orientation bias and that the fiber-enriched, pileated regions, have a concamerated structure around the MD extending compressed region.

The local basis weight variation of the sheet is seen in FIGS. 19 and 20. FIGS. 19 and 20 are X-ray negative images of the absorbent sheet of the invention, wherein the light portions represent high basis weight regions and the darker portions represent relatively lower basis weight regions. These images were made by placing sheet samples on plates and exposing the specimens to a 6 kV X-ray source for 1 hour. FIG. 19 is an X-ray image made without suction, while FIG. 20 was made with suction applied to the sheet.

In both FIGS. 19 and 20, it is seen that there are a plurality of dark, MD extending regions of relative low basis weight corresponding to the MD knuckles of the fabric of FIG. 7. Lighter and whiter portions show the fiber-enriched regions of relatively high basis weight. These regions extend in the CD, along the folds seen in FIG. 18, for example.

FIGS. 19 and 20 confirm the local basis weight variation seen in the SEMs and other photomicrographs, especially, the relatively orthogonal relationship between the low basis weight regions and the high basis weight regions.

Note that FIG. 19; with the suction "off" shows a slightly stronger basis weight variation (more prominent light areas) than FIG. 20 suction "on" consistent with FIGS. 22 and 23, discussed below.

Figure 21A:
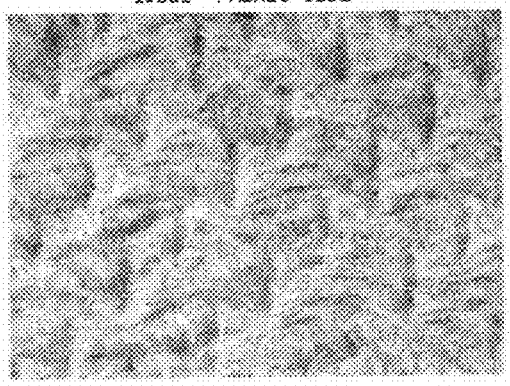
FIG. 21A through FIG. 21D are photomicrographs of various sheets of the invention at different calipers and like basis weights and fabric crepe ratios.
Figure 21B:
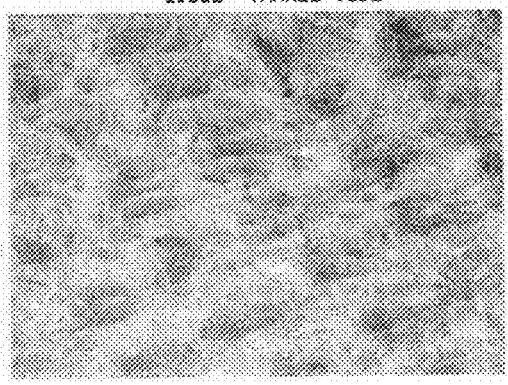
Figure 21C:
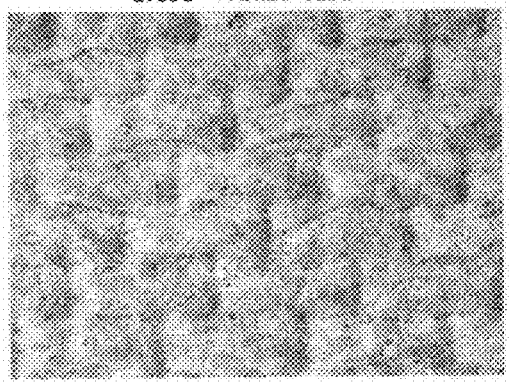
Figure 21D:
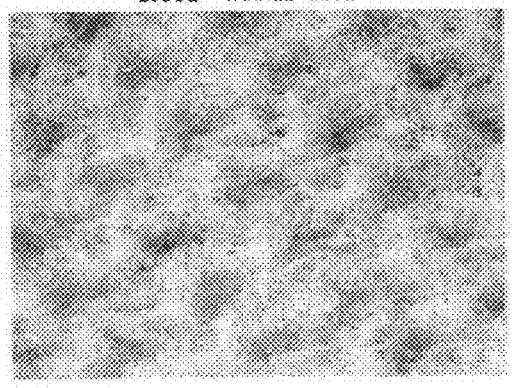

Further product options are seen in FIGS. 21A through 21D. FIGS. 21A and 21B, respectively, are photomicrographs of the fabric side and Yankee side of a 25 pound basis weight sheet at a fabric creped ratio of 1.3. FIGS. 21C and 21D are photomicrographs of another 25 pound basis weight sheet produced at a fabric creped ratio of 1.3. Where suction is indicated on the legends of the Figures, that is, FIGS. 21C, 21D the sheet was suction drawn after fabric creping.

Figure 23:
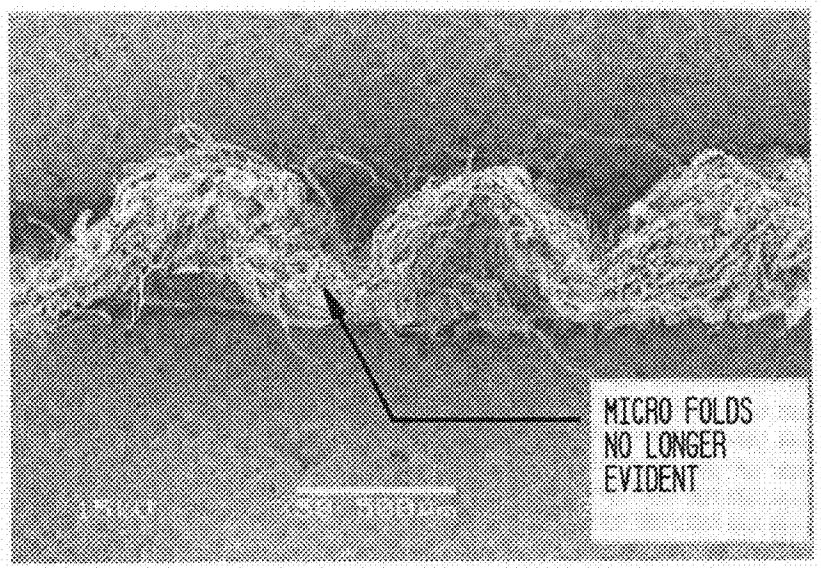
FIG. 22 and FIG. 23 are photomicrographs showing the cross section of an absorbent sheet of the invention along the machine direction.
Figure 22:
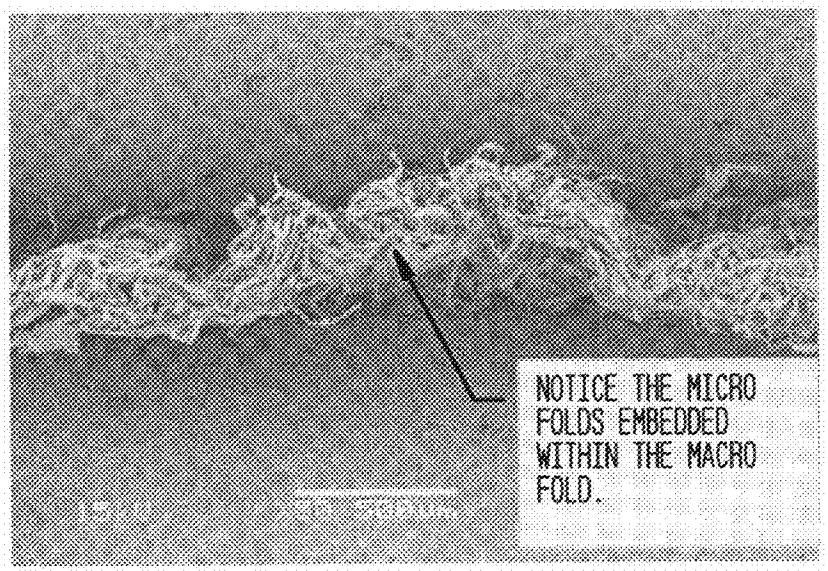
Figure 24:
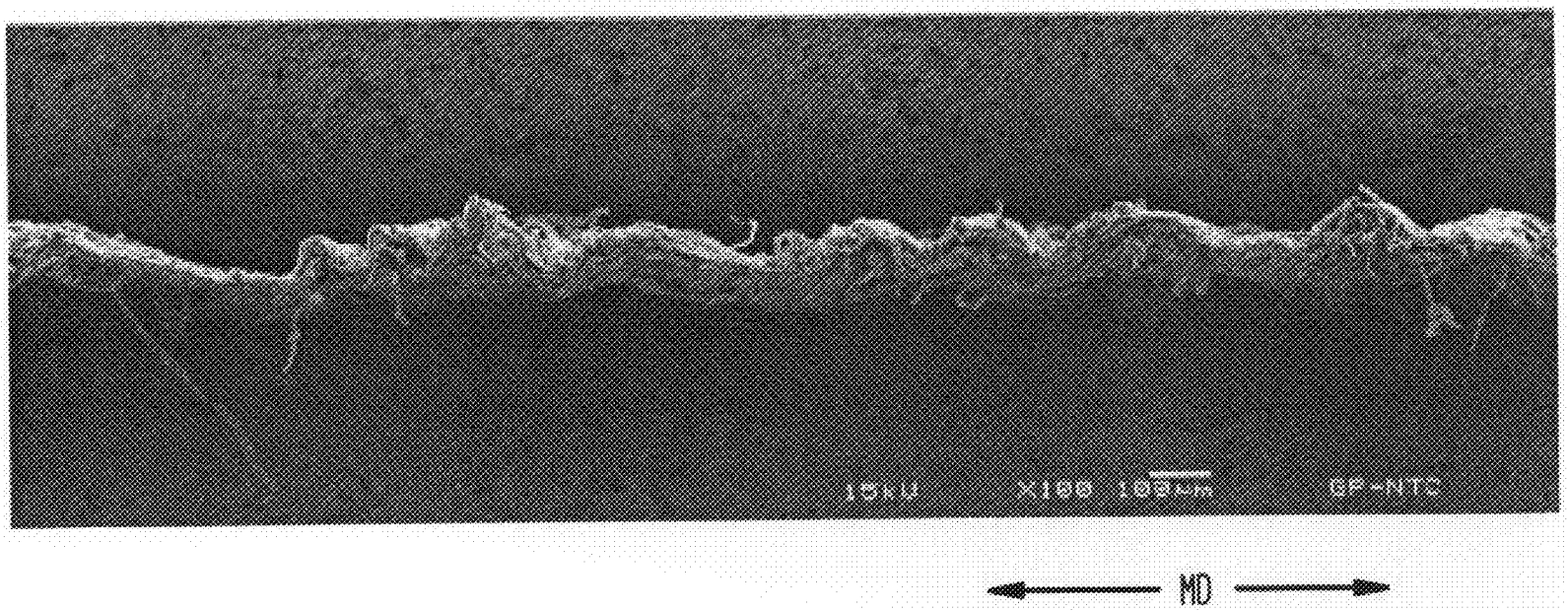
FIG. 24 is a cross-sectional view of an absorbent sheet produced by a CWP process.
Figure 25:
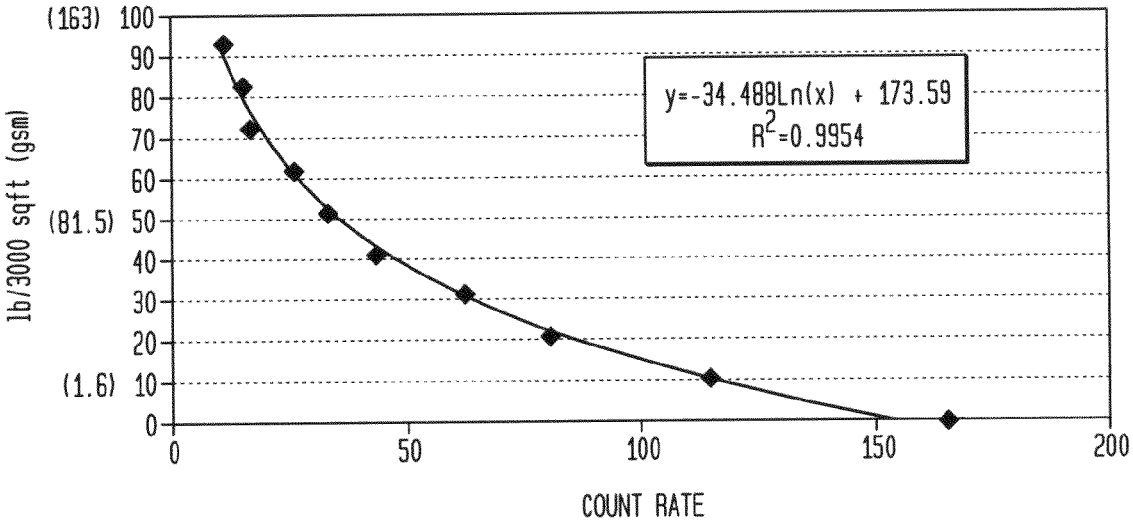
FIG. 25 is a calibration curve for a beta particle attenuation basis weight profiler.
Figure 26:
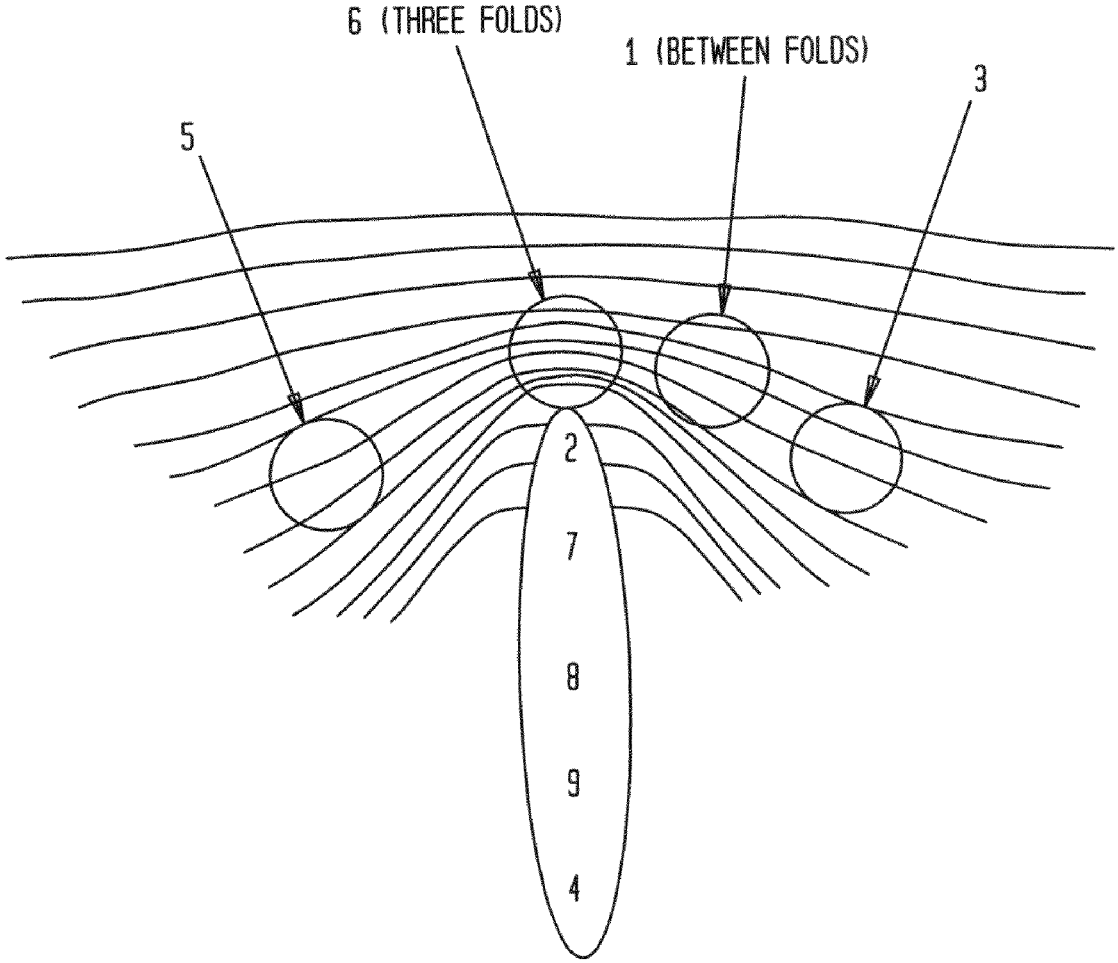
FIG. 26 is a schematic diagram showing the locations of local basis weight measurements on a sheet of the invention.

FIGS. 22 and 23 show the affect of suction when making the inventive sheet. FIG. 22 is a photomicrograph along the MD of a cellulosic sheet produced in accordance with the present invention, Yankee side up produced with no suction. FIG. 23 is a photomicrograph of a cellulosic sheet made in accordance with the invention wherein suction box 66 was turned on. It will be appreciated from these Figures that suction enhances the bulk (and absorbency) of the sheet. In FIG. 22, it is seen that there are micro-folds embedded within the macro-folds of the sheet. In FIG. 23, the micro-folds are no longer evident. For purposes of comparison, there is shown in FIG. 24 a corresponding cross-sectional view along the machine direction of a CWP base sheet. Here, it is seen that the fiber is relatively dense and does not exhibit the enhanced and uniform bulk of products of the invention.

Beta Particle Attenuation Analysis

In order to quantify local basis weight variation, a beta particle attenuation technique was employed.

Beta particles are produced when an unstable nucleus with either too many protons or neutrons spontaneously decays to yield a more stable element. This process can produce either positive or negative particles. When a radioactive element with too many protons undergoes beta decay, a proton is converted into a neutron, emitting a positively charged beta particle or positron ($\beta^+$) and a neutrino. Conversely, a radioactive element with too may neutrons undergoes beta decay by converting a neutron to a proton, emitting a negatively charged beta particle or negatron ($\beta^-$) and an antineutrino. Promethium ($_{61}{}^{147}Pm$) undergoes negative beta decay.

Beta gauging is based on the process of counting the number of beta particles that penetrate the specimen and impinge upon a detector positioned opposite the source over some period of time. The trajectories of beta particles deviate wildly as they interact with matter; some coming to rest within it, others penetrating or being backscattered after partial energy loss and ultimately exiting the solid at a wide range of angles.

Anderson, D. W. (1984). Absorption of Ionizing Radiation, Baltimore, University Park Press, (pp. 69) states that at intermediate transmission values the transmission can be calculated as follows:

$$I=I_0e^{-\beta\rho t}=I_0e^{-\beta w} \quad (1)$$

where:

$I_0$ is the intensity incident on the material $\beta$ is the effective beta mass absorption coefficient in cm2/g t is the thickness in cm $\rho$ is the density in g/cm3 w is the basis weight in g/cm2.

An off-line profiler fitted with an AT-100 radioisotope gauge (Adaptive Technologies, Inc., Fredrick, Md.) containing 1800 microcuries of Promethium was calibrated using a polycarbonate collimator having an aperture of approximately 18 mils diameter. Calibration was carried out by placing the collimator atop the beta particle source and measuring counts for 20 seconds. The operation is repeated with 0, 1, 2, 3, 4, 5, 6, 7, 8 layers of polyethylene terephthalate film having a basis weight of 10.33 lbs/3000 ft2 ream. Results appear in Table 1 and presented graphically in FIG. 25.

TABLE 1

Calibration

| Counts | Weight |
|---|---|
| 165.3 | 0 |
| 114.4 | 10.33 |
| 80.9 | 20.68 |
| 62.3 | 30.97 |
| 43.3 | 41.3 |
| 33 | 51.63 |
| 26.2 | 61.93 |
| 17.1 | 72.28 |
| 15.2 | 82.61 |
| 11 | 92.9 |

The calibrated apparatus was then used to measure local basis weight on a sample of absorbent sheet having generally the structure shown in FIG. 18. Basis weight measurements were taken generally at positions 1-9 indicated schematically in FIG. 26. Results appear in Table 2.

TABLE 2

Local Basis Weight Variation

| Position | Count | Calculated Basis Weight |
|---|---|---|
| 1 | 60 | 32.38424 |
| 2 | 73.8 | 25.24474 |
| 3 | 76.6 | 23.96046 |
| 4 | 71.2 | 26.48168 |
| 5 | 66.3 | 28.94078 |
| 6 | 37.5 | 48.59373 |
| 7 | 55.8 | 34.88706 |
| 8 | 60.4 | 32.15509 |
| 9 | 59.9 | 32.44177 |

It is appreciated from the foregoing that the local basis weight at position 6 (fiber-enriched region) is much higher, by 50% or so than position 2, a low basis weight region. Local basis weight at position 1 between folds was consistently relatively low; however, local basis weights at positions 4 and 7 were sometimes somewhat higher than expected, perhaps due to the presence of folds in the sample occurring during fabric or reel crepe.

Figure 27:
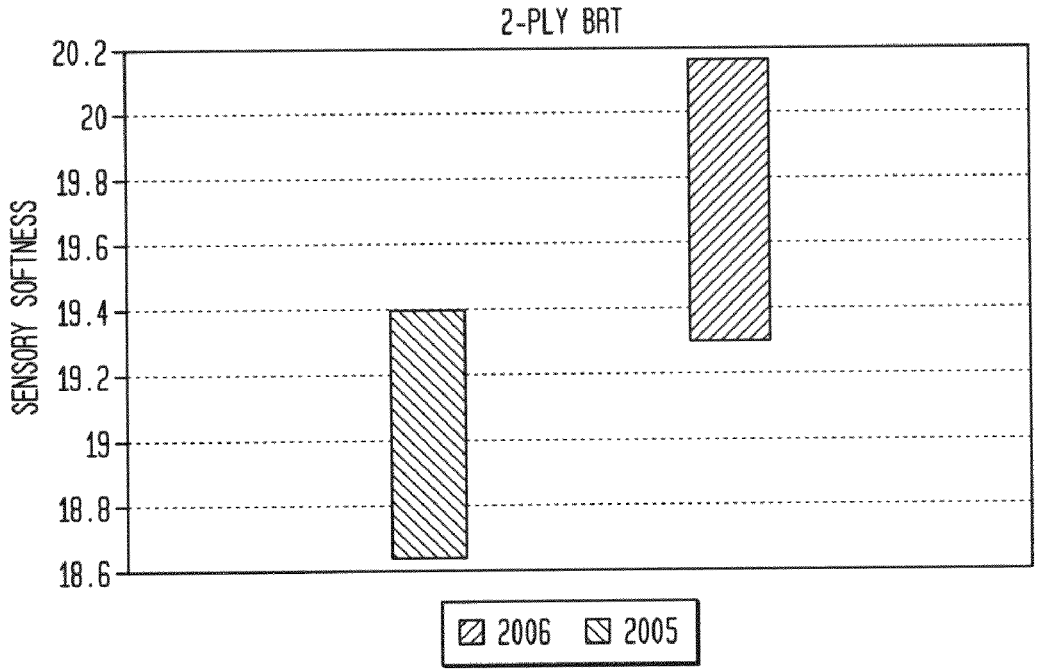
FIG. 27 is a bar graph comparing a panel paired-comparison softness of a sheet creped with a fabric of the class shown in FIGS. 7 and 8, versus softness of an absorbent sheet creped with a single layer fabric.

The inventive products and process for making them are extremely useful in connection with a wide variety of products. For example, there is shown in FIG. 27 a comparison of panel softness for various two-ply bathroom tissue products.

Figure 28:
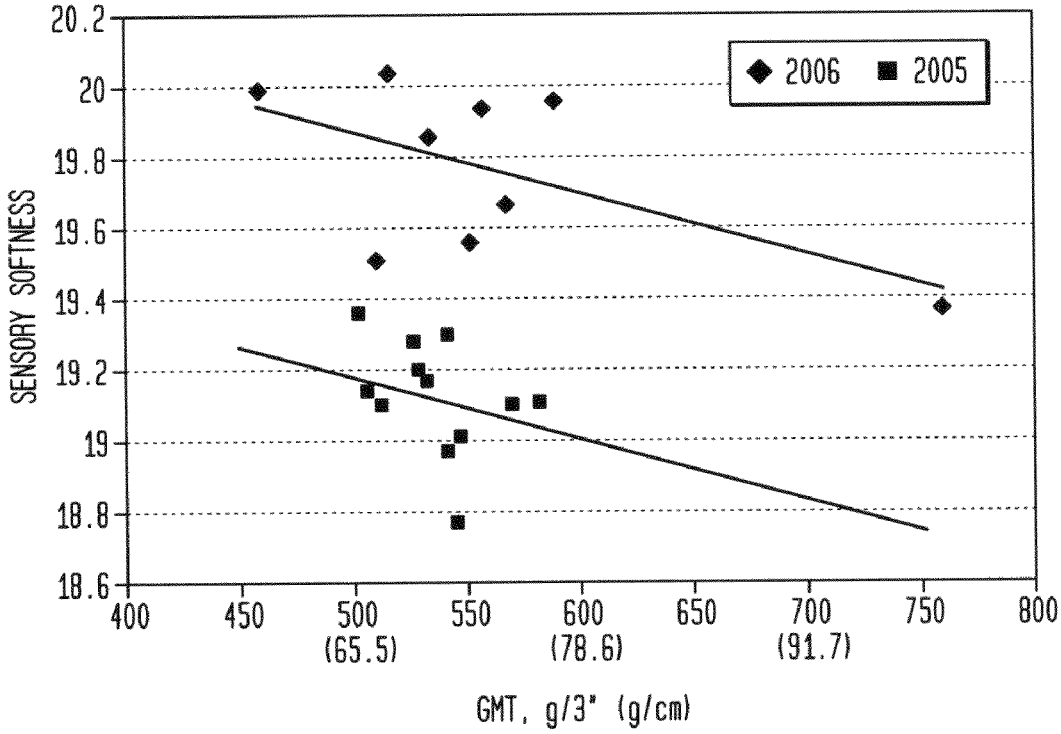
FIG. 28 is a plot of a panel paired-comparison softness versus Geometric Mean (GM) tensile of a sheet creped with a fabric of the class shown in FIGS. 7 and 8, and an absorbent sheet creped with a single layer fabric.

The 2005 product was made with a single layer fabric, while the 2006 product was made with a multi-layer fabric of the invention. Note that the products made with a multi-layer fabric exhibited much enhanced softness at a given tensile. This data is also shown in FIG. 28.

Details as to various tissue products are summarized in Tables 3, 4 and 5. The 44M fabric is a single layer fabric while the W013 fabric is the multilayer fabric discussed in connection with FIG. 7 and following.

TABLE 3

Comparison of Base Sheet and Finished Product Properties

| | 2005 | 2006 |
|---|---|---|
| Fabric | 44M (MD) | W013 (MD) |
| Fiber | 75% euc | 60% euc |
| Forming | Blended | B1. and Lay. |
| Softener | 1152, 2# | 1152, 4# |
| Fabric Crepe | 25 to 35 | 17 to 32 |
| Suction | 12 to 22 | 23 |
| BS Caliper Suction Off | 63 | 90 |
| BS Caliper Suction Max | 79 | 115 |
| FP BW | 27 to 29 | 32 |
| FP Caliper | 133 to 146 | 180 to 200 |
| FP GMT | 500 to 580 | 460 to 760 |
| FP Softness | 18.8 to 19.4 | 19.4 to 20.2 |

TABLE 4

Comparison of Properties (2-ply)

| | 2005 | 2006 |
|---|---|---|
| Fabric | 44M | W013 |
| BS Caliper Suction Off | 63 | 90 |
| BS Caliper Suction Max | 79 | 115 |
| FP BW | 27 to 29 | 32 |
| FP Caliper | 133 to 146 | 180 to 200 |
| FP Softness | 18.8 to 19.4 | 19.4 to 20.2 |

TABLE 5

Comparison of Finished Products and TAD Product

| | 2005 | 2006 | |
|---|---|---|---|
| Fabric | 44M | W013 | TAD Commercial |
| FP GMT | 600 | 600 | 600 |
| FP Softness | 18.9 | 20.1 | 20.2 |
| FP Caliper | 145 | 171 | 151 |
| Sheet Count | 200 | 200 | 200 |
| Roll Diameter | 4.70 | 4.90 | 4.75 |
| Roll Firmness | 17.7 | 9.3 | 17.6 |

TABLE 6

Comparison of Base Sheet and Finished Product Results for 44M/MD and W013 Fabrics

| Cell ID: Base sheet | P2150 | 11031/11032 |
|---|---|---|
| Product Type | QNBT Ultra | QNBT Ultra |
| Furnish | 75/25 Euc/Mar | 60/40 euc/Mar |
| eTAD Fabric/Side Up | 44M/MD | W013 |
| % Fabric Crepe/% Reel Crepe | 25/2 | 31.5/8.5% |
| Suction | 20 | 23.1 |
| Basis Weight (lbs/ream) | 16.42 | 17.60 |
| Caliper (mils/8 sheets) | 79.7 | 121.4 |
| MD Tensile (g/3") | 474 | 569 |
| CD Tensile (g/3") | 231 | 347 |
| GM Tensile (g/3") | 330 | 444 |
| MD Stretch (%) | 28.8 | 51.5 |
| CD Stretch (%) | 7.9 | 9.6 |
| CD Wet Tensile-Finch (g/3") | 27 | 0 |
| GM Break Modulus (g/%) | 21.9 | 20.0 |
| Base sheet Bulk in mils/8 plies/lb/R | 4.85 | 6.90 |
| emboss pattern | HVS9 | high elements double hearts |
| rubber backup roll | 55 Shore A | 90 P&J |
| sheet count | 176 | 198 |
| Basis Weight (lbs/ream) | 30.6 | 29.5 |

TABLE 6-continued

| Comparison of Base Sheet and Finished Product Results for 44M/MD and W013 Fabrics | | |
|---|---|---|
| Cell ID: Base sheet | P2150 | 11031/11032 |
| Caliper (mils/8 sheets) | 150.2 | 170.8 |
| MD Dry Tensile (g/3") | 478 | 695 |
| CD Dry Tensile (g/3") | 297 | 451 |
| Geometric Mean Tensile (g/3") | 376 | 559 |
| MD Stretch (%) | 12.0 | 28.7 |
| CD Stretch (%) | 7.2 | 9.1 |
| Perforation Tensile (g/3") | 258 | 393 |
| CD Wet Tensile (g/3") | 42.2 | 10 |
| GM Break Modulus (g/%) | 40.5 | 35.0 |
| Friction (GMMMD) | 0.546 | 0.586 |
| Roll Diameter (inches) | 4.67 | 4.91 |
| Roll Compression (%) | 23.7 | 9.3 |
| Sensory Softness | 19.61 | 20.2 |
| finished product Bulk in mils/8 plies/lb/R | 4.91 | 5.78 |

It is appreciated from Tables 3 through 5 that the process and products of the invention made with the multilayer fabric provide much more caliper at a given basis weight as well as enhanced softness.

Table 6 above likewise shows that tissue products of the invention, those made with the W0-13 fabric, exhibit much more softness with even much higher tensile, a very surprising result, given the conventional wisdom that softness decreases rapidly with increasing tensile.

The present invention also provides a unique combination of properties for making single ply towel and makes it possible to use elevated amounts of recycled fiber without negatively affecting product performance or hand feel. In this connection, furnish blends containing recycle fiber were evaluated. Results are summarized in Tables 7, 8 and 9.

TABLE 7

| Process Data | | | | | | | | |
|---|---|---|---|---|---|---|---|---|
| ID | Fabric | Yankee (fpm) | Sm Yank (fpm) | Reel (fpm) | Cal. (fpm) | Fabric Crp. (%) | Reel Crp. (%) | Calender (psi) |
| Cell 1 | W013 | 1,545 | 1,855 | 1,544 | 1,505 | 20 | 0 | 23 |
| Cell 2 | W013 | 1,545 | 1,855 | 1,544 | 1,505 | 20 | 0 | 20 |
| Cell 2A | W013 | 1,545 | 1,901 | 1,545 | 1,505 | 23 | 0 | 26 |
| Cell 3 | W013 | 1,545 | 1,901 | 1,545 | 1,505 | 23 | 0 | 17 |
| Cell 4 | W013 | 1,545 | 1,947 | 1,545 | 1,505 | 26 | 0 | 21 |

| | | | CHEMICAL ADD. | | FURNISH | |
|---|---|---|---|---|---|---|
| ID | Suction (ins. Hg) | Refining (hp) | Parez (lbs./ton) | WSR (lbs./ton) | Recycle (%) | Douglas Fir (%) |
| Cell 1 | 23 | None | 6 | 12 | 25 | 75 |
| Cell 2 | 23 | None | 1 | 10 | 50 | 50 |
| Cell 2A | 23 | None | 3 | 10 | 50 | 50 |
| Cell 3 | 23 | None | 0 | 10 | 75 | 25 |
| Cell 4 | 23 | None | 0 | 10 | 100 | 0 |

TABLE 8

| BASE SHEET DATA | | | | | | | | | | | |
|---|---|---|---|---|---|---|---|---|---|---|---|
| ID | BW (lbs./ream) | Unc. Cal. (mils/8 ply) | Cal. Cal. (mils/8 ply) | MDS (%) | MD DRY (g/3") | CD DRY (g/3") | GMT | Total (g/3") | MD/CD Ratio | WET CD (g/3") | WAR (secs) |
| SofPull | 21.3 | | 78.0 | 23.0 | 2,750 | 1,900 | 2,286 | 4,650 | 1.4 | 450 | 5.0 |
| Targets (mins/max) | (20.6/22) | | (72/84) | (18/28) | (2300/3200) | (1450/2550) | | | | (min 325) | (max 15) |
| Cell 1 | 21.1 | 95 | 77 | 24.4 | 2,468 | 1,908 | 2,170 | 4,376 | 1.3 | 445 | 4 |
| Cell 2 | 21.2 | 84 | 78 | 24.1 | 2,669 | 1,924 | 2,266 | 4,593 | 1.4 | 426 | 6 |
| Cell 2A | 20.6 | 95 | 76 | 25.5 | 2,254 | 1,761 | 1,992 | 4,015 | 1.3 | 385 | 5 |
| Cell 3 | 21.4 | 88 | 79 | 26.2 | 2,867 | 1,793 | 2,267 | 4,660 | 1.6 | 462 | 5 |
| Cell 4 | 21.4 | 88 | 76 | 27.6 | 2,787 | 1,974 | 2,346 | 4,761 | 1.4 | 505 | 5 |

TABLE 9

| Recycled Content Furnish Trial (Finished Product Test Data) | | | | | | | | | | |
|---|---|---|---|---|---|---|---|---|---|---|
| | | Single layer | | | | | | Product Targets | | |
| Identification | TAD | Creping Fabric | Cell 1 | Cell 2 | Cell 2A | Cell 3 | Cell 4 | Target | Minimum | Maximum |
| Furnish (Softwood/ Secondary) | 100/0 | 80/20 | 75/25 | 50/50 | 50/50 | 25/75 | 0/100 | | | |
| FC/RC Parameter | NA | 20/0 | 20/0 | 20/0 | 23/0 | 23/0 | 26/0 | | | |

TABLE 9-continued

| Recycled Content Furnish Trial (Finished Product Test Data) | | | | | | | | | | |
|---|---|---|---|---|---|---|---|---|---|---|
| | | Single layer | | | | | | Product Targets | | |
| Identification | TAD | Creping Fabric | Cell 1 | Cell 2 | Cell 2A | Cell 3 | Cell 4 | Target | Minimum | Maximum |
| Basis Weight (lbs/rm) | 22.6 | 21.3 | 21.2 | 21.4 | 20.8 | 21.5 | 21.3 | 21.0 | 20.0 | 22.0 |
| Caliper (mils/8 sheets) | 67 | 68 | 68 | 64 | 63 | 67 | 63 | 70 | 62 | 78 |
| Dry MD Tensile (g/3") | 2,810 | 2,868 | 2,734 | 2,916 | 2,574 | 3,179 | 3,057 | 2,800 | 2,000 | 3,600 |
| Dry CD Tensile (g/3") | 2,074 | 1,785 | 1,927 | 1,973 | 1,791 | 1,993 | 2,095 | 1,950 | 1,350 | 2,550 |
| MD/CD Ratio | 1.4 | 1.6 | 1.4 | 1.5 | 1.4 | 1.6 | 1.5 | 1.5 | 0.8 | 2.2 |
| Total Tensile (g/3") | 4,884 | 4,653 | 4,661 | 4,889 | 4,365 | 5,172 | 5,152 | 4,750 | — | — |
| MD Stretch (%) | 23.2 | 23.1 | 21.5 | 21.0 | 23.0 | 23.2 | 24.8 | 22 | 18 | 26 |
| CD Stretch (%) | 4.7 | 5.0 | 7.4 | 7.0 | 7.3 | 7.3 | 7.3 | — | — | — |
| Wet MD Tensile (Finch) (g/3") | 754 | 802 | 694 | 799 | 697 | 854 | 989 | — | — | — |
| Wet CD Tensile (Finch) (g/3") | 485 | 543 | 467 | 481 | 429 | 513 | 583 | 425 | 300 | 800 |
| CD Wet/Dry Ratio (%) | 23 | 30 | 24 | 24 | 24 | 26 | 28 | 22 | — | — |
| WAR (seconds) | 5 | 9 | 4 | 6 | 5 | 6 | 8 | 5 | 0 | 15 |
| MacBeth 3100 Brightness (%) UV Ex. | 79.4 | 78.7 | 82.9 | 83.4 | 83.4 | 83.7 | 83.9 | 78 | 76 | — |
| MacBeth 3100 Opacity (%) | 62 | 58 | 59 | 61 | 60 | 61 | 63 | — | — | — |
| SAT Capacity (g/m^2) | 192 | 205 | 201 | 172 | 172 | 165 | 181 | — | — | — |
| GM Break Modulus (g/% Stretch) | 232 | 209 | 183 | 199 | 166 | 194 | 189 | — | — | — |
| Roll Diameter (inches) | 9.09 | 9.11 | 7.09 | 7.06 | 6.82 | 6.98 | 6.82 | 7.00 | 6.75 | 7.25 |
| Roll Compression (%) | 1.6 | 0.4 | 2.3 | 2.1 | 2.4 | 2.0 | 2.1 | 2.0 | 0 | 4.0 |
| Hand Panel | — | 4.59 | 4.54 | 4.12 | 4.39 | 3.87 | 3.43 | — | — | — |
| Hand Panel Sig. Diff. | — | A | A | B, C | A, B | C | D | — | — | — |

Figure 29:
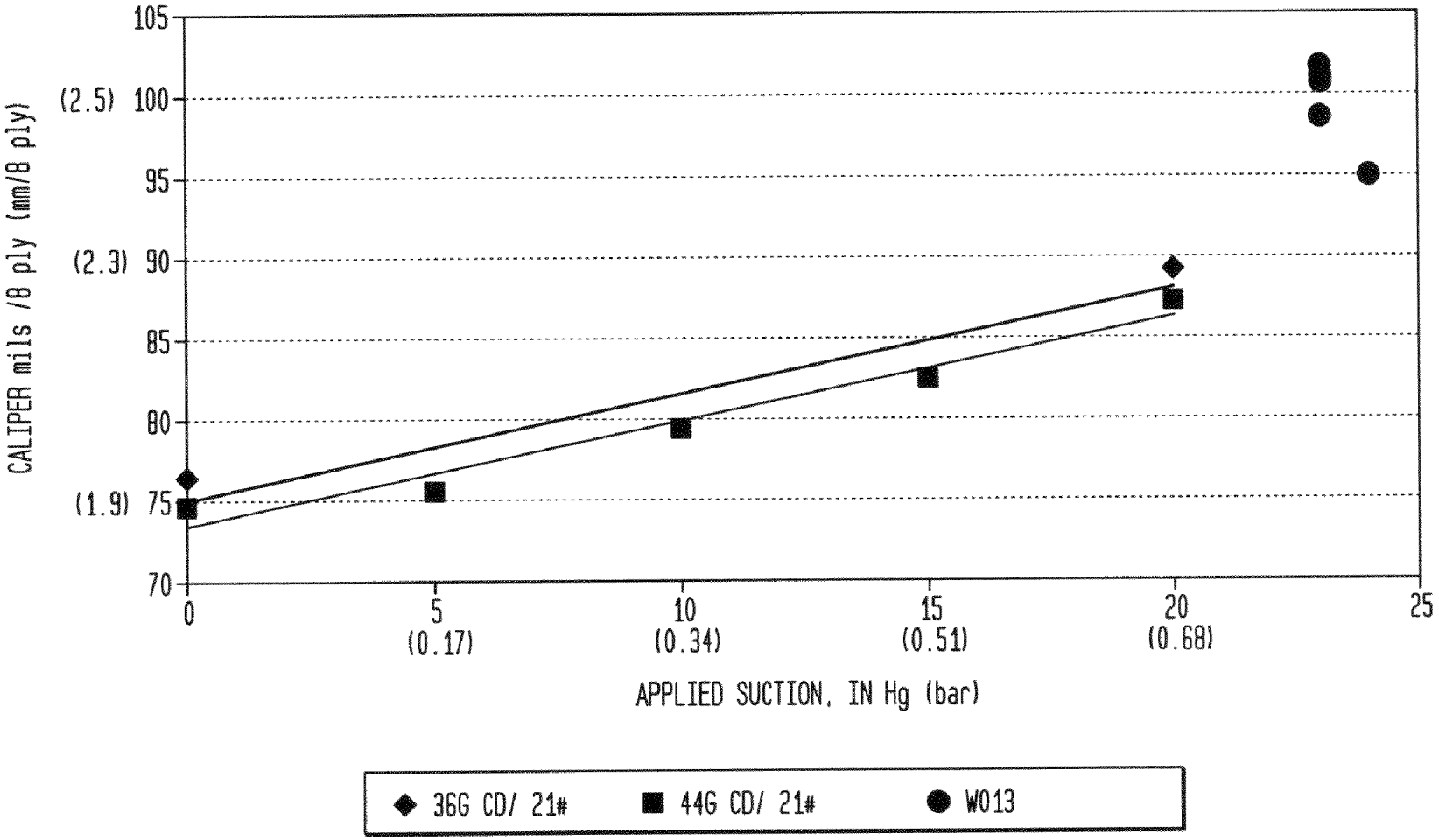
FIG. 29 is a plot of caliper versus suction for an absorbent sheet made with single layer fabrics and an absorbent sheet made with a multi-layer fabric of the class shown in FIGS. 7 and 8.
Figure 30A:
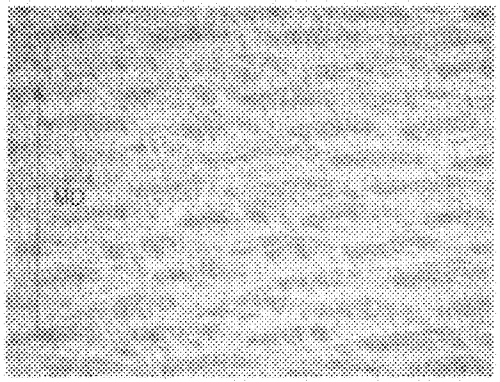
FIGS. 30A through 30F are photomicrographs of fabric creped sheets.
Figure 30B:
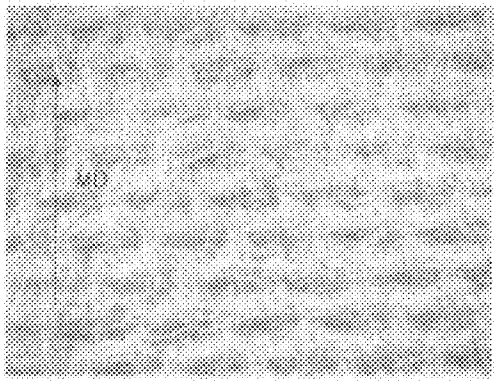
Figure 30C:
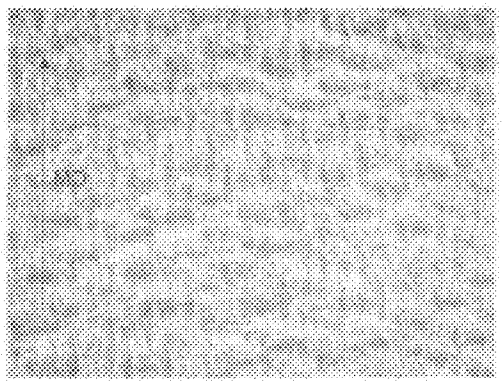
Figure 30D:
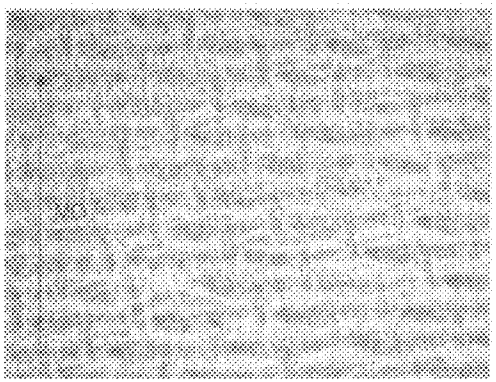
Figure 30E:
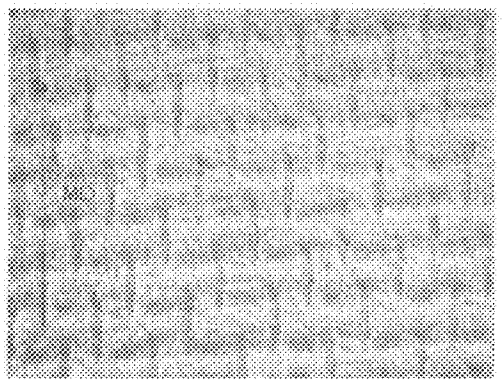
Figure 30F:
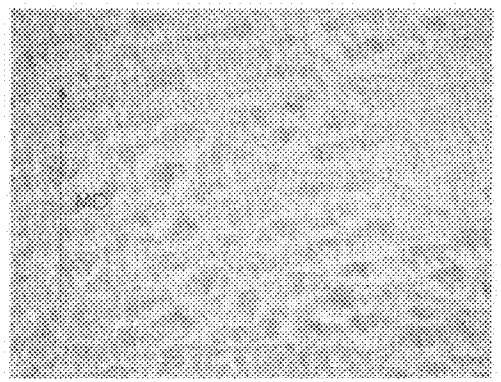
Figure 31:
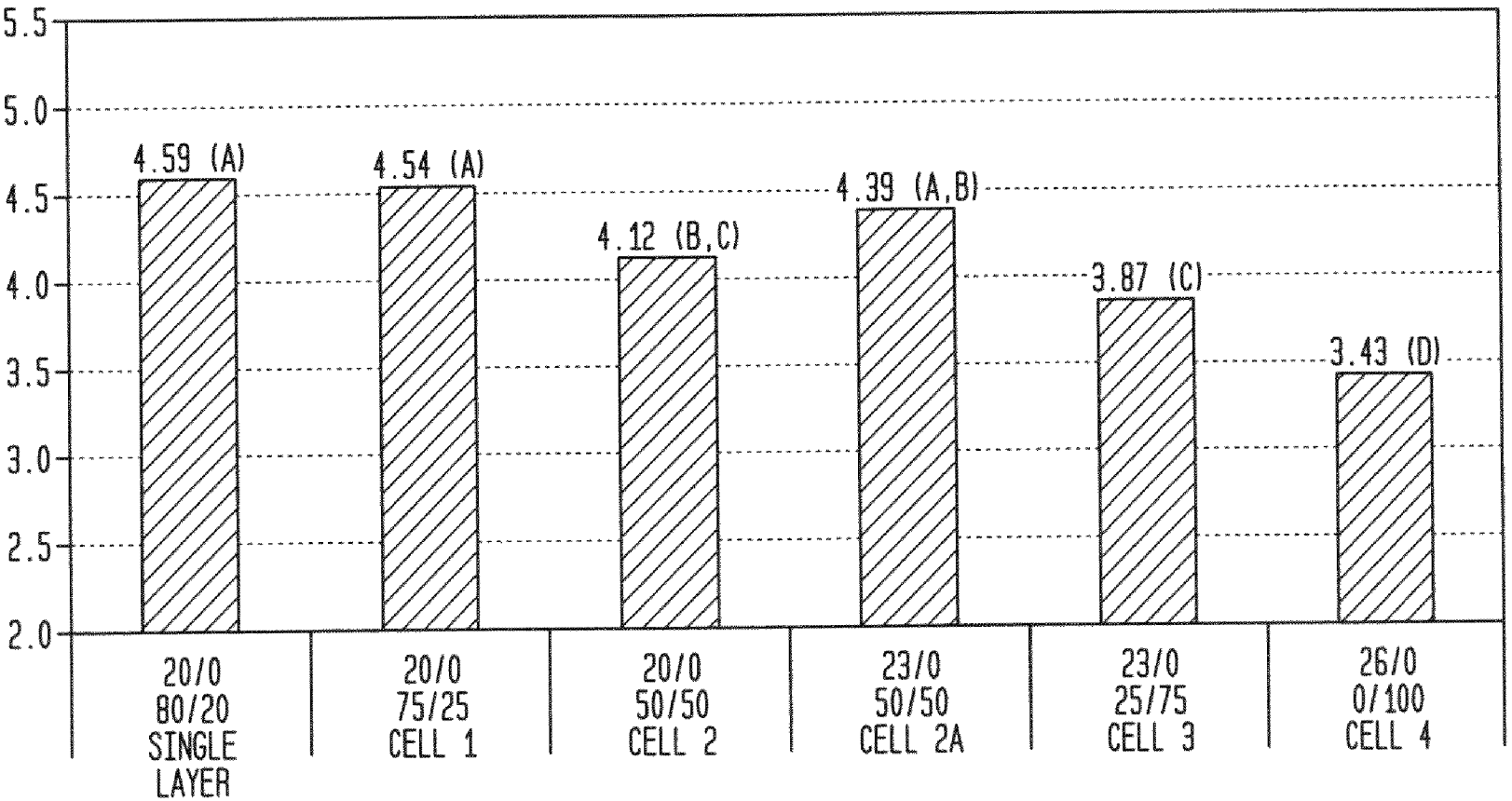
FIG. 31 is a bar graph illustrating a panel paired-comparison of softness of various products of the present invention.

The dramatic increase in caliper is seen in FIG. 29, which illustrates that the base sheets produced with the multi-layer fabric exhibited elevated caliper with respect to base sheets produced with single layer creping fabrics. The surprising bulk is readily apparent when comparing the products to TAD products or products made with a singe layer fabric. In FIGS. 30A through 30F, there are shown various base sheets. FIGS. 30A and 30D are respectively, photomicrographs of a Yankee side and a fabric side of a base sheet produced with a single layer fabric produced in accordance with the process described above in connection with FIG. 5. FIGS. 30B and 30E are photomicrographs of the Yankee side and fabric side of a base sheet produced with a double layer creping fabric in accordance with the invention utilizing the process described generally in connection with FIG. 5 above. FIGS. 30C and 30F are photomicrographs of the Yankee side and fabric side of a base sheet prepared by a conventional TAD process. It is appreciated from the photomicrographs of FIGS. 30B and 30E that the base sheet of the invention produced with a double layer fabric produces a higher loft than the other material, shown in FIGS. 30A, 30D, 30C and 30F. This observation is consistent with FIG. 31 which shows the relative softness of the products of FIG. 30A and FIG. 30D (single layer fabric) and other products made with increasing levels of recycled fiber in accordance with the invention. It is seen from FIG. 31 that it is possible to produce towel base sheet with equivalent softness while using up to 50% recycled fiber. This is a significant advance in as much as towel can be produced without utilizing expensive virgin Douglas fir furnish, for example.

The products and process of the present invention are thus likewise suitable for use in connection with touchless automated towel dispensers of the class described in co-pending U.S. Provisional Application No. 60/779,614, filed Mar. 6, 2006, and U.S. Provisional Patent Application No. 60/693,699, filed Jun. 24, 2005, the disclosures of which are incorporated herein by reference. In this connection, the base sheet is suitably produced on a paper machine of the class shown in FIG. 32.

Figure 32:
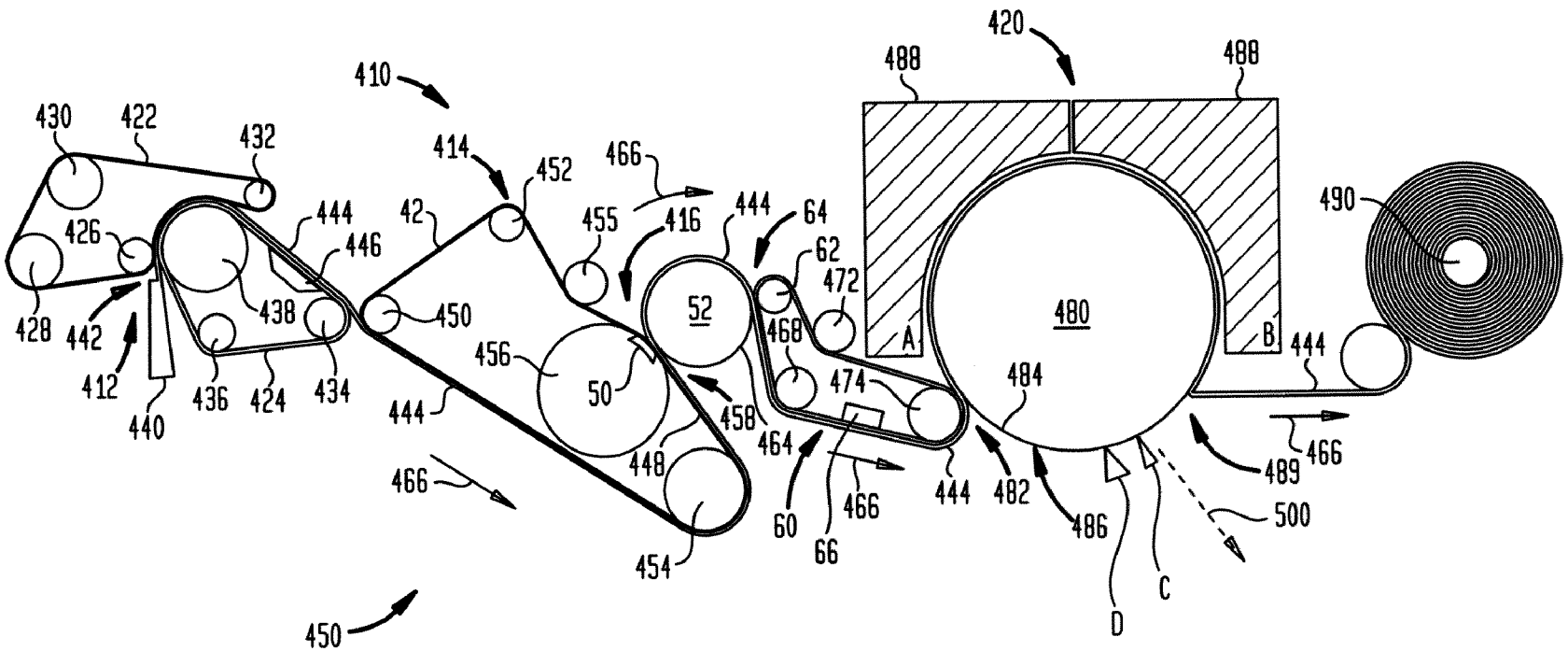
FIG. 32 is a schematic diagram of yet another paper machine useful for practicing the present invention.

FIG. 32 is a schematic diagram of a papermachine 410 having a conventional twin wire forming section 412, a felt run 414, a shoe press section 416, a creping fabric 60, and a Yankee dryer 420 suitable for practicing the present invention. Forming section 412 includes a pair of forming fabrics 422, 424 supported by a plurality of rolls 426, 428, 430, 432, 434, 436 and a forming roll 438. A headbox 440 provides papermaking furnish issuing therefrom as a jet in the machine direction to a nip 442 between forming roll 438 and roll 426 and the fabrics. The furnish forms a nascent web 444, which is dewatered on the fabrics with the assistance of suction, for example, by way of suction box 446.

The nascent web is advanced to a papermaking felt 42 which is supported by a plurality of rolls 450, 452, 454, 455, and the felt is in contact with a shoe press roll 456. The web is of a low consistency as it is transferred to the felt. Transfer may be assisted by suction, for example, roll 450 may be a suction roll if so desired or a pickup or suction shoe as is known in the art. As the web reaches the shoe press roll, it may have a consistency of 10-25%, preferably 20 to 25% or so as it enters nip 458 between shoe press roll 456 and transfer roll 52. Transfer roll 52 may be a heated roll if so desired. It has been found that increasing steam pressure to roll 52 helps lengthen the time between required stripping of excess adhesive from the cylinder of Yankee dryer 420. Suitable steam pressure may be about 95 psig or so, bearing in mind that roll 52 is a crowned roll and roll 62 has a negative crown to match such that the contact area between the rolls is influenced by the pressure in roll 52. Thus, care must be exercised to maintain matching contact between rolls 52, 62 when elevated pressure is employed.

Instead of a shoe press roll, roll 456 could be a conventional suction pressure roll. If a shoe press is employed, it is desirable and preferred that roll 454 is a suction roll effective to remove water from the felt prior to the felt entering the shoe press nip since water from the furnish will be pressed into the felt in the shoe press nip. In any case, using a suction roll at 454 is typically desirable to ensure the web remains in contact with the felt during the direction change as one of skill in the art will appreciate from the diagram.

Web 444 is wet-pressed on the felt in nip 458 with the assistance of pressure shoe 50. The web is thus compactively dewatered at 458, typically, by increasing the consistency by fifteen or more points at this stage of the process. The configuration shown at 458 is generally termed a shoe press; in connection with the present invention, cylinder 52 is operative as a transfer cylinder, which operates to convey web 444 at high speed, typically, 1000 fpm-6000 fpm, to the creping fabric.

Cylinder 52 has a smooth surface 464, which may be provided with adhesive (the same as the creping adhesive used on the Yankee cylinder) and/or release agents, if needed. Web 444 is adhered to transfer surface 464 of cylinder 52, which is rotating at a high angular velocity as the web continues to advance in the machine-direction indicated by arrows 466. On the cylinder, web 444 has a generally random apparent distribution of fiber orientation.

Direction 466 is referred to as the machine-direction (MD) of the web as well as that of papermachine 410; whereas the cross-machine-direction (CD) is the direction in the plane of the web perpendicular to the MD.

Web 444 enters nip 458, typically, at consistencies of 10-25% or so, and is dewatered and dried to consistencies of from about 25 to about 70 by the time it is transferred to creping fabric 60 as shown in the diagram.

Fabric 60 is supported on a plurality of rolls 468, 472 and a press nip roll 474 and forms a fabric crepe nip 64 with transfer cylinder 52 as shown.

The creping fabric defines a creping nip over the distance in which creping fabric 60 is adapted to contact roll 52; that is, applies significant pressure to the web against the transfer cylinder. To this end, creping roll 62 may be provided with a soft deformable surface which will increase the width of the creping nip and increase the fabric creping angle between the fabric and the sheet and the point of contact or a shoe press roll could be used as roll 62 to increase effective contact with the web in high impact fabric creping nip 64 where web 444 is transferred to fabric 60 and advanced in the machine-direction.

Creping nip 64 generally extends over a fabric creping nip distance or width of anywhere from about ⅛" to about 2", typically ½" to 2". For a creping fabric with 32 CD strands per inch, web 444 thus will encounter anywhere from about 4 to 64 weft filaments in the nip.

The nip pressure in nip 64, that is, the loading between creping roll 62 and transfer roll 52 is suitably 20-200, preferably 40-70 pounds per linear inch (PLI).

After fabric creping, the web continues to advance along MD 466 where it is wet-pressed onto Yankee cylinder 480 in transfer nip 482. Optionally, suction is applied to the web by way of a suction box 66.

Transfer at nip 482 occurs at a web consistency of generally from about 25 to about 70%. At these consistencies, it is difficult to adhere the web to surface 484 of cylinder 480 firmly enough to remove the web from the fabric thoroughly. This aspect of the process is important, particularly, when it is desired to use a high velocity drying hood.

The use of particular adhesives cooperate with a moderately moist web (25-70% consistency) to adhere it to the Yankee sufficiently to allow for a high velocity operation of the system and high jet velocity impingement air drying and subsequent peeling of the web from the Yankee. In this connection, a poly(vinyl alcohol)/polyamide adhesive composition as noted above is applied at 486 as needed, preferably, at a rate of less than about 40 mg/m$^2$ of sheet. Build-up is controlled as described hereafter.

The web is dried on Yankee cylinder 480, which is a heated cylinder and by high jet velocity impingement air in Yankee hood 488. Hood 488 is capable of variable temperature. During operation, temperature may be monitored at wet-end A of the Hood and dry end B of the hood using an infra-red detector or any other suitable means if so desired. As the cylinder rotates, web 444 is peeled from the cylinder at 489 and wound on a take-up reel 490. Reel 490 may be operated 5-30 fpm (preferably 10-20 fpm) faster than the Yankee cylinder at steady-state when the line speed is 2100 fpm, for example. A creping doctor C is normally used and a cleaning doctor D mounted for intermittent engagement is used to control build up. When adhesive build-up is being stripped from Yankee cylinder 480 the web is typically segregated from the product on reel 490, preferably, being fed to a broke chute at 500 for recycle to the production process.

Instead of being peeled from cylinder 480 at 489 during a steady-state operation as shown, the web may be creped from dryer cylinder 480 using a creping doctor such as creping doctor C, if so desired.

Utilizing the above procedures a series of "peeled" towel products were prepared utilizing the W013 fabric. Process parameters and product attributes are in Tables 10, 11 and 12, below.

TABLE 10

| Single-Ply Towel Sheet | | | | | |
|---|---|---|---|---|---|
| Roll ID | 11429 | 11418 | 11441 | 11405 | 11137 |
| NSWK | 100% | 50% | 100% | 50% | |
| Recycled Fiber | | 50% | | 50% | 100% |
| % Fabric Crepe | 5% | 5% | 5% | 5% | 5% |
| Suction (Hg) | 23 | 23 | 23 | 23 | 23 |
| WSR (#/T) | 12 | 12 | 12 | 12 | 12 |
| CMC (#/T) | 3 | 1 | 2 | 1 | 1 |
| Parez 631 (#/T) | 9 | 6 | 9 | 3 | 0 |
| PVOH (#/T) | 0.75 | 0.75 | 0.75 | 0.75 | 0.45 |
| PAE (#/T) | 0.25 | 0.25 | 0.25 | 0.25 | 0.15 |
| Modifier (#/T) | 0.25 | 0.25 | 0.25 | 0.25 | 0.15 |
| Yankee Speed (fpm) | 1599 | 1768 | 1599 | 1598 | 1598 |
| Reel Speed (fpm) | 1609 | 1781 | 1609 | 1612 | 1605 |
| Basis Weight (lbs/rm) | 18.4 | 18.8 | 21.1 | 21.0 | 20.3 |
| Caliper (mils/8 sheets) | 41 | 44 | 44 | 45 | 44 |
| Dry MD Tensile (g/3") | 4861 | 5517 | 6392 | 6147 | 7792 |
| Dry CD Tensile (g/3") | 3333 | 3983 | 3743 | 3707 | 4359 |
| GMT (g/3") | 4025 | 4688 | 4891 | 4773 | 5828 |
| MD Stretch (%) | 6.9 | 6.6 | 7.2 | 6.2 | 6.4 |
| CD Stretch (%) | 5.0 | 5.0 | 4.8 | 5.0 | 4.9 |
| Wet MD Cured Tensile (g/3") (Finch) | 1441 | 1447 | 1644 | 1571 | 2791 |
| Wet CD Cured Tensile (g/3") (Finch) | 1074 | 1073 | 1029 | 1064 | 1257 |
| WAR (seconds) (TAPPI) | 33 | 32 | 20 | 20 | 39 |
| MacBeth 3100 L* UV Included | 95.3 | 95.2 | 95.2 | 95.4 | 95.4 |
| MacBeth 3100 A* UV Included | −0.8 | −0.4 | −0.8 | −0.3 | 0.0 |
| MacBeth 3100 B* UV Included | 6.2 | 3.5 | 6.2 | 3.3 | 1.1 |
| MacBeth 3100 Brightness (%) UV Included | 80.6 | 83.5 | 80.3 | 84.3 | 87.1 |
| GM Break Modulus | 691 | 817 | 831 | 858 | 1033 |
| Sheet Width (inches) | 7.9 | 7.9 | 7.9 | 7.9 | 7.9 |
| Roll Diameter (inches) | 7.8 | 7.9 | 8.0 | 7.9 | 8.1 |
| Roll Compression (%) | 1.3 | 1.3 | 1.2 | 1.1 | 1.1 |
| AVE Bending Length (cm) | 3.7 | 3.9 | 4.0 | 4.1 | 4.7 |

TABLE 11

| Single-Ply Towel | | | | | | | | |
|---|---|---|---|---|---|---|---|---|
| | 89460 | 89460 | 89460 | 89460 | 89460 | | | |
| | Roll ID | | | | | | | |
| | 11443 | 11414 | 11437 | 11396 | 11137 | Target | Max | Min |
| NSWK | 100% | 50% | 100% | 50% | | | | |
| Recycled Fiber | | 50% | | 50% | 100% | | | |
| Parez 631 (#/T) | 9 | 6 | 9 | 3 | 0 | | | |
| PVOH (#/T) | 0.75 | 0.75 | 0.75 | 0.75 | 0.45 | | | |
| PAE (#/T) | 0.25 | 0.25 | 0.25 | 0.25 | 0.15 | | | |
| Modifier (#/T) | 0.25 | 0.25 | 0.25 | 0.25 | 0.15 | | | |
| Basis Weight (lbs/rm) | 18.4 | 18.4 | 21.1 | 20.9 | 20.0 | 20.8 | 22.0 | 19.6 |
| Caliper (mils/8 sheets) | 48 | 52 | 49 | 53 | 47 | 50 | 55 | 45 |
| Dry MD Tensile (g/3") | 5050 | 5374 | 6470 | 6345 | 7814 | 6500 | 8000 | 5000 |
| Dry CD Tensile (g/3") | 3678 | 3928 | 3869 | 3817 | 4314 | 4000 | 5000 | 3000 |
| MD Stretch (%) | 7.0 | 7.5 | 7.2 | 7.4 | 7.0 | 6 | 8 | 4 |
| CD Stretch (%) | 4.9 | 5.2 | 4.8 | 5.2 | 4.9 | | | |
| Wet MD Cured Tensile (g/3") (Finch) | 1711 | 1557 | 1888 | 1851 | 2258 | | | |
| Wet CD Cured Tensile (g/3") (Finch) | 1105 | 1086 | 1005 | 1163 | 1115 | 900 | 1250 | 625 |
| WAR (seconds) (TAPPI) | 43 | 29 | 26 | 23 | 34 | 18 | 35 | 1 |
| MacBeth 3100 L* UV Included | 95.1 | 95.1 | 95.0 | 95.2 | 95.5 | | | |
| MacBeth 3100 A* UV Included | −0.9 | −0.4 | −0.8 | −0.4 | −0.3 | | | |
| MacBeth 3100 B* UV Included | 6.2 | 3.6 | 6.1 | 3.3 | 1.4 | | | |
| MacBeth 3100 Brightness (%) UV Included | 80 | 83 | 80 | 84 | 87 | | | |
| GM Break Modulus | 737 | 734 | 853 | 793 | 991 | | | |
| Roll Diameter (inches) | 7.9 | 8.0 | 8.0 | 8.1 | 8.0 | 8.0 | 7.8 | 8.2 |
| AVE Bending Length - MD (cm) | 4.0 | 4.0 | 4.2 | 4.1 | 4.8 | 4.5 | 5.3 | 3.7 |

TABLE 12

| Single-Ply Towel Sheet | | | |
|---|---|---|---|
| Roll ID | Base sheet 11171 | Base sheet 9691 | Base sheet 9806 |
| NSWK | 100% | 100% | 100% |
| Fabric | Prolux W13 | 36G | 44G |
| % Fabric Crepe | 5% | 5% | 5% |
| Refining (amps) | 48 | 43 | 44 |
| Suction (Hg) | 23 | 19 | 23 |
| WSR (#/T) | 13 | 13 | 11 |
| CMC (#/T) | 2 | 1 | 1 |
| Parez 631 (#/T) | 0 | 0 | 0 |
| PVOH (#/T) | 0.45 | 0.75 | 0.75 |
| PAE (#/T) | 0.15 | 0.25 | 0.25 |
| Modifier (#/T) | 0.15 | 0.25 | 0.25 |
| Yankee Speed (fpm) | 1599 | 1749 | 1749 |
| Reel Speed (fpm) | 1606 | 1760 | 1760 |
| Yankee Steam (psi) | 45 | 45 | 45 |
| Moisture % | 2.5 | 4.0 | 2.6 |
| Caliper mils/8 sht | 60.2 | 50.4 | 51.7 |
| Basis Weight lb/3000 ft^2 | 20.9 | 20.6 | 20.8 |
| Tensile MD g/3 in | 6543 | 5973 | 6191 |
| Stretch MD % | 6 | 7 | 7 |
| Tensile CD g/3 in | 3787 | 3963 | 3779 |
| Stretch CD % | 4.4 | 4.1 | 4.3 |
| Wet Tens Finch Cured-CD g/3 in. | 1097 | 1199 | 1002 |
| Tensile GM g/3 in. | 4976 | 4864 | 4836 |
| Water Abs Rate 0.1 mL sec | 20 | 22 | 20 |
| Break Modulus GM gms/% | 973 | 913 | 894 |
| Tensile Dry Ratio | 1.7 | 1.5 | 1.6 |
| Tensile Total Dry g/3 in | 10331 | 9936 | 9970 |
| Tensile Wet/Dry CD | 29% | 30% | 27% |
| Ovrhang Dwn-MD cms | 9.8 | 7.6 | 8.0 |
| Bending Len MD Yank Do cm | 4.9 | 3.8 | 4.0 |
| Bending Len MD Yank Up cm | 5.0 | 4.8 | 9.0 |

TABLE 12-continued

| Single-Ply Towel Sheet | | | |
|---|---|---|---|
| Roll ID | Base sheet 11171 | Base sheet 9691 | Base sheet 9806 |
| Ovrhang Yankee Up-MD cms | 9.9 | 9.6 | 4.5 |
| AVE Bending Length-MD (cm) | 4.9 | 4.3 | 4.2 |

Note, that here again, the present invention makes it possible to employ elevated levels of recycled fiber in the towel without compromising product quality. Also, a reduced add-on rate of Yankee coatings was preferred when running 100% recycled fiber. The addition of recycled fiber also made it possible to reduce the use of dry strength resin.

Figure 33:
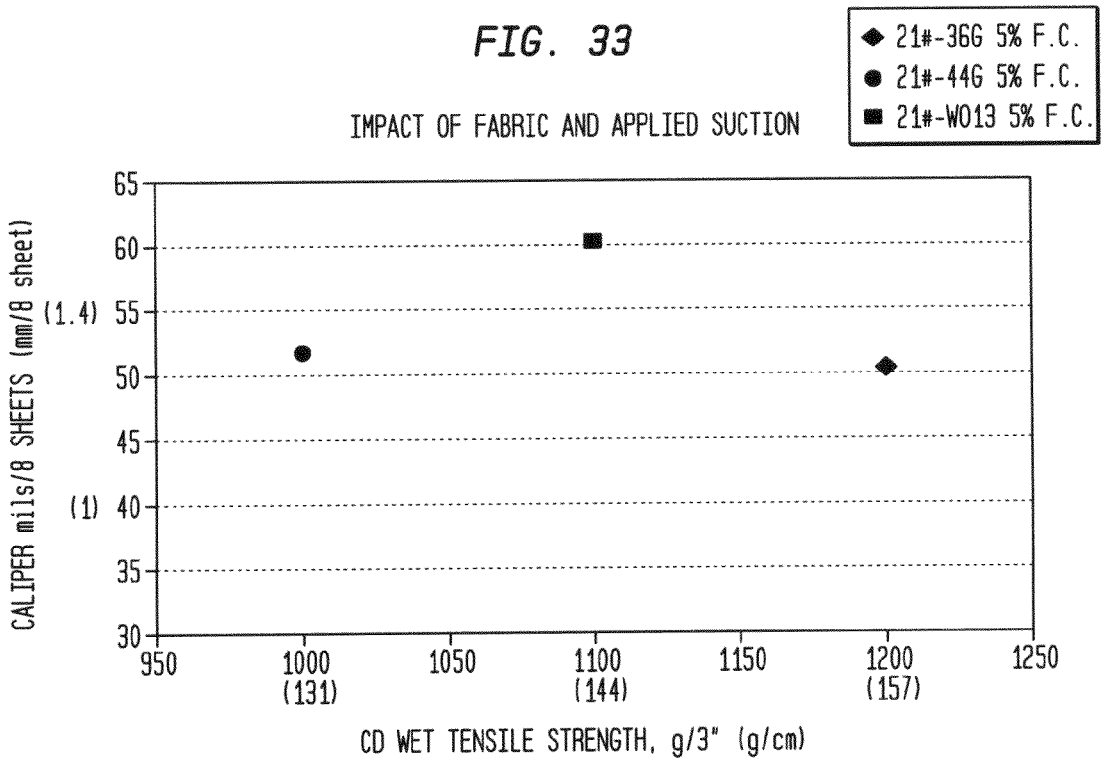
FIG. 33 is a plot of caliper versus CD wet tensile strength for various fabric creped sheets.
Figure 34:
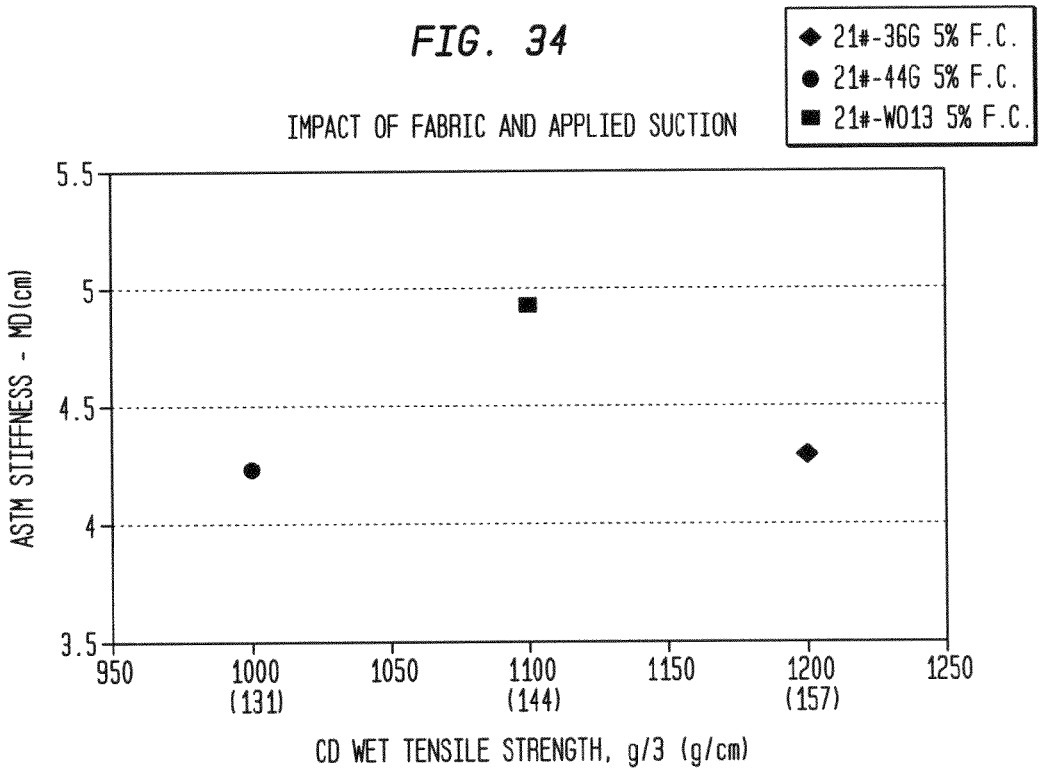
FIG. 34 is a plot of stiffness versus CD wet tensile for various fabric creped sheets, which are particularly useful for automatic touchless dispensers.

In FIGS. 33 and 34, it is seen that the high MD bending length product produced on the apparatus of FIG. 32 exhibited relatively high levels of CD wet tensile strength and surprisingly elevated levels of caliper.

Reel Crepe Response

The multilayer fabric illustrated and described in connection with FIGS. 7 and 8 is capable of providing much enhanced reel crepe response with many products. This feature allows production flexibility and more efficient paper-machine operation, since more caliper can be achieved at a given line crepe and/or wet-end speed (a production bottleneck on many machines) can be more fully utilized, as will be appreciated from the discussion which follows.

Reel Crepe Examples

Towel base sheets were made from a furnish consisting of 100% Southern Softwood Kraft pulp. The base sheets were all made to the same targeted basis weight (15 lbs/3000 ft2 ream), tensile strength (1400 g/3 inches geometric mean tensile), and tensile ratio (1.0). The base sheets were creped using several fabrics. For the single layer fabrics, sheets were creped using both sides of the fabric. The notation "MD" or "CD" in the fabric designation indicates whether the fabric's machine direction or cross direction knuckles were contacting the base sheet. The purpose of the experiment was to determine the level of fabric crepe beyond which no increases in base sheet caliper would be realized.

For each fabric, base sheets were made to the targets mentioned above at a selected level of fabric crepe, with no reel crepe. The fabric crepe was then increased, in increments of five percent and refining and jet/wire ratio adjusted as needed to again obtain the targeted sheet parameters. This process was repeated until an increase in fabric crepe did not result in an increase in base sheet caliper, or until practical operating limitations were reached.

Figure 35:
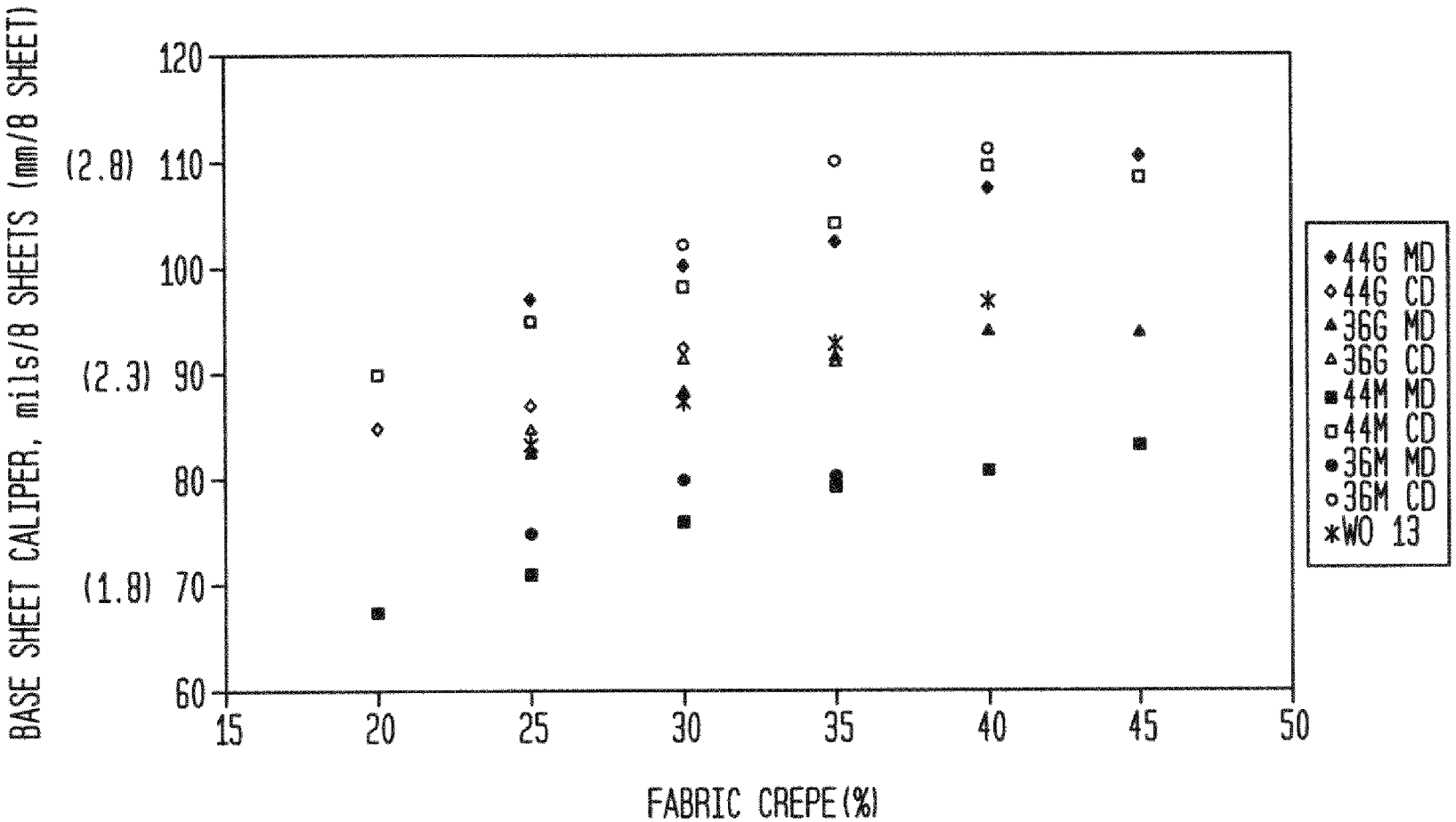
FIG. 35 is a plot of base sheet caliper versus fabric crepe.

The results of these experiments are shown in FIG. 35. These data show that, at 0% reel crepe the caliper generated using the W013 fabric can be matched or exceeded by several single layer fabrics.

For several of the fabrics, trials were also run in which reel crepe, in addition to fabric crepe, was used to reach a desired caliper level of approximately 95 mils/8 sheets. The results of these trials are shown in Table 13. The designations "FC" and "RC" stand for the levels of fabric crepe and reel crepe, respectively, used to produce the base sheets.

The trial results show that, for the single layer fabrics (the "M" and "G" fabrics), gains in caliper with the addition of reel crepe were all about one mil/8 sheets of caliper for each percent of reel crepe employed. However, the gain in caliper with the addition of reel crepe seen for the W013 fabric was dramatically higher; a Caliper Gain/% Reel Crepe ratio of 3 is readily achieved. In other words, instead of a 1 point caliper gain with 1 point of reel crepe, 3 points of caliper gain are achieved per point of reel crepe employed in the process when using the fabric with the long MD knuckles.

TABLE 13

Impact of Reel Crepe on Base Sheet Caliper
All Caliper Values Normalized to 15 lbs/ream Basis Weight

| Fabric | 44G CD | 36G CD | 36G MD | 44M MD | 36M MD | W013 |
|---|---|---|---|---|---|---|
| FC/RC (%) | 30/0 | 40/0 | 30/0 | 40/0 | 30/0 | 25/0 |
| Line Crepe (%) | 30 | 40 | 30 | 40 | 30 | 25 |
| Caliper (mils/8 sheets) | 92.4 | 94.1 | 91.5 | 80.9 | 79.7 | 83.3 |
| FC/RC (%) | 30/5 | 40/2 | 30/5 | 40/12 | 30/15 | 25/7 |
| Line Crepe (%) | 36.5 | 42.8 | 36.5 | 56.8 | 49.5 | 33.75 |
| Caliper (mils/8 sheets) | 95.2 | 96.0 | 96.5 | 93.6 | 97.3 | 103.2 |
| Caliper Gain/% Reel Crepe Ratio | 0.6 | 1.0 | 1.0 | 1.1 | 1.2 | 2.8 |

With the W013 fabric, fabric crepe can be reduced 3 times as fast as reel crepe and still maintain caliper. For example, if a process is operating achieving 100 caliper with the W013 fabric at 1.35 total crepe ratio (30% fabric crepe and 4% reel crepe for a 35% overall crepe) and it is desired to increase tensile capability while maintaining caliper, one could do the following: reduce fabric crepe to 21% (tensiles will likely rise) and then increase reel crepe at 7% for an overall ratio of 1.295 or 29.5% overall crepe; thus generating both more tensile and maintaining caliper (less crepe, and much less fabric crepe which is believed more destructive to tensile than reel crepe).

Besides better caliper and tensile control, a papermachine can be made much more productive. For example, on a 15 lb towel base sheet using a 44 M fabric 57% line crepe was required for a final caliper of 94. The multilayer W013 fabric produced a caliper of 103 at about 34% line crepe. Using these approximate values, a paper machine with a 6000 fpm wet-end speed limit would have a speed limit of 3825 fpm at the reel to meet a 94 caliper target for the base sheet with the 44M fabric. However, use of the W013 fabric can yield nearly 10 points of caliper, which should make it possible to speed up the reel to 4475 (6000/1.34 versus 6000/1.57) fpm.

Further, the multilayer fabric with the long MD knuckles makes it possible to reduce basis weight and maintain caliper and tensiles. Less fabric crepe calls for less refining to meet tensiles even at a given line crepe (again assuming reel crepe is much less destructive of tensile than fabric crepe). As the product weight goes down, fabric crepe can be reduced 3 percentage points for every percentage increase in reel crepe thereby making it easier to maintain caliper and retain tensile.

Figure 36:
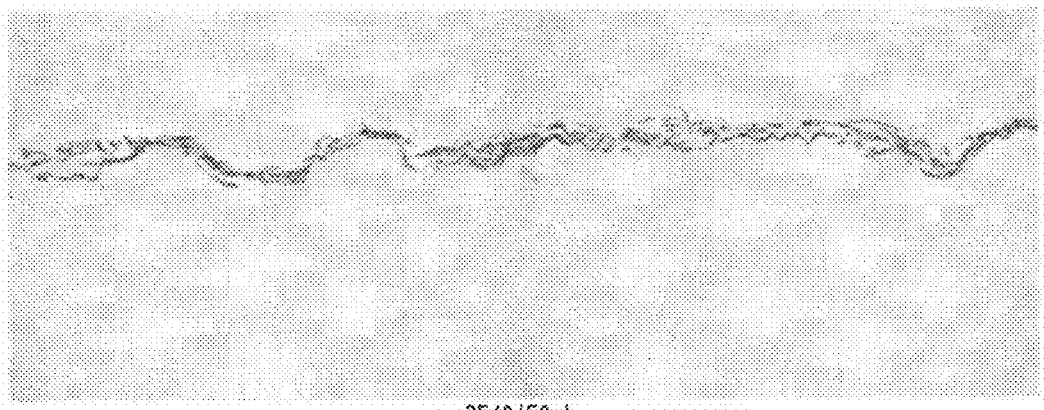
FIGS. 36-38 are photomicrographs showing the effect of combined reel crepe and fabric crepe on an absorbent sheet.
Figure 37:
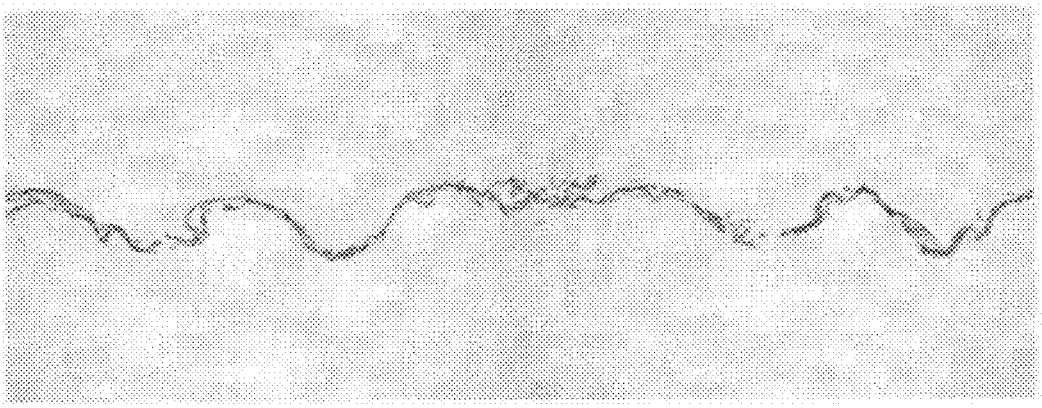
Figure 38:
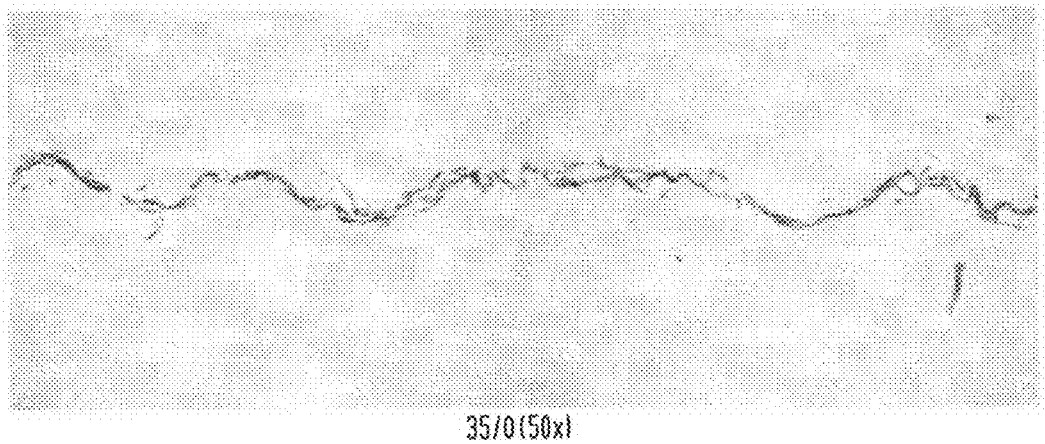

The reel crepe effects of Table 13 are confirmed in the photomicrographs of FIGS. 36-38, which are taken along the MD (60 micron thick samples) of fabric-creped sheet. FIG. 36 depicts a web with 25% fabric crepe and no reel crepe. FIG. 37 depicts a web made with 25% reel crepe and 7% fabric crepe where it is seen the crepe is dramatically more prominent then in FIG. 36. FIG. 38 depicts a web with 35% fabric crepe and no reel crepe. The web of FIG. 37 appears to have significantly more crepe than that of FIG. 38, despite having been made with about the same line crepe.

In many cases, the fabric creping techniques revealed in the following co-pending applications will be especially suitable for making products: U.S. patent application Ser. No. 11/678,669, entitled "Method of Controlling Adhesive Build-Up on a Yankee Dryer"; U.S. patent application Ser. No. 11/451,112 (Publication No. US 2006-0289133), filed Jun. 12, 2006, entitled "Fabric-Creped Sheet for Dispensers"; U.S. patent application Ser. No. 11/451,111, filed Jun. 12, 2006 (Publication No. US 2006-0289134), entitled "Method of Making Fabric-creped Sheet for Dispensers"; U.S. patent application Ser. No. 11/402,609 (Publication No. US 2006-0237154), filed Apr. 12, 2006, entitled "Multi-Ply Paper Towel With Absorbent Core"; U.S. patent application Ser. No. 11/151,761, filed Jun. 14, 2005 (Publication No. US 2005/0279471), entitled "High Solids Fabric-crepe Process for Producing Absorbent Sheet with In-Fabric Drying"; U.S. patent application Ser. No. 11/108,458, filed Apr. 18, 2005 (Publication No. US 2005-0241787), entitled "Fabric-Crepe and In Fabric Drying Process for Producing Absorbent Sheet"; U.S. patent application Ser. No. 11/108,375, filed Apr. 18, 2005 (Publication No. US 2005-0217814), entitled "Fabric-Crepe/Draw Process for Producing Absorbent Sheet"; U.S. patent application Ser. No. 11/104,014, filed Apr. 12, 2005 (Publication No. US 2005-0241786), entitled "Wet-Pressed Tissue and Towel Products With Elevated CD Stretch and Low Tensile Ratios Made With a High Solids Fabric-Crepe Process"; U.S. patent application Ser. No. 10/679,862 (Publication No. US 2004-0238135), filed Oct. 6, 2003, entitled "Fabric-crepe Process for Making Absorbent Sheet"; U.S. Provisional Patent Application No. 60/903,789, filed Feb. 27, 2007, entitled "Fabric Crepe Process With Prolonged Production Cycle"; and U.S. Provisional Patent Application No. 60/808,863, filed May 26, 2006, entitled "Fabric-creped Absorbent Sheet with Variable Local Basis Weight". The applications referred to immediately above are particularly relevant to the selection of machinery, materials, processing conditions, and so forth, as to fabric creped products of the present invention, and the disclosures of these applications are incorporated herein by reference.

While the invention has been described in detail, modifications within the spirit and scope of the invention will be readily apparent to those of skill in the art. In view of the foregoing discussion, relevant knowledge in the art and references including co-pending applications discussed above in connection with the Background and Detailed Description, the disclosures of which are all incorporated herein by reference, further description is deemed unnecessary.

What is claimed is:

1. An absorbent cellulosic sheet having a variable local basis weight, the sheet comprising:

a papermaking-fiber reticulum provided with:

(a) a plurality of elongated densified regions of compressed papermaking fibers, the densified regions being oriented generally along the machine direction (MD) of the sheet and having a relatively low local basis weight, as well as leading and trailing edges at their longitudinal extremities; and (b) a plurality of fiber-enriched, pileated regions connected with the plurality of elongated densified regions, the pileated regions having (i) a relatively high local basis weight and (ii) a plurality of cross-machine direction (CD) extending crests having concamerated CD profiles such that the extending crests of the pileated regions are arcuate and extend around corresponding leading and trailing edges of the plurality of elongated densified regions.

2. The absorbent cellulosic sheet according to claim 1, wherein representative areas within the fiber-enriched regions exhibit a characteristic local basis weight at least 25% higher than a characteristic local basis weight of representative areas within the densified regions.

3. The absorbent cellulosic sheet according to claim 2, wherein the characteristic local basis weight of representative areas within the fiber-enriched regions is at least 35% higher than the characteristic local basis weight of representative areas within the densified regions.

4. The absorbent cellulosic sheet according to claim 2, wherein the characteristic local basis weight of representative areas within the fiber-enriched regions is at least 50% higher than the characteristic local basis weight of representative areas within the densified regions.

5. The absorbent cellulosic sheet according to claim 2, wherein the characteristic local basis weight of representative areas within the fiber-enriched regions is at least 75% higher than the characteristic local basis weight of representative areas within the densified regions.

6. The absorbent cellulosic sheet according to claim 2, wherein the characteristic local basis weight of representative areas within the fiber-enriched regions is at least 100% higher than the characteristic local basis weight of representative areas within the densified regions.

7. The absorbent cellulosic sheet according to claim 2, wherein the characteristic local basis weight of representative areas within the fiber-enriched regions is at least 150% higher than the characteristic local basis weight of representative areas within the densified regions.

8. The absorbent cellulosic sheet according to claim 2, wherein the characteristic local basis weight of representative areas within the fiber-enriched regions is from 25% to 200% higher than the characteristic local basis weight of representative areas within the densified regions.

9. An absorbent cellulosic sheet having a variable local basis weight, the sheet comprising:

a papermaking-fiber reticulum provided with (i) a plurality of fiber-enriched pileated regions of a relatively high local basis weight each extending a distance in the cross-machine direction (CD) of the sheet and having a fiber bias toward the CD of the sheet adjacent to (ii) a plurality of elongated densified regions of a relatively low local basis weight each extending a distance in the machine direction (MD) of the sheet, the densified regions being arranged in a repeating pattern having leading and trailing edges, such that the densified regions are longitudinally staggered with respect to each other, wherein the fiber-enriched regions are interspersed between and connected with the densified regions, and wherein the densified regions occupy from about 5% to about 30% of the area of the sheet, and the fiber-enriched regions occupy from about 95% to about 50% of the area of the sheet.

10. An absorbent cellulosic sheet having a variable local basis weight, the sheet comprising:

(i) a plurality of fiber-enriched regions of a relatively high local basis weight each extending a distance in the cross-machine direction (CD) of the sheet; and (ii) a plurality of elongated densified regions of a low basis weight each extending a distance in the machine direction (MD) of the sheet, the densified regions being arranged in a repeating pattern having leading and trailing edges, such that the densified regions are longitudinally staggered with respect to each other, wherein the fiber-enriched regions are interspersed between and connected with the densified regions, wherein the densified regions occupy from about 5% to about 30% of the area of the sheet, and the fiber-enriched regions occupy from about 95% to about 50% of the area of the sheet, and wherein representative areas within the fiber-enriched regions exhibit a characteristic local basis weight at least 25% higher than a characteristic local basis weight of representative areas within the densified regions.

11. The absorbent cellulosic sheet according to claim 10, wherein the characteristic local basis weight of representative areas within the fiber-enriched regions is at least 35% higher than the characteristic local basis weight of representative areas within the densified regions.

12. The absorbent cellulosic sheet according to claim 10, wherein the characteristic local basis weight of representative areas within the fiber-enriched regions is at least 50% higher than the characteristic local basis weight of representative areas within the densified regions.

13. The absorbent cellulosic sheet according to claim 10, wherein the characteristic local basis weight of representative areas within the fiber-enriched regions is at least 75% higher than the characteristic local basis weight of representative areas within the densified regions.

14. The absorbent cellulosic sheet according to claim 10, wherein the characteristic local basis weight of representative areas within the fiber-enriched regions is at least 100% higher than the characteristic local basis weight of representative areas within the densified regions.

15. The absorbent cellulosic sheet according to claim 10, wherein the characteristic local basis weight of representative areas within the fiber-enriched regions is at least 150% higher than the characteristic local basis weight of representative areas within the densified regions.

16. The absorbent cellulosic sheet according to claim 10, wherein the characteristic local basis weight of representative areas within the fiber-enriched regions is from 25% to 200% higher than the characteristic local basis weight of representative areas within the densified regions.

17. An absorbent cellulosic sheet having a variable local basis weight, the sheet comprising:

(i) a plurality of fiber-enriched regions of a relatively high local basis weight each extending a distance in the cross-machine direction (CD) of the sheet; and (ii) a plurality of elongated densified regions of a low basis weight each extending a distance in the machine direction (MD) of the sheet, the densified regions being arranged in a repeating pattern having leading and trailing edges, such that the densified regions are longitudinally staggered with respect to each other, wherein the fiber-enriched regions are interspersed between and connected with the densified regions, and wherein the distance that the fiber-enriched regions extend in the CD is from about 0.25 to about 3 times the distance that the densified regions extend in the MD.

18. The absorbent sheet according to claim 17, wherein the fiber-enriched regions are pileated regions having a plurality of macrofolds.

19. The absorbent sheet according to claim 17, wherein the densified regions have an MD/CD aspect ratio of greater than 2.

20. The absorbent sheet according to claim 17, wherein the densified regions have an MD/CD aspect ratio of greater than 3.

21. The absorbent sheet according to claim 17, wherein the densified regions have an MD/CD aspect ratio of between about 2 and 6.

22. An absorbent cellulosic sheet having a variable local basis weight, the sheet comprising:

a papermaking-fiber reticulum provided with:

(a) a plurality of elongated densified regions of compressed papermaking fibers, the densified regions being oriented generally along the machine direction (MD) of the sheet and having a relatively low local basis weight, as well as leading and trailing edges at their longitudinal extremities; and (b) a plurality of fiber-enriched, pileated regions connected with the plurality of elongated densified regions, the pileated regions having (i) a relatively high local basis weight and (ii) a plurality of cross-machine direction (CD) extending crests having concamerated CD profiles such that the extending crests of the pileated regions arch around corresponding leading and trailing edges of the plurality of elongated densified regions.

23. The absorbent cellulosic sheet according to claim 22, wherein representative areas within the fiber-enriched regions exhibit a characteristic local basis weight at least 25% higher than a characteristic local basis weight of representative areas within the densified regions.

24. The absorbent cellulosic sheet according to claim 23, wherein the characteristic local basis weight of representative areas within the fiber-enriched regions is at least 35% higher than the characteristic local basis weight of representative areas within the densified regions.

25. The absorbent cellulosic sheet according to claim 23, wherein the characteristic local basis weight of representative areas within the fiber-enriched regions is at least 50% higher than the characteristic local basis weight of representative areas within the densified regions.

26. The absorbent cellulosic sheet according to claim 23, wherein the characteristic local basis weight of representative areas within the fiber-enriched regions is at least 75% higher than the characteristic local basis weight of representative areas within the densified regions.

27. The absorbent cellulosic sheet according to claim 23, wherein the characteristic local basis weight of representative areas within the fiber-enriched regions is at least 100% higher than the characteristic local basis weight of representative areas within the densified regions.

28. The absorbent cellulosic sheet according to claim 23, wherein the characteristic local basis weight of representative areas within the fiber-enriched regions is at least 150% higher than the characteristic local basis weight of representative areas within the densified regions.

29. The absorbent cellulosic sheet according to claim 23, wherein the characteristic local basis weight of representative areas within the fiber-enriched regions is from 25% to 200% higher than the characteristic local basis weight of representative areas within the densified regions.

* * * * *